US009334711B2

(12) United States Patent
Hannegan et al.

(10) Patent No.: US 9,334,711 B2
(45) Date of Patent: May 10, 2016

(54) SYSTEM AND METHOD FOR COOLING A ROTATING CONTROL DEVICE

(71) Applicant: Weatherford Technology Holdings, LLC, Houston, TX (US)

(72) Inventors: Don M. Hannegan, Fort Smith, AR (US); Thomas F. Bailey, Abilene, TX (US); Melvin T. Jacobs, Fort Smith, AR (US); Nicky A. White, Poteau, OK (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/163,617

(22) Filed: Jan. 24, 2014

(65) Prior Publication Data

US 2014/0138094 A1 May 22, 2014

Related U.S. Application Data

(60) Continuation of application No. 13/735,203, filed on Jan. 7, 2013, now Pat. No. 8,636,087, which is a division of application No. 12/462,266, filed on Jul. 31, 2009, now Pat. No. 8,347,983.

(51) Int. Cl.
*E21B 36/00* (2006.01)
*E21B 47/00* (2012.01)
(Continued)

(52) U.S. Cl.
CPC ..... *E21B 36/001* (2013.01); *E21B 21/00* (2013.01); *E21B 33/085* (2013.01); *E21B 33/13* (2013.01); *E21B 43/10* (2013.01)

(58) Field of Classification Search
CPC ... E21B 36/001; E21B 21/08; E21B 33/0355; E21B 33/085; E21B 47/065; E21B 47/12; G01N 2203/0037
See application file for complete search history.

(56) References Cited

U.S. PATENT DOCUMENTS 517,509 A 4/1894 Williams
1,157,644 A 10/1915 London
(Continued)

FOREIGN PATENT DOCUMENTS

AU 2010206020 2/2011
AU 2014200241 1/2014
(Continued)

OTHER PUBLICATIONS

Partial European Search Report (R. 64 EPC) dated Apr. 3, 2014 for European Patent Application 10171045.7-1610/2295712 corresponding to U.S. Appl. No. 12/462,266, published as US-2011-0024195 A1 on Feb. 3, 2011, now issued as U.S. Pat. No. 8,347,983 (our matter 62) from which U.S. Appl. No. 13/735,203 claims priority, now issued as U.S. Pat. No. 8,636,087 (our matter 75), in which this U.S. Appl. No. 14/163,617 claims priority (5 pages).
(Continued)

*Primary Examiner* — Zakiya W Bates
(74) *Attorney, Agent, or Firm* — Strasburger & Price, LLP

(57) ABSTRACT

A Drill-To-The-Limit (DTTL) drilling method variant to Managed Pressure Drilling (MPD) applies constant surface backpressure, whether the mud is circulating (choke valve open) or not (choke valve closed). A sensor measures the temperature in a cavity defined by a rotating control device "RCD" first sealing element and second sealing element, an inner member and a tubular. The RCD cavity is cooled by communicating/supplying or calculating/cooling fluid to the RCD cavity.

28 Claims, 28 Drawing Sheets

(51) Int. Cl.

| | |
|---|---|
| ***E21B 21/00*** | (2006.01) |
| ***E21B 33/08*** | (2006.01) |
| ***E21B 43/10*** | (2006.01) |
| ***E21B 33/13*** | (2006.01) |

(56) References Cited

U.S. PATENT DOCUMENTS

| | | | |
|---|---|---|---|
| 1,472,952 | A | 11/1923 | Anderson |
| 1,503,476 | A | 8/1924 | Childs et al. |
| 1,528,560 | A | 3/1925 | Myers et al. |
| 1,546,467 | A | 7/1925 | Bennett |
| 1,560,763 | A | 11/1925 | Collins |
| 1,700,894 | A | 2/1929 | Joyce et al. |
| 1,708,316 | A | 4/1929 | MacClatchie |
| 1,769,921 | A | 7/1930 | Hansen |
| 1,776,797 | A | 9/1930 | Sheldon |
| 1,813,402 | A | 7/1931 | Hewitt |
| 2,038,140 | A | 7/1931 | Stone |
| 1,831,956 | A | 11/1931 | Harrington |
| 1,836,470 | A | 12/1931 | Humason et al. |
| 1,902,906 | A | 3/1933 | Seamark |
| 1,942,366 | A | 1/1934 | Seamark |
| 2,036,537 | A | 4/1936 | Otis |
| 2,071,197 | A | 2/1937 | Burns et al. |
| 2,124,015 | A | 7/1938 | Stone et al. |
| 2,126,007 | A | 8/1938 | Gulberson et al. |
| 2,144,682 | A | 1/1939 | MacClatchie |
| 2,148,844 | A | 2/1939 | Stone et al. |
| 2,163,813 | A | 6/1939 | Stone et al. |
| 2,165,410 | A | 7/1939 | Penick et al. |
| 2,170,915 | A | 8/1939 | Schweitzer |
| 2,170,916 | A | 8/1939 | Schweitzer et al. |
| 2,175,648 | A | 10/1939 | Roach |
| 2,176,355 | A | 10/1939 | Otis |
| 2,185,822 | A | 1/1940 | Young |
| 2,199,735 | A | 5/1940 | Beckman |
| 2,211,122 | A | 8/1940 | Howard |
| 2,222,082 | A | 11/1940 | Leman et al. |
| 2,233,041 | A | 2/1941 | Alley |
| 2,243,340 | A | 5/1941 | Hild |
| 2,243,439 | A | 5/1941 | Pranger et al. |
| 2,287,205 | A | 6/1942 | Stone |
| 2,303,090 | A | 11/1942 | Pranger et al. |
| 2,313,169 | A | 3/1943 | Penick et al. |
| 2,325,556 | A | 7/1943 | Taylor, Jr. et al. |
| 2,338,093 | A | 1/1944 | Caldwell |
| 2,480,955 | A | 9/1949 | Penick |
| 2,506,538 | A | 5/1950 | Bennett |
| 2,529,744 | A | 11/1950 | Schweitzer, Jr. |
| 2,609,836 | A | 9/1952 | Knox |
| 2,628,852 | A | 2/1953 | Voytech |
| 2,646,999 | A | 7/1953 | Barske |
| 2,649,318 | A | 8/1953 | Skillman |
| 2,731,281 | A | 1/1956 | Knox |
| 2,746,781 | A | 5/1956 | Jones |
| 2,760,750 | A | 8/1956 | Schweitzer, Jr. et al. |
| 2,760,795 | A | 8/1956 | Vertson |
| 2,764,999 | A | 10/1956 | Stanbury |
| 2,808,229 | A | 10/1957 | Bauer et al. |
| 2,808,230 | A | 10/1957 | McNeil et al. |
| 2,846,178 | A | 8/1958 | Minor |
| 2,846,247 | A | 8/1958 | Davis |
| 2,853,274 | A | 9/1958 | Collins |
| 2,862,735 | A | 12/1958 | Knox |
| 2,886,350 | A | 5/1959 | Horne |
| 2,904,357 | A | 9/1959 | Knox |
| 2,927,774 | A | 3/1960 | Ormsby |
| 2,929,610 | A | 3/1960 | Stratton |
| 2,962,096 | A | 11/1960 | Knox |
| 2,995,196 | A | 8/1961 | Gibson et al. |
| 3,023,012 | A | 2/1962 | Wilde |
| 3,029,083 | A | 4/1962 | Wilde |
| 3,032,125 | A | 5/1962 | Hiser et al. |
| 3,033,011 | A | 5/1962 | Garrett |
| 3,052,300 | A | 9/1962 | Hampton |
| 3,096,999 | A | 7/1963 | Ahlstone et al. |
| 3,100,015 | A | 8/1963 | Regan |
| 2,128,614 | A | 4/1964 | Auer |
| 3,134,613 | A | 5/1964 | Regan |
| 3,176,996 | A | 4/1965 | Barnett |
| 3,203,358 | A | 8/1965 | Regan et al. |
| 3,209,829 | A | 10/1965 | Haeber |
| 3,216,731 | A | 11/1965 | Dollison |
| 3,225,831 | A | 12/1965 | Knox |
| 3,259,198 | A | 7/1966 | Montgomery et al. |
| 3,268,233 | A | 8/1966 | Brown |
| 3,285,352 | A | 11/1966 | Hunter |
| 3,288,472 | A | 11/1966 | Watkins |
| 3,289,761 | A | 12/1966 | Smith et al. |
| 3,294,112 | A | 12/1966 | Watkins |
| 3,302,048 | A | 1/1967 | Gray |
| 3,313,345 | A | 4/1967 | Fischer |
| 3,313,358 | A | 4/1967 | Postlewaite et al. |
| 3,323,773 | A | 6/1967 | Walker |
| 3,333,870 | A | 8/1967 | Watkins |
| 3,347,567 | A | 10/1967 | Watkins |
| 3,360,048 | A | 12/1967 | Watkins |
| 3,372,761 | A | 3/1968 | van Gils |
| 3,387,851 | A | 6/1968 | Cugini |
| 3,397,928 | A | 8/1968 | Galle |
| 3,400,938 | A | 9/1968 | Williams |
| 3,401,600 | A | 9/1968 | Wood |
| 3,405,763 | A | 10/1968 | Pitts et al. |
| 3,421,580 | A | 1/1969 | Fowler et al. |
| 3,424,197 | A | 1/1969 | Yanagisawa |
| 3,443,643 | A | 5/1969 | Jones |
| 3,445,126 | A | 5/1969 | Watkins |
| 3,452,815 | A | 7/1969 | Watkins |
| 3,472,518 | A | 10/1969 | Harlan |
| 3,476,195 | A | 11/1969 | Galle |
| 3,481,610 | A | 12/1969 | Slator et al. |
| 3,485,051 | A | 12/1969 | Watkins |
| 3,492,007 | A | 1/1970 | Jones |
| 3,493,043 | A | 2/1970 | Watkins |
| 3,503,460 | A | 3/1970 | Gadbois |
| 3,522,709 | A | 8/1970 | Vilain |
| 3,529,835 | A | 9/1970 | Lewis |
| 3,561,723 | A | 2/1971 | Cugini |
| 3,583,480 | A | 6/1971 | Regan |
| 3,587,734 | A | 6/1971 | Shaffer |
| 3,603,409 | A | 9/1971 | Watkins |
| 3,621,912 | A | 11/1971 | Wooddy, Jr. |
| 3,631,834 | A | 1/1972 | Gardner et al. |
| 3,638,721 | A | 2/1972 | Harrison |
| 3,638,742 | A | 2/1972 | Wallace |
| 3,653,350 | A | 4/1972 | Koons et al. |
| 3,661,409 | A | 5/1972 | Brown et al. |
| 3,664,376 | A | 5/1972 | Watkins |
| 3,667,721 | A | 6/1972 | Vujasinovic |
| 3,677,353 | A | 7/1972 | Baker |
| 3,724,862 | A | 4/1973 | Biffle |
| 3,741,296 | A | 6/1973 | Murman et al. |
| 3,779,313 | A | 12/1973 | Regan |
| 3,815,673 | A | 6/1974 | Bruce et al. |
| 3,827,511 | A | 8/1974 | Jones |
| 3,847,215 | A | 11/1974 | Herd |
| 3,868,832 | A | 3/1975 | Biffle |
| 3,872,717 | A | 3/1975 | Fox |
| 3,924,678 | A | 12/1975 | Ahlstone |
| 3,934,887 | A | 1/1976 | Biffle |
| 3,952,526 | A | 4/1976 | Watkins et al. |
| 3,955,622 | A | 5/1976 | Jones |
| 3,965,987 | A | 6/1976 | Biffle |
| 3,976,148 | A | 8/1976 | Maus et al. |
| 3,984,990 | A | 10/1976 | Jones |
| 3,992,889 | A | 11/1976 | Watkins et al. |
| 3,999,766 | A | 12/1976 | Barton |
| 4,037,890 | A | 7/1977 | Kurita et al. |
| 4,046,191 | A | 9/1977 | Neath |
| 4,052,703 | A | 10/1977 | Collins, Sr. et al. |
| 4,053,023 | A | 10/1977 | Herd et al. |
| 4,063,602 | A | 12/1977 | Howell et al. |
| 4,087,097 | A | 5/1978 | Bossens et al. |
| 4,091,881 | A | 5/1978 | Maus |

(56) References Cited

U.S. PATENT DOCUMENTS 4,098,341 A 7/1978 Lewis
4,099,583 A 7/1978 Maus
4,109,712 A 8/1978 Regan
4,143,880 A 3/1979 Bunting et al.
4,143,881 A 3/1979 Bunting
4,149,603 A 4/1979 Arnold
4,154,448 A 5/1979 Biffle
4,157,186 A 6/1979 Murray et al.
4,183,562 A 1/1980 Watkins et al.
4,200,312 A 4/1980 Watkins
4,208,056 A 6/1980 Biffle
4,216,835 A 8/1980 Nelson
4,222,590 A 9/1980 Regan
4,249,600 A 2/1981 Bailey
4,281,724 A 8/1981 Garrett
4,282,939 A 8/1981 Maus et al.
4,285,406 A 8/1981 Garrett et al.
4,291,772 A 9/1981 Beynet
4,293,047 A 10/1981 Young
4,304,310 A 12/1981 Garrett
4,310,058 A 1/1982 Bourgoyne, Jr.
4,312,404 A 1/1982 Morrow
4,313,054 A 1/1982 Martini
4,326,584 A 4/1982 Watkins
4,335,791 A 6/1982 Evans
4,336,840 A 6/1982 Bailey
4,337,653 A 7/1982 Chauffe
4,345,769 A 8/1982 Johnston
4,349,204 A 9/1982 Malone
4,353,420 A 10/1982 Miller
4,355,784 A 10/1982 Cain
4,361,185 A 11/1982 Biffle
4,363,357 A 12/1982 Hunter
4,367,795 A 1/1983 Biffle
4,378,849 A 4/1983 Wilks
4,383,577 A 5/1983 Pruitt
4,384,724 A 5/1983 Derman
4,386,667 A 6/1983 Millsapps, Jr.
4,387,771 A 6/1983 Jones
4,398,599 A 8/1983 Murray
4,406,333 A 9/1983 Adams
4,407,375 A 10/1983 Nakamura
4,413,653 A 11/1983 Carter, Jr.
4,416,340 A 11/1983 Bailey
4,423,776 A 1/1984 Wagoner et al.
4,424,861 A 1/1984 Carter, Jr. et al.
4,427,072 A 1/1984 Lawson
4,439,068 A 3/1984 Pokladnik
4,440,232 A 4/1984 LeMoine
4,440,239 A 4/1984 Evans
4,441,551 A 4/1984 Biffle
4,444,250 A 4/1984 Keithahn et al.
4,444,401 A 4/1984 Roche et al.
4,448,255 A 5/1984 Shaffer et al.
4,456,062 A 6/1984 Roche et al.
4,456,063 A 6/1984 Roche
4,457,489 A 7/1984 Gilmore
4,478,287 A 10/1984 Hynes et al.
4,480,703 A 11/1984 Garrett
4,484,753 A 11/1984 Kalsi
4,486,025 A 12/1984 Johnston
4,488,703 A 12/1984 Jones
4,497,592 A 2/1985 Lawson
4,500,094 A 2/1985 Biffle
4,502,534 A 3/1985 Roche et al.
4,508,313 A 4/1985 Jones
4,509,405 A 4/1985 Bates
4,519,577 A 5/1985 Jones
4,524,832 A 6/1985 Roche et al.
4,526,243 A 7/1985 Young
4,527,632 A 7/1985 Chaudot
4,529,210 A 7/1985 Biffle
4,531,580 A 7/1985 Jones
4,531,591 A 7/1985 Johnston
4,531,593 A 7/1985 Elliott et al.
4,531,951 A 7/1985 Burt et al.
4,533,003 A 8/1985 Bailey
4,540,053 A 9/1985 Baugh et al.
4,546,828 A 10/1985 Roche
4,553,591 A 11/1985 Mitchell
D282,073 S 1/1986 Bearden et al.
4,566,494 A 1/1986 Roche
4,575,426 A 3/1986 Bailey
4,595,343 A 6/1986 Thompson et al.
4,597,447 A 7/1986 Roche et al.
4,597,448 A 7/1986 Baugh
4,610,319 A 9/1986 Kalsi
4,611,661 A 9/1986 Hed et al.
4,615,544 A 10/1986 Baugh
4,618,314 A 10/1986 Hailey
4,621,655 A 11/1986 Roche
4,623,020 A 11/1986 Nichols
4,626,135 A 12/1986 Roche
4,630,680 A 12/1986 Elkins
4,632,188 A 12/1986 Schuh et al.
4,646,826 A 3/1987 Bailey et al.
4,646,844 A 3/1987 Roche et al.
4,651,830 A 3/1987 Crotwell
4,660,863 A 4/1987 Bailey
4,688,633 A 8/1987 Barkley
4,690,220 A 9/1987 Braddick
4,697,484 A 10/1987 Klee et al.
4,709,900 A 12/1987 Dyer
4,712,620 A 12/1987 Lim et al.
4,719,937 A 1/1988 Roche et al.
4,722,615 A 2/1988 Bailey et al.
4,727,942 A 3/1988 Galle et al.
4,736,799 A 4/1988 Ahlstone
4,745,970 A 5/1988 Bearden et al.
4,749,035 A 6/1988 Cassity
4,754,820 A 7/1988 Watts et al.
4,757,584 A 7/1988 Pav et al.
4,759,413 A 7/1988 Bailey et al.
4,765,404 A 8/1988 Bailey et al.
4,783,084 A 11/1988 Biffle
4,807,705 A 2/1989 Henderson et al.
4,813,495 A 3/1989 Leach
4,817,724 A 4/1989 Funderburg, Jr. et al.
4,822,212 A 4/1989 Hall et al.
4,825,938 A 5/1989 Davis
4,828,024 A 5/1989 Roche
4,832,126 A 5/1989 Roche
4,836,289 A 6/1989 Young
4,844,406 A 7/1989 Wilson
4,865,137 A 9/1989 Bailey
4,882,830 A 11/1989 Carstensen
4,909,327 A 3/1990 Roche
4,949,796 A 8/1990 Williams
4,955,436 A 9/1990 Johnston
4,955,949 A 9/1990 Bailey et al.
4,962,819 A 10/1990 Bailey et al.
4,971,148 A 11/1990 Roche et al.
4,984,636 A 1/1991 Bailey et al.
4,995,464 A 2/1991 Watkins et al.
5,009,265 A 4/1991 Bailey et al.
5,022,472 A 6/1991 Bailey et al.
5,028,056 A 7/1991 Bemis et al.
5,035,292 A 7/1991 Bailey
5,040,600 A 8/1991 Bailey et al.
5,048,621 A 9/1991 Bailey
5,062,450 A 11/1991 Bailey
5,062,479 A 11/1991 Bailey et al.
5,072,795 A 12/1991 Delgado et al.
5,076,364 A 12/1991 Hale et al.
5,082,020 A 1/1992 Bailey
5,085,277 A 2/1992 Hopper
5,101,897 A 4/1992 Leismer et al.
5,137,084 A 8/1992 Gonzales et al.
5,147,559 A 9/1992 Brophey et al.
5,154,231 A 10/1992 Bailey et al.
5,163,514 A 11/1992 Jennings
5,165,480 A 11/1992 Wagoner et al.
5,178,215 A 1/1993 Yenulis et al.
5,182,979 A 2/1993 Morgan

(56) References Cited

U.S. PATENT DOCUMENTS 5,184,686 A 2/1993 Gonzalez
5,195,754 A 3/1993 Dietle
5,205,165 A 4/1993 Jardine et al.
5,213,158 A 5/1993 Bailey et al.
5,215,151 A 6/1993 Smith et al.
5,224,557 A 7/1993 Yenulis et al.
5,230,520 A 7/1993 Dietle et al.
5,243,187 A 9/1993 Hettlage
5,251,869 A 10/1993 Mason
5,255,745 A 10/1993 Czyrek
5,277,249 A 1/1994 Yenulis et al.
5,279,365 A 1/1994 Yenulis et al.
5,305,839 A 4/1994 Kalsi et al.
5,320,325 A 6/1994 Young et al.
5,322,137 A 6/1994 Gonzales
5,325,925 A 7/1994 Smith et al.
5,348,107 A 9/1994 Bailey et al.
5,375,476 A 12/1994 Gray
5,427,179 A 6/1995 Bailey
5,431,220 A 7/1995 Bailey
5,443,129 A 8/1995 Bailey et al.
5,495,872 A 3/1996 Gallagher et al.
5,529,093 A 6/1996 Gallagher et al.
5,588,491 A 12/1996 Tasson et al.
5,607,019 A 3/1997 Kent
5,647,444 A 7/1997 Williams
5,657,820 A 8/1997 Bailey
5,662,171 A 9/1997 Brugman et al.
5,662,181 A 9/1997 Williams et al.
5,671,812 A 9/1997 Bridges
5,678,829 A 10/1997 Kalsi et al.
5,735,502 A 4/1998 Levett et al.
5,738,358 A 4/1998 Kalsi et al.
5,755,372 A 5/1998 Cimbura
5,823,541 A 10/1998 Dietle et al.
5,829,531 A 11/1998 Hebert et al.
5,848,643 A 12/1998 Carbaugh et al.
5,873,576 A 2/1999 Dietle et al.
5,878,818 A 3/1999 Hebert et al.
5,901,964 A 5/1999 Williams et al.
5,944,111 A 8/1999 Bridges
5,952,569 A 9/1999 Jervis
5,960,881 A 10/1999 Allamon et al.
6,007,105 A 12/1999 Dietle et al.
6,016,880 A 1/2000 Hall et al.
6,017,168 A 1/2000 Fraser, Jr.
6,036,192 A 3/2000 Dietle et al.
6,039,118 A 3/2000 Carter et al.
6,050,348 A 4/2000 Richarson et al.
6,070,670 A 6/2000 Carter et al.
6,076,606 A 6/2000 Bailey et al.
6,102,123 A 8/2000 Bailey et al.
6,102,673 A 8/2000 Mott et al.
6,109,348 A 8/2000 Caraway
6,109,618 A 8/2000 Dietle
6,112,810 A 9/2000 Bailey
6,120,036 A 9/2000 Kalsi et al.
6,129,152 A 10/2000 Hosie et al.
6,138,774 A 10/2000 Bourgoyne, Jr. et al.
6,170,576 B1 1/2001 Bailey
6,202,745 B1 3/2001 Reimert et al.
6,209,663 B1 4/2001 Hosie
6,213,228 B1 4/2001 Saxman
6,227,547 B1 5/2001 Dietle et al.
6,230,824 B1 5/2001 Peterman et al.
6,244,359 B1 6/2001 Bridges et al.
6,263,982 B1 7/2001 Hannegan et al.
6,273,193 B1 8/2001 Hermann
6,315,302 B1 11/2001 Conroy et al.
6,315,813 B1 11/2001 Morgan et al.
6,325,159 B1 12/2001 Peterman et al.
6,334,619 B1 1/2002 Dietle et al.
6,352,129 B1 3/2002 Best
6,354,385 B1 3/2002 Ford et al.
6,361,830 B1 3/2002 Schenk
6,375,895 B1 4/2002 Daemen
6,382,634 B1 5/2002 Dietle et al.
6,386,291 B1 5/2002 Short
6,413,297 B1 7/2002 Morgan et al.
6,450,262 B1 9/2002 Regan
6,454,007 B1 9/2002 Bailey
6,457,529 B2 10/2002 Calder et al.
6,470,975 B1 10/2002 Bourgoyne et al.
6,478,303 B1 11/2002 Radcliffe
6,494,462 B2 12/2002 Dietle
6,504,982 B1 1/2003 Greer, IV
6,505,691 B2 1/2003 Judge
6,520,253 B2 2/2003 Calder
6,536,520 B1 3/2003 Snider et al.
6,536,525 B1 3/2003 Haugen et al.
6,547,002 B1 4/2003 Bailey et al.
6,554,016 B2 4/2003 Kinder
6,561,520 B2 5/2003 Kalsi et al.
6,581,681 B1 6/2003 Zimmerman et al.
6,607,042 B2 8/2003 Hoyer et al.
RE38,249 E 9/2003 Tasson et al.
6,655,460 B2 12/2003 Bailey et al.
6,685,194 B2 2/2004 Dietle et al.
6,702,012 B2 3/2004 Bailey et al.
6,708,762 B2 3/2004 Haugen et al.
6,720,764 B2 4/2004 Relton et al.
6,725,951 B2 4/2004 Looper
6,732,804 B2 5/2004 Hosie et al.
6,747,570 B2 6/2004 Beique et al.
6,749,172 B2 6/2004 Kinder
6,767,016 B2 7/2004 Gobeli et al.
6,796,381 B2 9/2004 Ayler et al.
6,814,142 B2 11/2004 Paulk et al.
6,843,313 B2 1/2005 Hult
6,851,476 B2 2/2005 Gray et al.
6,877,565 B2 4/2005 Edvardsen
6,886,631 B2 5/2005 Wilson et al.
6,896,048 B2 5/2005 Mason et al.
6,896,076 B2 5/2005 Nelson et al.
6,904,981 B2 6/2005 van Riet
6,913,092 B2 7/2005 Bourgoyne
6,945,330 B2 9/2005 Wilson et al.
6,973,977 B2 12/2005 Naquin
7,004,444 B2 2/2006 Kinder
7,007,913 B2 3/2006 Kinder
7,011,167 B2 3/2006 Ebner
7,025,130 B2 4/2006 Bailey et al.
7,028,777 B2 4/2006 Wade et al.
7,032,691 B2 4/2006 Humphreys
7,040,394 B2 5/2006 Bailey et al.
7,044,237 B2 5/2006 Leuchtenberg
7,073,580 B2 7/2006 Wilson et al.
7,077,212 B2 7/2006 Roesner et al.
7,080,685 B2 7/2006 Bailey et al.
7,086,481 B2 8/2006 Hosie et al.
7,152,680 B2 12/2006 Wilson et al.
7,159,669 B2 1/2007 Bourgoyne et al.
7,165,610 B2 1/2007 Hopper
7,174,956 B2 2/2007 Williams et al.
7,178,600 B2 2/2007 Luke et al.
7,191,840 B2 3/2007 Bailey
7,198,098 B2 4/2007 Williams
7,204,315 B2 4/2007 Pia
7,219,729 B2 5/2007 Bostick et al.
7,237,618 B2 7/2007 Williams
7,237,623 B2 7/2007 Hannegan
7,240,727 B2 7/2007 Williams
7,243,958 B2 7/2007 Williams
7,255,173 B2 8/2007 Hosie et al.
7,258,171 B2 8/2007 Bailey
7,278,494 B2 10/2007 Williams
7,278,496 B2 10/2007 Leuchtenberg
7,296,628 B2 11/2007 Robichaux
7,308,954 B2 12/2007 Martin-Marshall
7,325,610 B2 2/2008 Giroux et al.
7,334,633 B2 2/2008 Williams et al.
7,347,261 B2 3/2008 Markel et al.
7,350,590 B2 4/2008 Hosie et al.
7,363,860 B2 4/2008 Wilson et al.

(56) References Cited

U.S. PATENT DOCUMENTS

| | | | |
|---|---|---|---|
| 7,367,411 | B2 | 5/2008 | Leuchtenberg |
| 7,377,334 | B2 | 5/2008 | May |
| 7,380,590 | B2 | 6/2008 | Hughes |
| 7,380,591 | B2 | 6/2008 | Williams |
| 7,380,610 | B2 | 6/2008 | Williams |
| 7,383,876 | B2 | 6/2008 | Gray et al. |
| 7,389,183 | B2 | 6/2008 | Gray |
| 7,392,860 | B2 | 7/2008 | Johnston |
| 7,395,877 | B2 | 7/2008 | Hosie et al. |
| 7,413,018 | B2 | 8/2008 | Hosie et al. |
| 7,416,021 | B2 | 8/2008 | Williams |
| 7,416,226 | B2 | 8/2008 | Williams |
| 7,448,454 | B2 | 11/2008 | Bourgoyne et al. |
| 7,451,809 | B2 | 11/2008 | Noske et al. |
| 7,475,732 | B2 | 1/2009 | Hosie et al. |
| 7,487,837 | B2 | 2/2009 | Bailey et al. |
| 7,513,300 | B2 | 4/2009 | Pietras et al. |
| 7,559,359 | B2 | 7/2009 | Williams |
| 7,635,034 | B2 | 12/2009 | Williams |
| 7,650,950 | B2 | 1/2010 | Leuchtenberg |
| 7,654,325 | B2 | 2/2010 | Giroux et al. |
| 7,669,649 | B2 | 3/2010 | Williams |
| 7,699,109 | B2 | 4/2010 | May et al. |
| 7,708,089 | B2 | 5/2010 | Williams |
| 7,712,523 | B2 | 5/2010 | Snider et al. |
| 7,717,169 | B2 | 5/2010 | Williams |
| 7,717,170 | B2 | 5/2010 | Williams |
| 7,726,416 | B2 | 6/2010 | Williams |
| 7,743,823 | B2 | 6/2010 | Hughes et al. |
| 7,762,320 | B2 | 7/2010 | Williams |
| 7,766,100 | B2 | 8/2010 | Williams |
| 7,779,903 | B2 | 8/2010 | Bailey et al. |
| 7,789,132 | B2 | 9/2010 | Williams |
| 7,789,172 | B2 | 9/2010 | Williams |
| 7,793,719 | B2 | 9/2010 | Snider et al. |
| 7,798,250 | B2 | 9/2010 | Williams |
| 7,802,635 | B2 | 9/2010 | Leduc et al. |
| 7,823,665 | B2 | 11/2010 | Sullivan |
| 7,836,946 | B2 | 11/2010 | Bailey et al. |
| 7,836,973 | B2 | 11/2010 | Belcher et al. |
| 7,926,593 | B2 | 4/2011 | Bailey et al. |
| 8,066,062 | B2 | 11/2011 | Edvardsen et al. |
| 8,347,983 | B2 | 1/2013 | Hoyer et al. |
| 8,636,087 | B2 | 1/2014 | Hannegan et al. |
| 8,881,843 | B2 | 11/2014 | Todd et al. |
| 2002/0149501 | A1 | 10/2002 | Beique et al. |
| 2003/0089506 | A1 | 5/2003 | Ayler et al. |
| 2003/0106712 | A1 | 6/2003 | Bourgoyne et al. |
| 2003/0164276 | A1 | 9/2003 | Snider et al. |
| 2004/0017190 | A1 | 1/2004 | McDearmon et al. |
| 2004/0065477 | A1 | 4/2004 | Paulk et al. |
| 2005/0034898 | A1 | 2/2005 | Naquin |
| 2005/0151107 | A1 | 7/2005 | Shu |
| 2005/0161228 | A1 | 7/2005 | Cook et al. |
| 2005/0241833 | A1 | 11/2005 | Bailey et al. |
| 2006/0037782 | A1 | 2/2006 | Martin-Marshall |
| 2006/0108119 | A1 | 5/2006 | Bailey et al. |
| 2006/0144622 | A1 | 7/2006 | Bailey et al. |
| 2006/0157282 | A1 | 7/2006 | Tilton et al. |
| 2006/0191716 | A1 | 8/2006 | Humphreys |
| 2007/0051512 | A1 | 3/2007 | Markel et al. |
| 2007/0068705 | A1 | 3/2007 | Hosie et al. |
| 2007/0095540 | A1 | 5/2007 | Kozicz |
| 2007/0163784 | A1 | 7/2007 | Bailey |
| 2008/0169107 | A1 | 7/2008 | Redlinger et al. |
| 2008/0210471 | A1 | 9/2008 | Bailey et al. |
| 2008/0236819 | A1 | 10/2008 | Foster et al. |
| 2008/0245531 | A1 | 10/2008 | Noske et al. |
| 2009/0025930 | A1 | 1/2009 | Iblings et al. |
| 2009/0101351 | A1 | 4/2009 | Hannegan et al. |
| 2009/0101411 | A1 | 4/2009 | Hannegan et al. |
| 2009/0139724 | A1 | 6/2009 | Gray et al. |
| 2009/0152006 | A1 | 6/2009 | Leduc et al. |
| 2009/0166046 | A1 | 7/2009 | Edvardson et al. |
| 2009/0200747 | A1 | 8/2009 | Williams |
| 2009/0211239 | A1 | 8/2009 | Askeland |
| 2009/0236144 | A1 | 9/2009 | Todd et al. |
| 2009/0301723 | A1 | 12/2009 | Gray |
| 2010/0008190 | A1 | 1/2010 | Gray et al. |
| 2010/0025047 | A1 | 2/2010 | Sokol |
| 2010/0175882 | A1 | 7/2010 | Bailey et al. |
| 2010/0218937 | A1 | 9/2010 | Edvardsen et al. |
| 2011/0024195 | A1 | 2/2011 | Hoyer |
| 2011/0036629 | A1 | 2/2011 | Bailey et al. |
| 2011/0036638 | A1 | 2/2011 | Sokol |

FOREIGN PATENT DOCUMENTS

| | | | |
|---|---|---|---|
| CA | 2363132 | A1 | 9/2000 |
| CA | 2447196 | A1 | 4/2004 |
| CA | 2641596 | | 8/2007 |
| CA | 2711621 | | 1/2011 |
| CA | 2855020 | | 1/2011 |
| EP | 0290250 | A2 | 11/1988 |
| EP | 0290250 | A3 | 11/1988 |
| EP | 267140 | B1 | 3/1993 |
| EP | 1375817 | B1 | 1/2004 |
| EP | 1519003 | B1 | 3/2005 |
| EP | 1659260 | B1 | 5/2006 |
| GB | 1161299 | | 8/1969 |
| GB | 2019921 | A | 11/1979 |
| GB | 2067235 | A | 7/1981 |
| GB | 2394738 | A | 5/2004 |
| GB | 2394741 | A | 5/2004 |
| GB | 2449010 | A | 8/2007 |
| GB | 2449010 | A | 11/2008 |
| GB | 2449010 | B | 4/2011 |
| GB | 2476002 | A | 6/2011 |
| WO | WO 93/06335 | | 4/1993 |
| WO | WO 99/45228 | A1 | 9/1999 |
| WO | WO 99/50524 | A2 | 10/1999 |
| WO | WO 99/51852 | A1 | 10/1999 |
| WO | WO 99/50524 | A3 | 12/1999 |
| WO | WO 00/52299 | A1 | 9/2000 |
| WO | WO 00/52300 | A1 | 9/2000 |
| WO | WO 01/79654 | A1 | 10/2001 |
| WO | WO 02/36928 | A1 | 5/2002 |
| WO | WO 02/50398 | A1 | 6/2002 |
| WO | WO 03/071091 | A1 | 8/2003 |
| WO | WO 2006/088379 | A1 | 8/2006 |
| WO | WO 2007/092956 | A2 | 8/2007 |
| WO | WO 2008/133523 | A1 | 11/2008 |
| WO | WO 2008/156376 | A1 | 12/2008 |
| WO | WO 2009/017418 | A1 | 2/2009 |
| WO | WO 2009/123476 | A1 | 10/2009 |

OTHER PUBLICATIONS

Extended European Search Report (R. 61 EPC) dated Jul. 15, 2014 for European Patent Application 10171045.7 corresponding to U.S. Appl. No. 12/462,266, published as US-2011-0024195 A1 on Feb. 3, 2011, now issued as U.S. Pat. No. 8,347,983 (our matter 62) from which U.S. Appl. No. 13/735,203 claims priority, now issued as U.S. Pat. No. 8,636,087 (our matter 75), from which this present U.S. Appl. No. 14/163,617, in turn, claims priority (10 pages).

Canadian Intellectual Property Office Office Action dated Jul. 22, 2014 for Canadian Patent Application 2,711,621 corresponding to U.S. Appl. No. 12/462,266, published as US-2011-0024195 A1 on Feb. 3, 2011, now issued as U.S. Pat. No. 8,347,983 (our matter 62) from which U.S. Appl. No. 13/735,203 claims priority, now issued as U.S. Pat. No. 8,636,087 (our matter 75), from which this present U.S. Appl. No. 14/163,617, in turn, claims priority (2 pages).

US 6,708,780, 03/2004, Bourgoyne et al. (withdrawn).

U.S. Appl. No. 60/079,641, filed Mar. 27, 1998.

U.S. Appl. No. 60/122,530, filed Mar. 2, 1999.

U.S. Appl. No. 61/205,209, filed Jan. 15, 2009.

The Modular T BOP Stack System, Cameron Iron Works © 1985 (5 pages).

Cameron HC Collet Connector, © 1996 Cooper Cameron Corporation, Cameron Division (12 pages).

(56) References Cited

OTHER PUBLICATIONS

Riserless drilling: circumventing the size/cost cycle in deepwater—Conoco, Hydril project seek enabling technologies to drill in deepest water depths economically, May 1986 Offshore Drilling Technology (pp. 49, 50, 52, 53, 54 and 55).
Williams Tool Company—Home Page—Under Construction Williams Rotating Control Heads (2 pages); Seal-Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications Where Using a Williams rotating control head while drilling is a plus (1 page); Williams higher pressure rotating control head systems are Ideally Suited for New Technology Flow Drilling and Closed Loop Underbalanced Drilling (UBD) Vertical and Horizontal (2 pages); and How to Contact US (2 pages).
Offshore—World Trends and Technology for Offshore Oil and Gas Operations, Mar. 1998, Seismic: Article entitled, "Shallow Flow Diverter JIP Spurred by Deepwater Washouts" (3 pages including cover page, table of contents and p. 90).
Williams Tool Co., Inc. Rotating Control Heads and Strippers for Air, Gas, Mud, and Geothermal Drilling Worldwide—Sales Rental Service, © 1988 (19 pages).
Williams Tool Co., Inc. 19 page brochure © 1991 Williams Tool Co., Inc. (19 pages).
Fig. 19 Floating Piston Drilling Choke Design: May 1997.
Blowout Preventer Testing for Underbalanced Drilling by Charles R. "Rick" Stone and Larry A. Cress, Signa Engineering Corp., Houston, Texas (24 pages) Sep. 1997.
Williams Tool Co., Inc. Instructions, Assemble & Disassemble Model 9000 Bearing Assembly (cover page and 27 numbered pages).
Williams Tool Co., Inc. Rotating Control Heads Making Drilling Safer While Reducing Costs Since 1968, © 1989 (4 pages).
Williams Tool Company, Inc. International Model 7000 Rotating Control Head, 1991 (4 pages).
Williams Rotating Control Heads, Reduce Costs Increase Safety Reduce Environmental Impact (4 pages).
Williams Tool Co., Inc. Sales-Rental-Service, Williams Rotating Control Heads and Strippers for Air, Gas, Mud, and Geothermal Drilling, © 1982 (7 pages).
Williams Tool Co., Inc., Rotating Control Heads and Strippers for Air, Gas, Mud, Geothermal and Pressure Drilling, © 1991 (19 pages).
An article—The Brief Jan. 1996, The Brief's Guest Columnists, Williams Tool Co., Inc., Communicating Dec. 13, 1995 (Fort Smith, Arkansas), The When? and Why? of Rotating Control Head Usage, Copyright © Murphy Publishing, Inc. 1996 (2 pages).
A reprint from the Oct. 9, 1995 edition of Oil & Gas Journal, "Rotating control head applications increasing," by Adam T. Bourgoyne, Jr., Copyright 1995 by PennWell Publishing Company (6 pages).
1966-1967 Composite Catalog-Grant Rotating Drilling Head for Air, Gas or Mud Drilling (1 page).
1976-1977 Composite Catalog Grant Oil Tool Company Rotating Drilling Head Models 7068, 7368, 8068 (Patented), Equally Effective with Air, Gas, or Mud Circulation Media (3 pages).
A Subsea Rotating Control Head for Riserless Drilling Applications; Daryl A. Bourgoyne, Adam T. Bourgoyne, and Don Hannegan—1998 (International Association of Drilling Contractors International Deep Water Well Control Conference held in Houston, Texas, Aug. 26-27, 1998) (14 pages).
Hannegan, "Applications Widening for Rotating Control Heads," Drilling Contractor, cover page, table of contents and pp. 17 and 19, Drilling Contractor Publications Inc., Houston, Texas, Jul. 1996.
Composite Catalog, Hughes Offshore 1986-87 Subsea Systems and Equipment, Hughes Drilling Equipment Composite Catalog (pp. 2986-3004).
Williams Tool Co., Inc. Technical Specifications Model for the Model 7100, (3 pages).
Williams Tool Co., Inc. Website, Underbalanced Drilling (UBD), The Attraction of UBD (2 pages).
Williams Tool Co., Inc. Website,. "Applications, Where Using a Williams Rotating Control Head While Drilling is a Plus" (2 pages).
Williams Tool Co., Inc. Website, "Model 7100," (3 pages).
Composite Catalog, Hughes Offshore 1982/1983, Regan Products, © Copyright 1982 (Two cover sheets and 4308-27 thru 4308-43, and end sheet). See p. 4308-36 Type KFD Diverter.
Coflexip Brochure; 1—Coflexip Sales Offices, 2—the Flexible Steel Pipe for Drilling and Service Applications, 3—New 5" I.D. General Drilling Flexible, 4—Applications, and 5—Illustration (5 unnumbered pages).
Baker, Ron, "A Primer of Oilwell Drilling," Fourth Edition, Published Petroleum Extension Service, The University of Texas at Austin, Austin, Texas, in cooperation with International Association of Drilling Contractors Houston, Texas © 1979 (3 cover pages and pp. 42-49 re Circulation System).
Brochure, Lock down Lubricator System, Dutch Enterprises, Inc., "Safety with Savings" (cover sheet and 16 unnumbered pages).
Hydril GL series Annual Blowout Preventers (Patented—see Roche patents above), (cover sheet and 2 pages).
Other Hydril Product Information (The GH Gas Handler Series Product is Listed), © 1996, Hydril Company (Cover sheet and 19 pages).
Brochure, Shaffer Type 79 Rotating Blowout Preventer, NL Rig Equipment/NL Industries, Inc., (6 unnumbered pages).
Shaffer, A Varco Company, (Cover page and pp. 1562-1568).
Avoiding Explosive Unloading of Gas in a Deep Water Riser When SOBM in Use; Colin P. Leach & Joseph R. Roche—1998 (The Paper Describes an Application for the Hydril Gas Handler, The Hydril GH 211-2000 Gas Handler is Depicted in Figure 1 of the Paper) (9 unnumbered pages).
Feasibility Study of Dual Density Mud System for Deepwater Drilling Operations; Clovis A. Lopes & A.T. Bourgoyne, Jr.—1997 (Offshore Technology Conference Paper No. 8465); (pp. 257-266).
Apr. 1998 Offshore Drilling with Light Weight Fluids Joint Industry Project Presentation (9 unnumbered pages).
Nakagawa, Edson Y., Santos, Helio and Cunha, J.C., "Application of Aerated-Fluid Drilling in Deepwater," SPE/IACDC 52787 Presented by Don Hannegan, P.E., SPE © 1999 SPE/IADC Drilling Conference, Amsterdam, Holland, Mar. 9-11, 1999 (5 unnumbered pages).
Brochure: "Inter-Tech Drilling Solutions, Ltd.'s RBOP™ Means Safety and Experience for Underbalanced Drilling," Inter-Tech Drilling Solutions Ltd./Big D Rentals & Sales (1981) Ltd. and Color "Rotating BOP" (2 unnumbered pages).
"Pressure Control While Drilling," Shaffer® A Varco Company, Rev. A (2 unnumbered pages).
Field Exposure (As of Aug. 1998), Shaffer® a Varco Company (1 unnumbered page).
Graphic: "Rotating Spherical BOP" (1 unnumbered page).
"JIP's Worl Brightens Outlook for UBD in Deep Waters" by Edson Yoshihito Nakagawa, Helio Santos and Jose Carlos Cunha, American Oil & Gas Reporter, Apr. 1999, pp. 53, 56, 58-60 and 63.
"Seal-Tech 1500 PSI Rotating Blowout Preventer," Undated, 3 pages.
"RPM System 3000™ Rotating Blowout Preventer, Setting a new standard in Well Control," by Techcorp Industries, Undated, 4 pages.
"RiserCap™ Materials Presented at the 1999 LSU/MMS/IADC Well Control Workshop", by Williams Tool Company, Inc., Mar. 24-25, pp. 1-14.
"The 1999 LSU/MMS Well Control Workshop: An overview," by John Rogers Smith. World Oil, Jun. 1999. Cover page and pp. 4, 41-42, and 44-45.
Dag Oluf Nessa, "Offshore underbalanced drilling system could revive field developments," World Oil, vol. 218, No. 10, Oct. 1997, 1 unnumbered page and pp. 83-84, 86, and 88.
D.O. Nessa, "Offshore underbalanced drilling system could revive field developments," World Oil Exploration Drilling Production, vol. 218, No. 7, Color pages of Cover Page and pp. 3, 61-64, and 66, Jul. 1997.
PCT Search Report, International Application No. PCT/US99/06695, 4 pages (Date of Completion May 27, 1999).
PCT Search Report, International Application No. PCT/GB00/00731, 3 pages (Date of Completion Jun. 16, 2000).
National Academy of Sciences—National Research Council, "Design of a Deep Ocean Drilling Ship," Cover Page and pp. 114-121. Undated but cited in above U.S. Pat. No. 6,230,824B1.

(56) References Cited

OTHER PUBLICATIONS

"History and Development of a Rotating Preventer," by A. Cress, Rick Stone, and Mike Tangedahl, IADC/SPE 23931, 1992 IADC/SPE Drilling Conference, Feb. 1992, pp. 757-773.
Helio Santos, Email message to Don Hannegan, et al., 1 page (Aug. 20, 2001).
Rehm, Bill, "Practical Underbalanced Drilling and Workover," Petroleum Extension Service, The University of Texas at Austin Continuing & Extended Education, Cover page, title page, copyright page, and pp. 6-6, 11-2, 11-3, G-9, and G-10 (2002).
Williams Tool Company Inc., "RISERCAP™: Rotating Control Head System for Floating Drilling Rig Applications," 4 unnumbered pages, (© 1999 Williams Tool Company, Inc.).
Antonio C.V.M. Lage, Helio, Santos and Paulo R.C. Silva, Drilling With Aerated Drilling Fluid From a Floating Unit Part 2: Drilling the Well, SPE 71361, 11 pages (© 2001, Society of Petroleum Engineers, Inc.).
Helio Santos, Fabio Rosa, and Christian Leuchtenberg, Drilling and Aerated Fluid from a Floating Unit, Part 1: Planning, Equipment, Tests, and Rig Modifications, SPE/IADC 67748, 8 pages (© 2001 SPE/IADC Drilling Conference).
E.Y. Nakagawa, H. Santos, J.C. Cunha and S. Shayegi, Planning of Deepwater Drilling Operations with Aerated Fluids, SPE 54283, 7 pages, (© 1999, Society of Petroleum Engineers).
E.Y. Nakagawa, H.M.R. Santos and J.C. Cunha, Implementing the Light-Weight Fluids Drilling Technology in Deepwater Scenarios, 1999 LSU/MMS Well Control Workshop Mar. 24-25, 1999, 12 pages (1999).
Press Release, "Stewart & Stevenson Introduces First Dual Gradient Riser," Stewart & Stevenson, http:/www.ssss/com/ssss/20000831.asp 2 pages (Aug. 31, 2000).
Press Release: "Stewart & Stevenson introduces First Dual Gradient Riser," Stewart & Stevenson, http:www/ssss/com/ssss/20000831.asp, 2 pages (Aug. 31, 2000).
Williams Tool Company Inc., "Williams Tool Company Introduces the . . . Virtual Riser™," 4 unnumbered pages, (© 1998 Williams Tool Company, Inc.).
"PETEX Publications," Petroleum Extension Service, University of Texas at Austin, 12 pages, (last modified Dec. 6, 2002).
"BG in the Caspian region," SPE Review, Issue 164, 3 unnumbered pages (May 2003).
"Field Cases as of Mar. 3, 2003," Impact Fluid Solutions, 6 pages (Mar. 3, 2003).
"Determine in the Safe Application of Underbalanced Drilling Technologies in Marine Environments—Technical Proposal," Maurer Technology, Inc., Cover Page and pp. 2-13 (Jun. 17, 2002).
Colbert, John W., "John W. Colbert, P.E. Vice President Engineering Biographical Data," Signa Engineering Corp., 2 unnumbered pages (undated).
"Technical Training Courses," Parker Drilling Co., http:/www.parkerdrilling.com/news/tech.html, 5 pages (last visited, Sep. 5, 2003).
"Drilling equipment: Improvements from data recording to slim hole," Drilling Contractor, pp. 30-32, (Mar./Apr. 2000).
"Drilling conference promises to be informative," Drilling Contractor, p. 10 (Jan./Feb. 2002).
"Underbalanced and Air Drilling," OGCI, Inc., http:/www.ogci.com/course_info.asp?counseID=410, 2 pages, (2003).
"2003 SPE Calendar," Society of Petroleum Engineers, Google cache of http:/www.spe.org/spe/cda/views/events/eventMaster/0,1470,1648_2194_632303.00.html; for "mud cap drilling", 2 pages (2001).
"Oilfield Glossary: reverse-circulating valve," Schlumberger Limited, 1 page (2003).
Murphy, Ross D. and Thompson, Paul B., "A drilling contractor's view of underbalanced drilling," World Oil Magazine, vol. 223, No. 5, 9 pages (May 2002).
"Weatherford UnderBalanced Services: General Underbalance Presentation to the DTI," 71 unnumbered pages, © 2002.
Rach, Nina M., "Underbalanced near-balanced drilling are possible offshore," Oil & Gas Journal, Color Copies, pp. 39-44, (Dec. 1, 2003).
Forrest, Neil et al., Subsea Equipment for Deep Water Drilling Using Dual Gradient Mud System, SPE/IADC Drilling Conference held in Amsterdam, The Netherlands, Feb. 27, 2001 to Mar. 1, 2001, Paper SPE/IADC 67707, © 2001 SPE/IADC Drilling Conference (8 pages); particularly see p. 3, col. 1, ¶ 4 and col. 2, ¶ 5 and Figs. 4-6.
Hannegan, D.M.; Bourgoyne, Jr., A.T.: "Deepwater Drilling with Lightweight Fluids—Essential Equipment Required," SPE/IADC 67708, pp. 1-6 (© 2001, SPE/IADC Drilling Conference).
Hannegan, Don M., "Underbalanced Operations Continue Offshore Movement," SPE 68491, pp. 1-3, (© 2001, Society of Petroleum Engineers, Inc.).
Hannegan, D. and Divine, R., "Underbalanced Drilling—Perceptions and Realities of Today's Technology in Offshore Applications," IADC/SPE 74448, p. 1-9, (© 2002, IADC/SPE Drilling Conference).
Hannegan, Don M. and Wanzer, Glen: "Well Control Considerations—Offshore Applications of Underbalanced Drilling Technology," SPE/IADC 79854, pp. 1-14, (© 2003, SPE/IADC Drilling Conference).
Bybee, Karen, "Offshore Applications of Underbalanced—Drilling Technology," Journal of Petroleum Technology, Cover Page and pp. 51-52, (Jan. 2004).
Bourgoyne, Darryl A.; Bourgoyne, Adam T.; Hannegan, Don; "A Subsea Rotating Control Head for Riserless Drilling Applications," IADC International Deep Water Well Control Conference, pp. 1-14, (Aug. 26-27, 1998).
Lage, Antonio C.V.M.; Santos, Helio; Silva, Paulo R.C.; "Drilling With Aerated Drilling Fluid From a Floating Unit Part 2: Drilling the Well," Society of Petroleum Engineers, SPE 71361, pp. 1-11 (Sep. 30-Oct. 3, 2001).
Furlow, William; "Shell's seafloor pump, solids removal key to ultra-deep, dual-gradient drilling (Skid ready for commercialization)," Offshore World Trends and Technology for Offshore Oil and Gas Operations, Cover page, table of contents, pp. 54, 2 unnumbered pages, and 106 (Jun. 2001).
Rowden, Michael V.: "Advances in riserless drilling pushing the deepwater surface string envelope (Alternative to seawater, CaCl2 sweeps);" Offshore World Trends and Technology for Offshore Oil and Gas Operations, Cover page, table of contents, pp. 56, 58, and 106 (Jun. 2001).
Boye, John: "Multi Purpose Intervention Vessel Presentation," M.O.S.T. Multi Operational Service Tankers, Weatherford International, Jan. 2004, 43 pages (© 2003).
GB Search Report, International Application No. GB 0324939.8, 1 page (Jan. 21, 2004).
MicroPatent® list of patents citing U.S. Pat. No. 3,476,195 printed on Jan. 24, 2003.
PCT Search Report, International Application No. PCT/EP2004/052167, 4 pages (Date of Completion Nov. 25, 2004).
PCT Written Opinion of the International Searching Authority, International Application No. PCT/EP2004/052167, 6 pages.
Supplementary European Search Report No. EP 99908371, 3 pages (Date of Completion Oct. 22, 2004).
*General Catalog*, 1970-1971, Vetco Offshore, Inc., Subsea Systems; cover page, company page and numbered pp. 4800, 4816-4818; 6 pages total, in particular see numbered p. 4816 for "patented" Vetco H-4 connectors.
*General Catalog*, 1972-73, Vetco Offshore, Inc., Subsea Systems; cover page; company page and numbered pp. 4498, 4509-4510; 5 pages total.
*General Catalog*, 1974-75, Vetco Offshore, Inc.; cover page, company page and numbered pp. 5160, 5178-5179; 5 pages total.
*General Catalog*, 1976-1977, Vetco Offshore, Inc., Subsea Drilling and Completion Systems; cover page and numbered pp. 5862-5863; 4 pages total.
*General Catalog*, 1982-1983, Vetco; cover page and numbered pp. 8454-8455, 8479; 4 pages total.
*Shaffer, A Varco Company: Pressure Control While Drilling System*, http://www.tulsaequipm.com; printed Jun. 21, 2004; 2 pages.

(56) References Cited

OTHER PUBLICATIONS

*Performance Drilling by Precision Drilling. A Smart Equation*, Precision Drilling, © 2002 Precision Drilling Corporation; 12 pages, in particular see 9th page for "Northland's patented RBOP . . . ."
*RPM System, 3000™ Rotating Blowout Preventer: Setting a New Standard in Well Control*, Weatherford, Underbalanced Systems: © 2002-2005 Weatherford; Brochure #333.01, 4 pages.
*Managed Pressure Drilling in Marine Environments*, Don Hannegan, P.E.; Drilling Engineering Association Workshop, Moody Gardens, Galveston, Jun. 22-23, 2004; © 2004 Weatherford, 28 pages.
Hold™ 2500 RCD Rotating Control Device web page and brochure, http://www.smith.com/hold2500; printed Oct. 27, 2004, 5 pages.
Rehm, Bill, "Practical Underbalanced Drilling and Workover," Petroleum Extension Service, The University of Texas at Austin Continuing & Extended Education, cover page, title page, copyright page and pp. 6-1 to 6-9, 7-1 to 7-9 (2002).
"Pressured Mud Cap Drilling from a Semi-Submersible Drilling Rig," J.H. Terwogt, SPE, L.B. Makiaho and N. van Beelen, SPE, Shell Malaysia Exploration and Production; B.J. Gedge, SPE, and J. Jenkins, Weatherford Drilling and Well Services (6 pages total); © 2005 (This paper was prepared for presentation at the SPE/IADC Drilling Conference held in Amsterdam, The Netherlands, Feb. 23-25, 2005).
Tangedahl, M.J., et al., "Rotating Preventers: Technology for Better Well Control," World Oil, Gulf Publishing Company, Houston, TX, US, vol. 213, No. 10, Oct. 1992, numbered pp. 63-64 and 66 (3 pages).
European Search Report for EP 05 27 0083, Application No. 05270083.8-2315, European Patent Office, Mar. 2, 2006, corresponding to U.S. Appl. No. 10/995,980, published as US2006/0108119 A1 (now U.S. Pat. No. 7,487,837 B2) (5 pages).
Netherlands Search Report for NL No. 1026044, dated Dec. 14, 2005 (3 pages).
Int'l. Search Report for PCT/GB 00/00731 corresponding to U.S. Pat. No. 6,470,975 (Jun. 16, 2000) (2 pages).
GB0324939.8 Examination Report corresponding to U.S. Pat. No. 6,470,975 (Mar. 21, 2006) (6 pages).
GB0324939.8 Examination Report corresponding to U.S. Pat. No. 6,470,975 Jan. 22, 2004) (3 pages).
2003/0106712 Family Lookup Report (Jun. 15, 2006) (5 pages).
U.S. Pat. No. 6,470,975 Family Lookup Report (Jun. 15, 2006) (5 pages).
AU S/N 28183/00 Examination Report corresponding to U.S. Pat. No. 6,470,975 (1 page) (Sep. 9, 2002).
NO S/N 20013953 Examination Report corresponding to U.S. Pat. No. 6,470,975 w/one page of English translation (3 pages) (Apr. 29, 2003).
Nessa, D.O. & Tangedahl, M.L. & Saponia, J: Part 1: "Offshore underbalanced drilling system could revive field developments," World Oil, vol. 218, No. 7, Cover Page, 3, 61-64 and 66 (Jul. 1997); and Part 2: "Making this valuable reservoir drilling/completion technique work on a conventional offshore drilling platform." World Oil, vol. 218 No. 10, Cover Page, 3, 83, 84, 86 and 88 (Oct. 1997).
Int'l. Search Report for PCT/GB 00/00731 corresponding to U.S. Pat. No. 6,470,975 (4 pages) (Jun. 27, 2000).
Int'l. Preliminary Examination Report for PCT/GB 00/00731 corresponding to U.S. Pat. No. 6,470,975 (7 pages) (Dec. 14, 2000).
NL Examination Report for WO 00/52299 corresponding to this U.S. Appl. No. 10/281,534 (3 pages) (Dec. 19, 2003).
AU S/N 28181/00 Examination Report corresponding to U.S. Pat. No. 6,263,982 (1 page) (Sep. 6, 2002).
EU Examination Report for WO 00/906522.8-2315 corresponding to U.S. Pat. No. 6,263,982 (4 pages) (Nov. 29, 2004).
NO S/N 20013952 Examination Report w/two pages of English translation corresponding to U.S. Pat. No. 6,263,982 (4 pages) (Jul. 2, 2005).
PCT/GB00/00726 Int'l Preliminary Examination Report corresponding to U.S. Pat. No. 6,263,982 (10 pages) (Jun. 26, 2001).
PCT/GB00/00726 Written Opinion corresponding to U.S. Pat. No. 6,263,982 (7 pages) (Dec. 18, 2000).
PCT/GB00/00726 International Search Report corresponding to U.S. Pat. No. 6,263,982 (3 pages (Mar. 2, 1999).
AU S/N 27822/99 Examination Report corresponding to U.S. Pat. No. 6,138,774 (1 page) (Oct. 15, 2001).
EU 99908371.0-1266-US99/03888 European Search Report corresponding to U.S. Pat. No. 6,138,774 (3 pages) (Nov. 2, 2004).
NO S/N 20003950 Examination Report w/one page of English translation corresponding to U.S. Pat. No. 6,138,774 (3 pages) (Nov. 1, 2004).
PCT/US990/03888 Notice of Transmittal of International Search Report corresponding to U.S. Pat. No. 6,138,774 (6 pages) (Aug. 4, 1999).
PCT/US99/03888 Written Opinion corresponding to U.S. Pat. No. 6,138,744 (5 pages) (Dec. 21, 1999).
PCT/US99/03888 Notice of Transmittal of International Preliminary Examination Report corresponding to U.S. Pat. No. 6,138,774 (15 pages) (Jun. 12, 2000).
EU Examination Report for 05270083.8-2315 corresponding to U.S. Appl. No. 10/995,980, published as US 2006/0108119 A1 (now U.S. Pat. No. 7,487,837 B2) (11 pages) (May 10, 2006).
Tangedahl, M.J., et al. "Rotating Preventers: Technology for Better Well Control," World Oil, Gulf Publishing Company, Houston, TX, US, vol. 213, No. 10, (Oct. 1, 1992) numbered pp. 63-64 and 66 (3 pages) XP 000288328 ISSN: 0043-8790.
UK Search Report for Application No. GB 0325423.2, searched Jan. 30, 2004 corresponding to above U.S. Pat. No. 7,040,394 (one page).
UK Examination Report for Application No. GB 0325423.2 (4 pages).
Dietle, Lannie L., et al., Kalsi Seals Handbook, Document. 2137 Revision 1, © 1992-2005 Kalsi Engineering, Inc. of Sugar Land, Texas USA; front and back covers and 164 total pages; in particular forward page ii for "Patent Rights"; Appendix A-6 for Kalsi seal part No. 381-6- and A-10 for Kalsi seal part No. 432-32-. as discussed in U.S. Appl. No. 11/366,078 (now U.S. Pat. No. 7,836,946 B2) at number paragraph 70 and 71.
Fig. 10 and discussion in U.S. Appl. No. 11/366,078, published as US2006/0144622 A1 (now U.S. Pat. No. 7,836,946 B2) of Background of Invention.
Partial European search report R.46 EPC dated Jun. 27, 2007 for European Patent Application EP07103416.9-2315 corresponding to U.S. Appl. No. 11/366,078, published as US 2006/0144622 A1, now U.S. Pat. No. 7,836,946 (5 pages).
Extended European search report R.44 EPC dated Oct. 9, 2007 for European Patent Application 07103416.9-2315 corresponding to U.S. Appl. No. 11/366,078, published as US-2006/0144622 A1, now U.S. Pat. No. 7,836,946 (8 pages).
U.S. Appl. No. 60/079,641, Mudlift System for Deep Water Drilling, filed Mar. 27, 1998, abandoned, but priority claimed in above U.S. Pat. No. 6,230,824 B1 and 6,102,673 and PCT WO-99/50524 (54 pages).
U.S. Appl. No. 60/122,530, Concepts for the Application of Rotating Control Head Technology to Deepwater Drilling Operations, filed Mar. 2, 1999, abandoned, but priority claimed in above U.S. Pat. No. 6,470,975 B1 (54 pages).
PCT/GB2008/050239 (corresponding to US2008/0210471 A1; now issued as U.S. Pat. No. 7,926,593) Annex to Form PCT/ISA/206 Communication Relating to the Results of the Partial International Search dated Aug. 26, 2008 (4 pages).
PCT/GB2008/050239 (corresponding to US2008/0210471 A1; now issued as U.S. Pat. No. 7,926,593) International Search Report and Written Opinion of the International Searching Authority (19 pages).
Vetco Gray Product Information CDE-PI-0007 dated Mar. 1999 for 59.0" Standard Bore CSO Diverter (2 pages) © 1999 by Vetco Gray Inc.
Vetco Gray Capital Drilling Equipment KFDJ and KFDJ Model "J" Diverters (1 page) (no date).
Hydril Blowout Preventers Catalog M-9402 D (44 pages) © 2004 Hydrill Company LP; see annular and ram BOP seals on p. 41.
Hydril Compact GK® 7 1/16"-3000 & 5000 psi Annular Blowout Preventers, Catalog 9503B © 1999 Hydril Company (4 pages).
Weatherford Controlled Pressure Drilling *Williams*® Rotating Marine Diverter Insert (2 pages).

(56) References Cited

OTHER PUBLICATIONS

Weatherford Controlled Pressure Drilling Model 7800 Rotating Control Device © 2007 Weatherford(5 pages).
Weatherford Controlled Pressure Drilling® and Testing Services *Williams*® Model 8000/9000 Conventional Heads © 2002-2006 Weatherford(2 pages).
Weatherford "Real Results Rotating Control Device Resolves Mud Return Issues in Extended-Reach Well, Saves Equipment Costs and Rig Time" © 2007 Weatherford and "Rotating Control Device Ensures Safety of Crew Drilling Surface-Hole Section" © 2008 Weatherford (2 pages).
Washington Rotating Control Heads, Inc. Series 1400 Rotating Control Heads ("Shorty") printed Nov. 21, 2008 (2 pages).
Smith Services product details for Rotating Control Device—RDH 500® printed Nov. 24, 2008 (4 pages).
American Petroleum Institute Specification for Drill Through Equipment—Rotating Control Devices, API Specification 16RCD, First Edition, Feb. 2005 (84 pages).
Weatherford Drilling & Intervention Services Underbalanced Systems RPM System 3000™ Rotating Blowout Preventer, Setting a New Standard in Well Control, An Advanced Well Control System for Underbalanced Drilling Operations, Brochure #333.00, © 2002 Weatherford (4 pages).
Medley, George; Moore, Dennis; Nauduri, Sagar; Signa Engineering Corp.; SPE/IADC Managed Pressure Drilling & Underbalanced Operations (PowerPoint presentation; 22 pages).
Secure Drilling Well Controlled, Secure Drilling™ System using Micro-Flux Control Technology, © 2007 Secure Drilling (12 pages).
The LSU Petroleum Engineering Research & Technology Transfer Laboratory, 10-rate Step Pump Shut-down and Start-up Example Procedure for Constant Bottom Hole Pressure Manage Pressure Drilling Applications (8 pages).
United States Department of the Interior Minerals Management Service Gulf of Mexico OCS Region NTL No. 2008-G07; Notice to Lessees and Operators of Federal Oil, Gas, and Sulphur Leases in the Outer Continental Shelf, Gulf of Mexico OCS Region, Managed Pressure Drilling Projects; Issue Date: May 15, 2008; Effective Date: Jun. 15, 2008; Expiration Date: Jun. 15, 2013 (9 pages).
Gray, Kenneth; Dynamic Density Control Quantifies Well Bore Conditions in Real Time During Drilling; American Oil & Gas Reporter, Jan. 2009 (4 pages).
Kotow, Kenneth J.; Pritchard, David M.; Riserless Drilling with Casing: A New Paradigm for Deepwater Well Design, OTC-19914-PP, © 2009 Offshore Technology Conference, Houston, TX May 4-7, 2009 (13 pages).
Hannegan, Don M.; Managed Pressure Drilling—A New Way of Looking at Drilling Hydraulics—Overcoming Conventional Drilling Challenges; SPE 2006-2007 Distinguished Lecturer Series presentation (29 pages); see all but particularly see Figs. 14-20.
Turck Works Industrial Automation; Factor 1 Sensing for Metal Detection, cover page, first page and numbered pp. 1.157 to 1.170 (16 pages) (printed in Jan. 2009).
Balluff Sensors Worldwide; Object Detection Catalog Aug. 2009—Industrial Proximity Sensors for Non-Contact Detection of Metallic Targets at Ranges Generally under 50mm (2 inches); Linear Position and Measurement; Linear Position Transducers; Inductive Distance Sensors; Photoelectric Distance Sensors; Magneto-Inductive Linear Position Sensors; Magnetic Linear/Rotary Encoder System; printed Dec. 23, 2008 (8 pages).
Inductive Sensors AC 2-Wire Tubular Sensors, Balluff product catalog pp. 1.109-1.120 (12 pages) (no date).
Inductive Sensors DC 2-Wire Tubular Sensors, Balluff product catalog pp. 1.125-1.136 (12 pages) (no date).
Inductive Sensors Analog Inductive Sensors, Balluff product catalog pp. 1.157-1.170 (14 pages) (no date).
Inductive Sensors DC 3-/4-Wire Inductive Sensors, Balluff product catalog pp. 1.72-1.92 (21 pages).
Selecting Position Transducers: How to Choose Among Displacement Sensor Technologies; How to Choose Among Draw Wire, LVDT, RVDT, Potentiometer, Optical Encoder, Ultrasonic, Magnetostrictive, and Other Technologies; © 1996-2010, Space Age Control, Inc., printed Jan. 11, 2009 (7 pages) (www.. spaceagecontrol.com/selpt.htm).
Liquid Flowmeters, Omega.com website; printed Jan. 26, 2009 (13 pages).
Super Autochoke—Automatic Pressure Regulation Under All Conditions © 2009 M-I, LLC; MI Swaco website; printed Apr. 2, 2009 (1 page); see U.S. Pat. No. 4,355,784.
Extended European Search Report R.61 EPC dated Sep. 16, 2010 for European Patent Application 08166660.4-1266/2050924 corresponding to U.S. Appl. No. 11/975,554, now US 2009/0101351 A1 (7 pages).
Office Action from the Canadian Intellectual Property Office dated Nov. 13, 2008 for Canadian Application No. 2,580,177 corresponding to U.S. Appl. No. 11/366,078, published as US-2006/0144622 A1 now U.S. Pat. No. 7,836,946 B2 (3 pages).
Response to European Patent Application No. 08719084.9 (corresponding to the present published application US2008/0210471 A1, now issued as U.S. Pat. No. 7,926,593) dated Nov. 16, 2010 (4 pages).
Office Action from the Canadian Intellectual Property Office dated Apr. 15, 2008 for Canadian Application No. 2,527,395 corresponding to U.S. Appl. No. 10/995,980, published as US-2006/0108119 A1, now U.S. Pat. No. 7,487,837 B2 (3 pages).
Office Action from the Canadian Intellectual Property Office dated Apr. 9, 2009 for Canadian Application No. 2,527,395 corresponding to U.S. Appl. No. 10/995,980, published as US-2006/0108119 A1, now U.S. Pat. No. 7,487,837 B2 (2 pages).
Office Action from the Canadian Intellectual Property Office dated Dec. 15, 2009 for Canadian Application No. 2,681,868 corresponding to U.S. Appl. No. 10/995,980, published as US-2006/0108119 A1, now U.S. Pat. No. 7,487,837 B2 (2 pages).
Examiner's First Report on Australian Patent Application No. 2005234651 from the Australian Patent Office dated Jul. 22, 2010 corresponding to U.S. Appl. No. 10/995,980, published as US-2006/0108119 A1, now U.S. Pat. No. 7,487,837 B2 (2 pages).
Office Action from the Canadian Intellectual Property Office dated Sep. 9, 2010 for Canadian Application No. 2,707,738 corresponding to U.S. Appl. No. 10/995,980, published as US-2006/0108119 A1 now U.S. Pat. No. 7,487,837 B2 (2 pages).
Web page of Ace Wire Spring & Form Company, Inc. printed Dec. 8, 2009 for "Garter Springs—Helical Extension & Compression" www..acewirespring.com/garter-springs.html (1 page).
Extended European Search Report (R 61 EPC) dated Mar. 4, 2011 for European Application No. 08166658.8-1266/2053197 corresponding to U.S. Appl. No. 11/975,946, published as US 2009-0101411 A1 (13 pages).
Canadian Intellectual Property Office Office Action dated Dec. 7, 2010, Application No. 2,641,238 entitled "Fluid Drilling Equipment" for Canadian Application corresponding to U.S. Appl. No. 11/975,946, published as US 2009-0101411 A1 (4 pages).
Grosso, J.A., "An Analysis of Well Kicks on Offshore Floating Drilling Vessels," SPE 4134, Oct. 1972, pp. 1-20, © 1972 Society of Petroleum Engineers (20 pages).
Bourgoyne, Jr., Adam T., et al., "Applied Drilling Engineering," pp. 168-171, © 1991 Society of Petroleum Engineers (6 pages).
Wagner, R.R., et al., "Surge Field Tests Highlight Dynamic Fluid Response," SPE/IADC 25771, Feb. 1993, pp. 883-892, © 1993 SPE/IADC Drilling Conference (10 pages).
Solvang, S.A., et al., "Managed Pressure Drilling Resolves Pressure Depletion Related Problems in the Development of the HPHT Kristin Field," SPE/IADC 113672, Jan. 2008, pp. 1-9, © 2008 IADC/SPE Managed Pressure Drilling and Underbalanced Operations Conference and Exhibition (9 pages).
Rasmussen, Ovle Sunde, et al., "Evaluation of MPD Methods for Compensation of Surge-and-Swab Pressures in Floating Drilling Operations," IADC/SPE 108346, Mar. 2007, pp. 1-11, © 2007 IADC/SPE Managed Pressure Drilling and Underbalanced Operations Conference and Exhibition (11 pages).
Shaffer Drill String Compensator available from National Oilwell Varco of Houston, Texas, printed Mar. 23, 2010 from http://www.nov.com/ProductDisplay.aspx?ID=4954&taxID=121&terms=drill+string+compensators (1 page).

(56) References Cited

OTHER PUBLICATIONS

Shaffer Crown Mounted Compensator available from National Oilwell Varco of Houston, Texas, printed Mar. 23, 2010 from http://www.nov.com/ProductDisplay.aspx?ID=4949&taxID=121&terms=active+drill+string+compensator (3 pages).

Active heave compensator available from National Oilwell Varco of Houston, Texas, printed Mar. 23, 2010 from http://www.nov.com/ProductDisplay.aspx?ID=3677&taxID=740&terms=active+heave+compensator (3 pages).

Durst, Doug, et al., "Subsea Downhole Motion Compensator (SDMC): Field History, Enhancements, and the Next Generation," IADC/SPE 59152, Feb. 2000, pp. 1-12, © 2000 Society of Petroleum Engineers, Inc. (12 pages).

Sensoy, Taner, et al., Weatherford Secure Drilling Well Controlled Report "Surge and Swab effects d ue to the Heave motion of floating rigs", Nov. 10, 2009 (7 pages).

Hargreaves, David, et al., "Early Kick Detection for Deepwater Drilling: New Probabilistic Methods Applied in the Field", SPE 71369, © 2001, Society of Petroleum Engineers, Inc. (11 pages).

Heavy-Duty Hydraulic Cylinders catalog, The Sheffer Corporation, printed Mar. 5, 2010 from http://www.sheffercorp.com/layout_contact.shtm (27 pages).

Unocal Baroness Surface Stack Upgrade Modifications (5 pages).

Thomson, William T., Professor of Engineering, University of California, "Vibration Theory and Applications", © 1848, 1953, 1965 by Prentice-Hall, Inc. title page, copyright page, contents page and numbered pp. 3-9 (10 pages).

Active Heave Compensator, Ocean Drilling Program, www.oceandrilling.org (3 pages).

3.3 Floating Offshore Drilling Rigs (Floaters); 3.3.1. Technologies Required by Floaters; 3.3.2. Drillships; 3.3.3. Semisubmersible Drilling Rig; 4.3.4. Subsea Control System; 4.4. Prospect of Offshore Production System (5 pages).

Weatherford® Real Results First Rig Systems Solutions for Thailand Provides Safer, More Efficient Operations with Stabmaster® and Automated Side Doors, © 2009 Weatherford document No. 6909.00 discussing Weatherford's Integrated Safety Interlock System (ISIS) (1 page).

U.S. Appl. No. 61/205,209, filed Jan. 15, 2009; Abandoned, but priority claimed in US2010/0175882A1 (24 pages).

Smalley® Steel Ring Company, Spirolox®; pages from website http://www.spirolox.com/what_happened.php printed Apr. 27, 2010 (5 pages).

Extended European Search Report (R 61 EPC) dated Aug. 25, 2011 for European Application No. 11170537.2-2315 corresponding to U.S. Appl. No. 13/048,497 published as US2011/0168932 A1 on Jul. 14, 2011 and its divisional of U.S. Appl. No. 12/080,170, filed Mar. 31, 2008, now U.S. Pat. No. 7,926,593 (5 pages).

Canadian Intellectual Property Office Action dated Feb. 24, 2012, Application No. 2,711,621 entitled "Rotating Control Device" for Canadian Application corresponding to U.S. Appl. No. 12/462,266, published as US-2011-0024195 A1 on Feb. 3, 2011 (2 pages).

Australian Patent Office Reply to Request for Normal Examination of Application No. 2010206020 dated Mar. 1, 2012 corresponding to U.S. Appl. No. 12/462,266, published as US-2011-0024195 A1 on Feb. 3, 2011 (2 pages).

Extended European Search Report (R. 61 EPC) dated Jul. 15, 2014 for European Patent Application 10171045.7 corresponding to U.S. Appl. No. 12/462,266, published as US-2011-0024195 A1 on Feb. 3, 2011, now issued a U.S. Pat. No. 8,347,983 (our matter 62) from which U.S. Appl. No. 13/735,203 claims priority, now issued as U.S. Pat. No. 8,636,087 (our matter 75), from which this present U.S. Appl. No. 14/163,617, in turn, claims priority (10 pages).

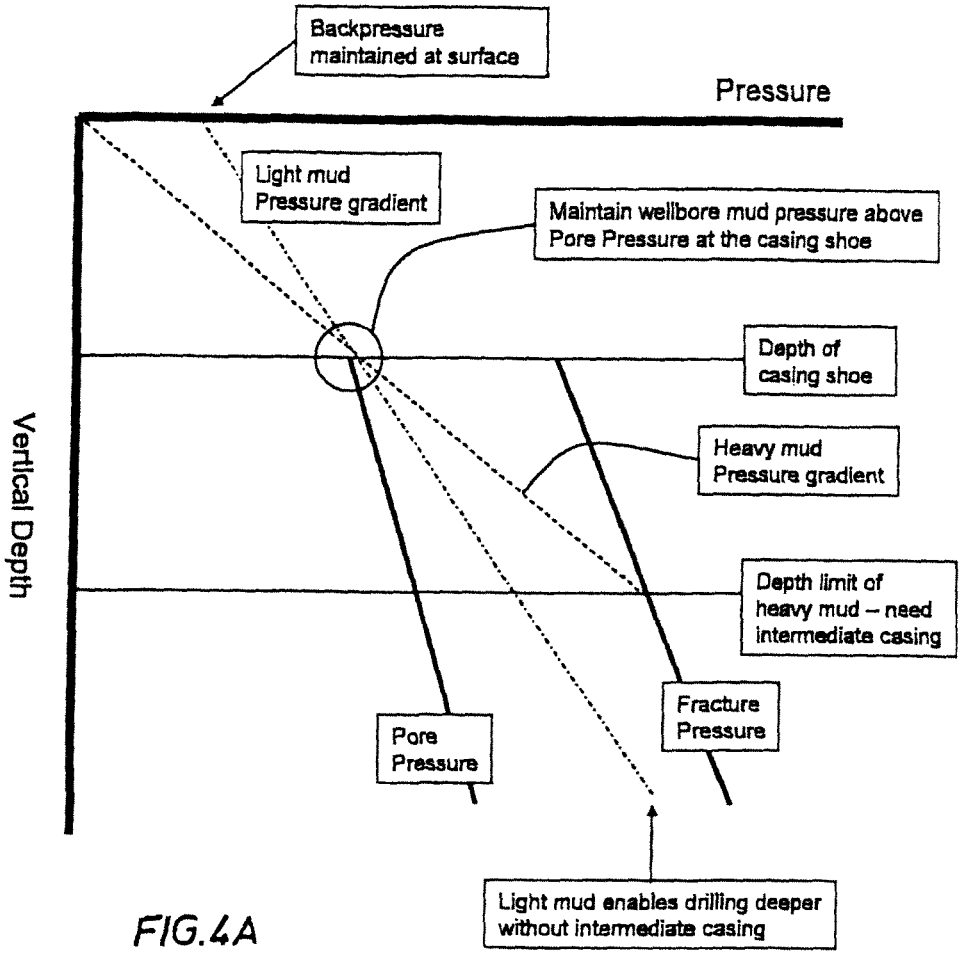
FIG.4A
FIG.6
(PRIOR ART)
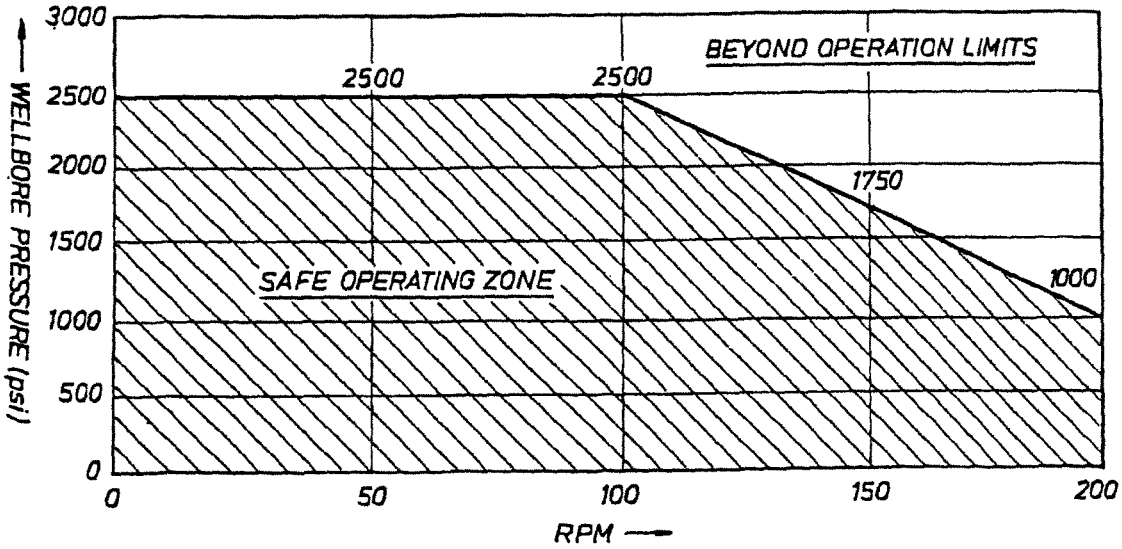

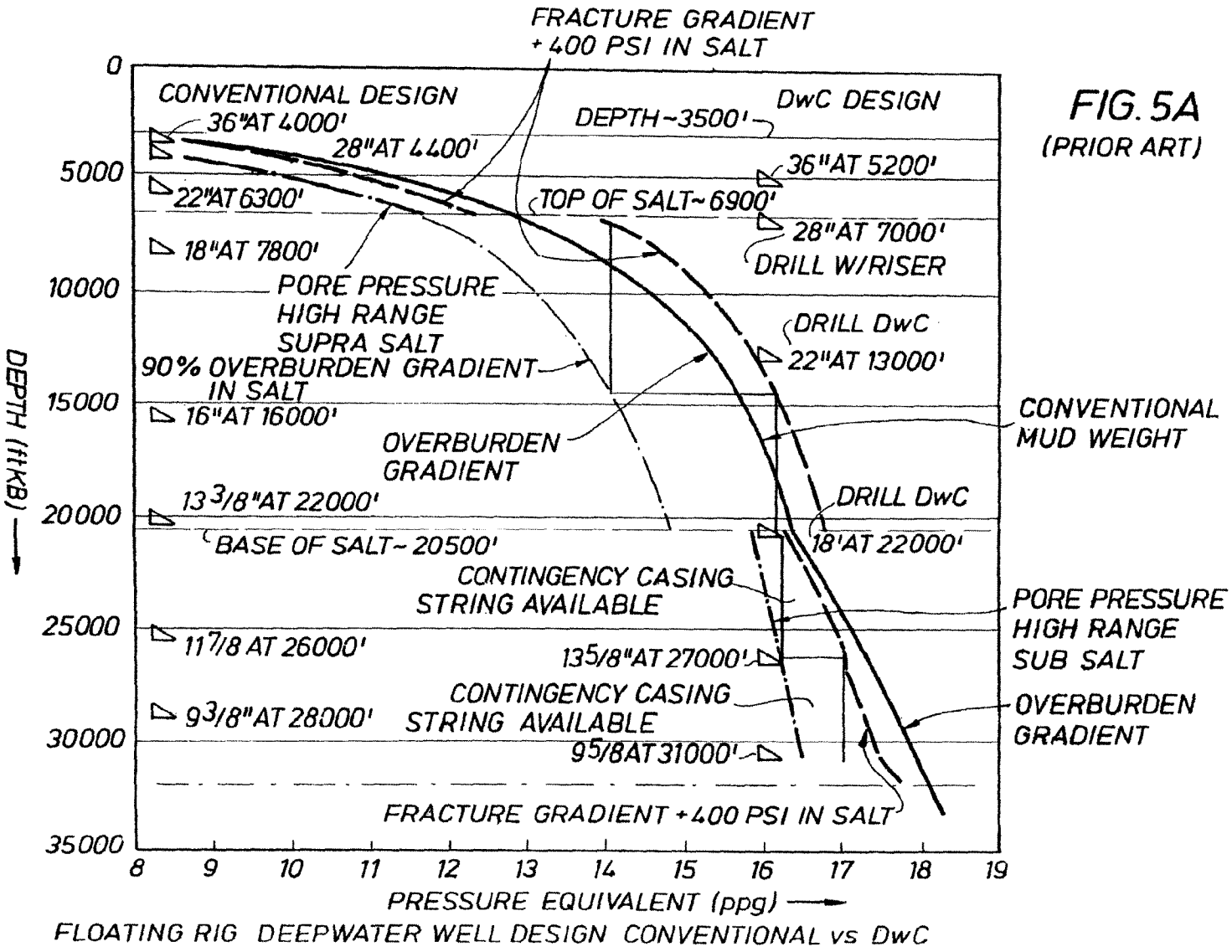
FLOATING RIG DEEPWATER WELL DESIGN CONVENTIONAL vs DwC

FLOATING RIG DEEPWATER WELL DESIGN CONVENTIONAL vs DTTL METHOD

DS
MR
120
T
N
132
137
136
106
139
104
P2
110
144
142
145
146
148
100
130
134
135
141
102
MR
T
P1
140
N
122
123
141
150
FLUID SOURCE
152
PUMP
154
PLC

FLUID SOURCE
234
DS
191
210
238
216
202
219
214
228
PUMP
232
P3
PLC
230
217
222
200
226
224
218
225
212
PUMP
227
198
220
208
194
221
192
223
196
P2
205
190
204
190A
P1
206

FLUID SOURCE
264
DS 245
268
271
250
273
262
269A
269B
270
PUMP
248
256
246
260
244
PLC
242
P2
240
274
PUMP
278
272
258
275
254
276
252
P1

DS
388
390A 436B
434
441
442
436A
440
438
404
443
444
PLC
450
448
446
421
427
P4
408
423
454
426
452
386
430
433
428A
428B
437
432
424
P3

P3
452
454
390B
384
415
416
417
418
453
396
390
394
414
410B
410A
412
429
392
431
398
408
P2
406
382
420
407
402
422
P1
DS
400

SYSTEM AND METHOD FOR COOLING A ROTATING CONTROL DEVICE

CROSS-REFERENCE TO RELATED APPLICATIONS

This application is a continuation of application Ser. No. 13/735,203 filed Jan. 7, 2013 (U.S. Pat. No. 8,636,087, issue date Jan. 28, 2014), which is a divisional application Ser. No. 12/462,266 filed Jul. 31, 2009 (U.S. Pat. No. 8,347,983, issue date Jan. 8, 2013), which are hereby incorporated by reference in its entirety for all purposes.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

The present invention relates to rotating control devices used when drilling wells and methods for use of these rotating control devices.

2. Description of the Related Art

Rotating control devices (RCDs) have been used for many years in the drilling industry for drilling wells. An internal sealing element fixed with an internal member of the RCD seals around the outside diameter of a tubular and rotates with the tubular. The tubular may be slidingly run through the RCD as the tubular rotates or when the tubular, such as a drill string, casing or coil tubing is not rotating. Examples of some proposed RCDs are shown in U.S. Pat. Nos. 5,213,158; 5,647,444 and 5,662,181. The internal sealing element may be passive or active. Passive sealing elements, such as stripper rubber sealing elements, can be fabricated with a desired stretch-fit. The wellbore pressure in the annulus acts on the cone shaped stripper rubber sealing elements with vector forces that augment a closing force of the stripper rubber sealing elements around the tubular. An example of a proposed stripper rubber sealing element is shown in U.S. Pat. No. 5,901,964. RCDs have been proposed with a single stripper rubber sealing element, as in U.S. Pat. Nos. 4,500,094 and 6,547,002; and Pub. No. US 2007/0163784, and with dual stripper rubber sealing elements, as in the '158 patent, '444 patent and the '181 patent, and U.S. Pat. No. 7,448,454. U.S. Pat. No. 6,230,824 proposes two opposed stripper rubber sealing elements, the lower sealing element positioned in an axially downward, and the upper sealing element positioned in an axially upward (see FIGS. 4B and 4C of '824 patent).

Unlike a stripper rubber sealing element, an active sealing element typically requires a remote-to-the-tool source of hydraulic or other energy to open or close the sealing element around the outside diameter of the tubular. An active sealing element can be deactivated to reduce or eliminate the sealing forces of the sealing element with the tubular. RCDs have been proposed with a single active sealing element, as in the '784 publication, and with a stripper rubber sealing element in combination with an active sealing element, as in U.S. Pat. Nos. 6,016,880 and 7,258,171 (both with a lower stripper rubber sealing element and an upper active sealing element), and Pub. No. US 2005/0241833 (with lower active sealing element and upper stripper rubber sealing element).

A tubular typically comprises sections with varying outer surface diameters. RCD passive and active sealing elements must seal around all of the rough and irregular surfaces of the components of the tubular, such as hardening surfaces (such as proposed in U.S. Pat. No. 6,375,895), drill pipe, tool joints, and drill collars. The continuous movement of the tubular through the sealing element while the sealing element is under pressure causes wear of the interior sealing surface of the sealing element. When drilling with a dual annular sealing element RCD, the lower of the two sealing elements is typically exposed to the majority of the pressurized fluid and cuttings returning from the wellbore, which communicate with the lower surface of the lower sealing element body. The upper sealing element is exposed to the fluid that is not blocked by the lower sealing element. When the lower sealing element blocks all of the pressurized fluid, the lower sealing element is exposed to a significant pressure differential across its body since its upper surface is essentially at atmospheric pressure when used on land or atop a riser. The highest demand on the RCD sealing elements occurs when tripping the tubular out of the wellbore under high pressure.

American Petroleum Institute Specification 16RCD (API-16RCD) entitled "Specification for Drill Through Equipment—Rotating Control Devices," First Edition, © February 2005 American Petroleum Institute, proposes standards for safe and functionally interchangeable RCDs. The requirements for API-16RCD must be complied with when moving the drill string through a RCD in a pressurized wellbore. The sealing element is inherently limited in the number of times it can be fatigued with tool joints that pass under high differential pressure conditions. Of course, the deeper the wellbores are drilled, the more tool joints that will be stripped through sealing elements, some under high pressure.

In more recent years, RCDs have been used to contain annular fluids under pressure, and thereby manage the pressure within the wellbore relative to the pressure in the surrounding earth formation. During such use, the sealing element in the RCD can be exposed to extreme wellbore fluid pressure variations and conditions. In some circumstances, it may be desirable to drill in an underbalanced condition, which facilitates production of formation fluid to the surface of the wellbore since the formation pressure is higher than the wellbore pressure. U.S. Pat. No. 7,448,454 proposes underbalanced drilling with an RCD. At other times, it may be desirable to drill in an overbalanced condition, which helps to control the well and prevent blowouts since the wellbore pressure is greater than the formation pressure. While Pub. No. US 2006/0157282 generally proposes Managed Pressure Drilling (MPD), International Pub. No. WO 2007/092956 proposes Managed Pressure Drilling (MPD) with an RCD. Managed Pressure Drilling (MPD) is an adaptive drilling process used to control the annulus pressure profile throughout the wellbore. The objectives are to ascertain the downhole pressure environment limits and to manage the hydraulic annulus pressure profile accordingly.

One equation used in the drilling industry to determine the equivalent weight of the mud and cuttings in the wellbore when circulating with the rig mud pumps on is:

Equivalent Mud Weight (EMW)=Mud Weight Hydrostatic Head+Δ Circulating Annulus Friction Pressure (AFP)

This equation would be changed to conform the units of measurements as needed.

In one variation of MPD, the above Circulating Annulus Friction Pressure (AFP), with the rig mud pumps on, is swapped for an increase of surface backpressure, with the rig mud pumps off, resulting in a Constant Bottomhole Pressure (CBHP) variation of MPD, or a constant EMW, whether the mud pumps are circulating or not. Another variation of MPD is proposed in U.S. Pat. No. 7,237,623 for a method where a predetermined column height of heavy viscous mud (most often called kill fluid) is pumped into the annulus. This mud cap controls drilling fluid and cuttings from returning to surface. This pressurized mud cap drilling method is sometimes referred to as bull heading or drilling blind.

The CBHP MPD variation is achieved using non-return valves (e.g., check valves) on the influent or front end of the drill string, an RCD and a pressure regulator, such as a drilling choke valve, on the effluent or back return side of the system. One such drilling choke valve is proposed in U.S. Pat. No. 4,355,784. A commercial hydraulically operated choke valve is sold by M-I Swaco of Houston, Tex. under the name SUPER AUTOCHOKE. Also, Secure Drilling International, L.P. of Houston, Tex., now owned by Weatherford International, Inc., has developed an electronic operated automatic choke valve that could be used with its underbalanced drilling system proposed in U.S. Pat. Nos. 7,044,237; 7,278,496 and 7,367,411 and Pub. No. US2008/0041149 A1. In summary, in the past, an operator of a well has used a manual choke valve, a semi-automatic choke valve and/or a fully automatic choke valve for an MPD program.

Generally, the CBHP MPD variation is accomplished with the choke valve open when circulating and the choke valve closed when not circulating. In CBHP MPD, sometimes there is a 10 choke-closing pressure setting when shutting down the rig mud pumps, and a 10 choke-opening setting when starting them up. The mud weight may be changed occasionally as the well is drilled deeper when circulating with the choke valve open so the well does not flow. Surface backpressure, within the available pressure containment capability rating of an RCD as discussed below, is used when the pumps are turned off (resulting in no AFP) during the making of pipe connections to keep the well from flowing. Also, in a typical CBHP application, the mud weight is reduced by about 0.5 ppg from conventional drilling mud weight for the similar environment. Applying the above EMW equation, the operator navigates generally within a shifting drilling window, defined by the pore pressure and fracture pressure of the formation, by swapping surface backpressure, for when the pumps are off and the AFP is eliminated, to achieve CBHP.

As discussed above, the CBHP MPD variation can only apply surface backpressure within the available pressure containment rating of an RCD. Pressure test results before the Feb. 6, 1997 filing date of the '964 patent for the Williams Model 7100 RCD disclose stripper rubber sealing element failures at working pressures above 2500 psi (17,237 kPa) when the drill string is rotating. The Williams Model 7100 RCD with 7 inch (17.8 cm) ID is designed for a static pressure of 5000 psi (34,474 kPa) when the drill pipe is not rotating. The Williams Model 7100 RCD is available from Weatherford International of Houston, Tex. Weatherford International also manufactures a Model 7800 RCD and a Model 7900 RCD. FIG. 6 is a pressure rating graph for the Weatherford Model 7800 RCD that shows wellbore pressure in pounds per square inch (psi) on the vertical axis, and RCD rotational speed in revolutions per minute (RPM) on the horizontal axis. The maximum allowable wellbore pressure without exceeding operational limits for the Weatherford Model 7800 RCD is 2500 psi (17,237 kPa) for rotational speeds of 100 RPM or less. The maximum allowable pressure decreases for higher rotational speeds. Like the Williams Model 7100 RCD, the Weatherford Model 7800 RCD has a maximum allowable static pressure of 5000 psi (34,474 kPa). The Williams Model 7100 RCD and the Weatherford Model 7800 and Model 7900 RCDs all have passive sealing elements. Weatherford also manufactures a lower pressure Model 7875 self-lubricated RCD bearing assembly with top and bottom flanges and a lower pressure Model 7875 self-lubricated bell nipple insert RCD bearing assembly with a bottom flange only. Since neither Model 7875 has means of circulating coolant to remove frictional heat, their pressure vs. RPM ratings are lower than the Model 7800 and the Model 7900. Weatherford also manufactures an active sealing element RCD, RBOP 5K RCD with 7 inch ID, which has a maximum allowable stripping pressure of 2500 psi, maximum rotating pressure of 3500 psi (24,132 kPa), and maximum static pressure of 5000 psi.

Pressure differential systems have been proposed for use with RCD components in the past. For example, U.S. Pat. No. 5,348,107 proposes a pressurized lubricant system to lubricate certain seals that are exposed to wellbore fluid pressures. However, unlike the RCD tubular sealing elements discussed above, the seals that are lubricated in the '107 patent do not seal with the tubular. Pub. No. US 2006/0144622 also proposes a system to regulate the pressure between two radial seals. Again, the seals subject to this pressure regulation do not seal with the drill string. The '622 publication also proposes an active sealing element in which fluid is supplied to energize a flexible bladder, and the pressure within the bladder is maintained at a controlled level above the wellbore pressure. The '833 publication proposes an active sealing element in which a hydraulic control maintains the fluid pressure that urges the sealing element toward the drill string at a predetermined pressure above the wellbore pressure. U.S. Pat. No. 7,258,171 proposes a system to pressurize lubricants to lubricate bearings at a predetermined pressure in relation to the surrounding subsea water pressure. Also, U.S. Pat. No. 4,312,404 proposes a system for leak protection of a rotating blowout preventer and U.S. Pat. No. 4,531,591 proposes a system for lubrication of an RCD.

The above discussed U.S. Pat. Nos. 4,312,404; 4,355,784; 4,500,094; 4,531,591; 5,213,158; 5,348,107; 5,647,444; 5,662,181; 5,901,964; 6,016,880; 6,230,824; 6,375,895; 6,547,002; 7,040,394; 7,044,237; 7,237,623; 7,258,171; 7,278,496; 7,367,411; 7,448,454; and 7,487,837; and Pub. Nos. US 2005/0241833; 2006/0144622; 2006/0157282; and 2007/0163784; 2008/0041149; and International Pub. No. WO 2007/092956 or PCT/US2007/061929 are hereby incorporated by reference for all purposes in their entirety. U.S. Pat. Nos. 5,647,444; 5,662,181; 5,901,964; 6,547,002; 7,040,394; 7,237,623; 7,258,171; 7,448,454 and 7,487,837; and Pub. Nos. US 2005/0241833; 2006/0144622; 2006/0157282; and 2007/0163784; and International Pub. No. WO 2007/092956 or PCT/US2007/061929 are assigned to the assignee of the present invention.

A need exists for an RCD that can safely operate in dynamic or working conditions in annular wellbore fluid pressures greater than 2500 psi (17,237 kPa). Customers of the drilling industry have expressed a desire for a higher safety factor in both the static and dynamic rating of available RCDs for certain applications. A higher safety factor or dynamic rating would allow for use of RCDs to manage pressurized systems in well prospects with high wellbore pressure, such as in deep offshore wells. It would also be desirable if the design of the RCD complied with API-16RCD requirements. Furthermore, use of the higher rated RCD with a higher surface backpressure with a fluid program that disregards pore pressure and instead uses the fracture pressure of the formation and casing shoe leak off or pressure test as limiting pressure factors would be desirable. This novel drilling limitation variation of MPD would be desirable in that it would allow use of readily available, lighter mud weight and less expensive drilling fluids while drilling deeper with a larger resulting tubular opening area.

BRIEF SUMMARY OF THE INVENTION

A method and system are provided a high pressure rated RCD by, among other features, limiting the fluid pressure differential to which a RCD sealing element is exposed. For a dual annular sealing element RCD, a pressurized cavity fluid is communicated to the RCD cavity located between the two sealing elements. Sensors can be positioned to detect the wellbore annulus fluid pressure and temperature and the cavity fluid pressure and temperature in the RCD cavity and at other desired locations. The pressures and temperatures may be compared, and the cavity fluid pressure and temperature applied in the RCD cavity may be adjusted. The pressure differential to which one or more of the sealing elements is exposed may be reduced. The cavity fluid may be water, drilling fluid, gas, lubricant from the bearings, coolant from the cooling system, or hydraulic fluid used to activate an active sealing element. The cavity fluid may be circulated, which may be beneficial for lubricating and cooling or may be bullheaded. In another embodiment, the RCD may have more than two sealing elements. Pressurized cavity fluids may be communicated to each of the RCD internal cavities located between the sealing elements. Sensors can be positioned to detect the wellbore annulus fluid pressure and temperature and the cavity fluid pressures and temperatures in the RCD cavities. Again, the pressures and temperatures may be compared, and the cavity fluid pressures and temperatures in all of the RCD internal cavities may be adjusted.

In still another embodiment, conventional RCDs and rotating blowout preventers RBOPs can be stacked and adapted to communicate cavity fluid to their respective cavities to share the differential pressure across the sealing elements.

With a higher pressure rated RCD, a Drill-To-The-Limit (DTTL) drilling method variant to MPD would be feasible where surface backpressure is applied whether the mud is circulating (choke valve open) or not (choke valve closed). Because of the constant application of surface backpressure, the DTTL method can use lighter mud weight that still has the cutting carrying ability to keep the borehole clean. With a higher pressure rated RCD, the DTTL method would identify the weakest component of the pressure containment system, usually the fracture pressure of the formation or the casing shoe Leak Off Test (LOT) or pressure test. In the DTTL method, since surface backpressure is constantly applied, the pore pressure limitation of the conventional drilling window, such as used in the CBHP method and other MPD methods, can be disregarded in developing the fluid and drilling programs.

With a higher pressure rated RCD, such as 5,000 psi dynamic or working pressure and 10,000 psi static pressure, the limitation will usually be the fracture pressure of the formation or the LOT. Using the DTTL method, a deeper wellbore can be drilled with a larger resulting end tubulars opening area, such as casings or production liners, than would be possible with any other MPD application, including, but not limited to, the CBHP method.

BRIEF DESCRIPTION OF THE DRAWINGS

A better understanding of the present invention can be obtained with the following detailed descriptions of the various disclosed embodiments in the drawings:

FIG. 4A is a comparison chart of a light mud pressure gradient to a heavy mud pressure gradient relative to a pore pressure/fracture pressure window.

FIG. 5A is a comparison chart of a prior art deep water well design for conventional versus Drilling with Casing (DwC).

FIG. 6 is a prior art wellbore pressure rating vs. RPM graph for an exemplary prior art Weatherford Model 7800 RCD.

DETAILED DESCRIPTION OF THE INVENTION

Figure 1:
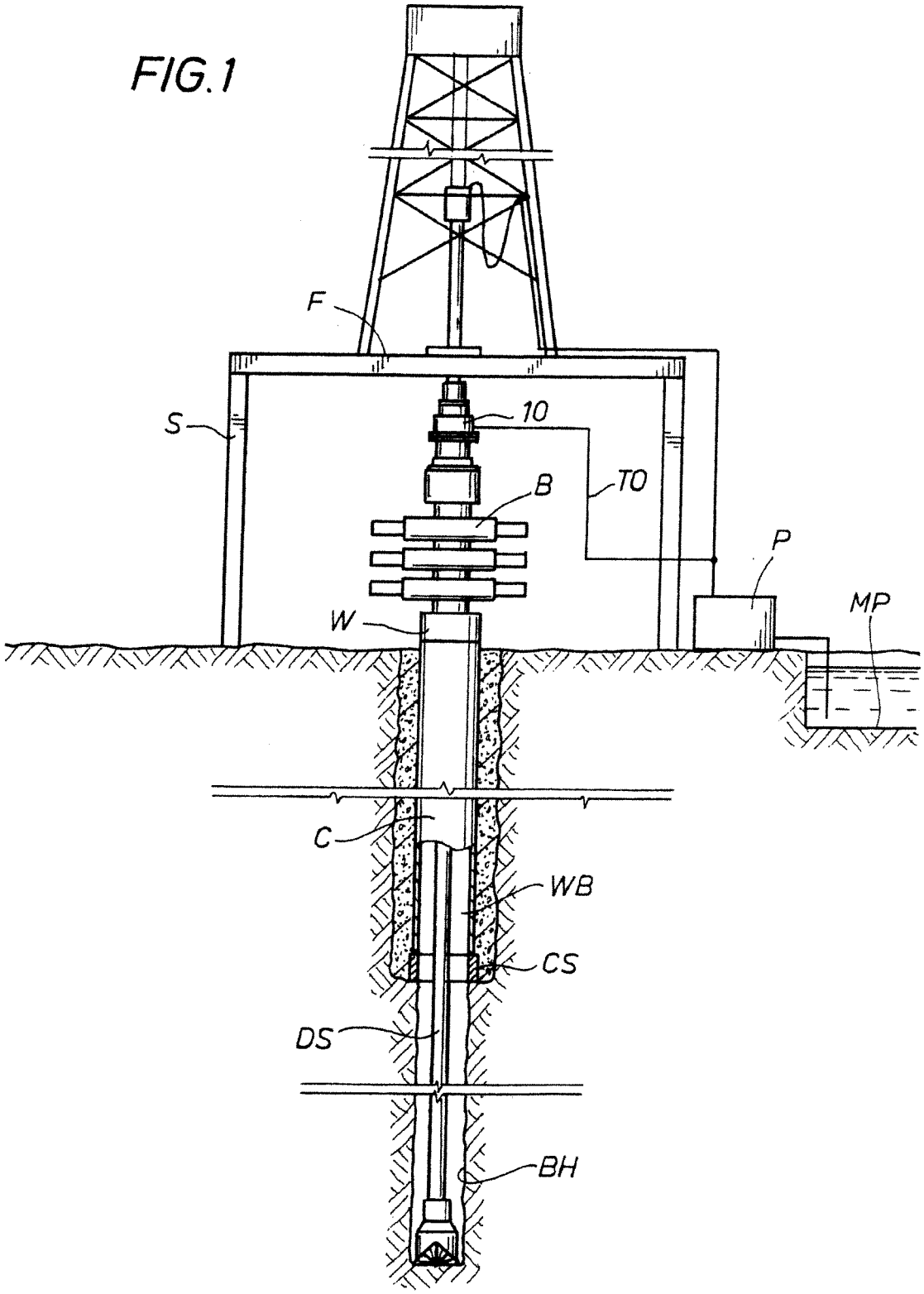
FIG. 1 is a multiple broken elevational view of an exemplary embodiment of a land drilling rig showing an RCD positioned above a blowout preventer ("BOP") stack, a cemented casing and casing shoe in partial cut away section, and a drill string extending through a formation into a wellbore.
Figure 2:
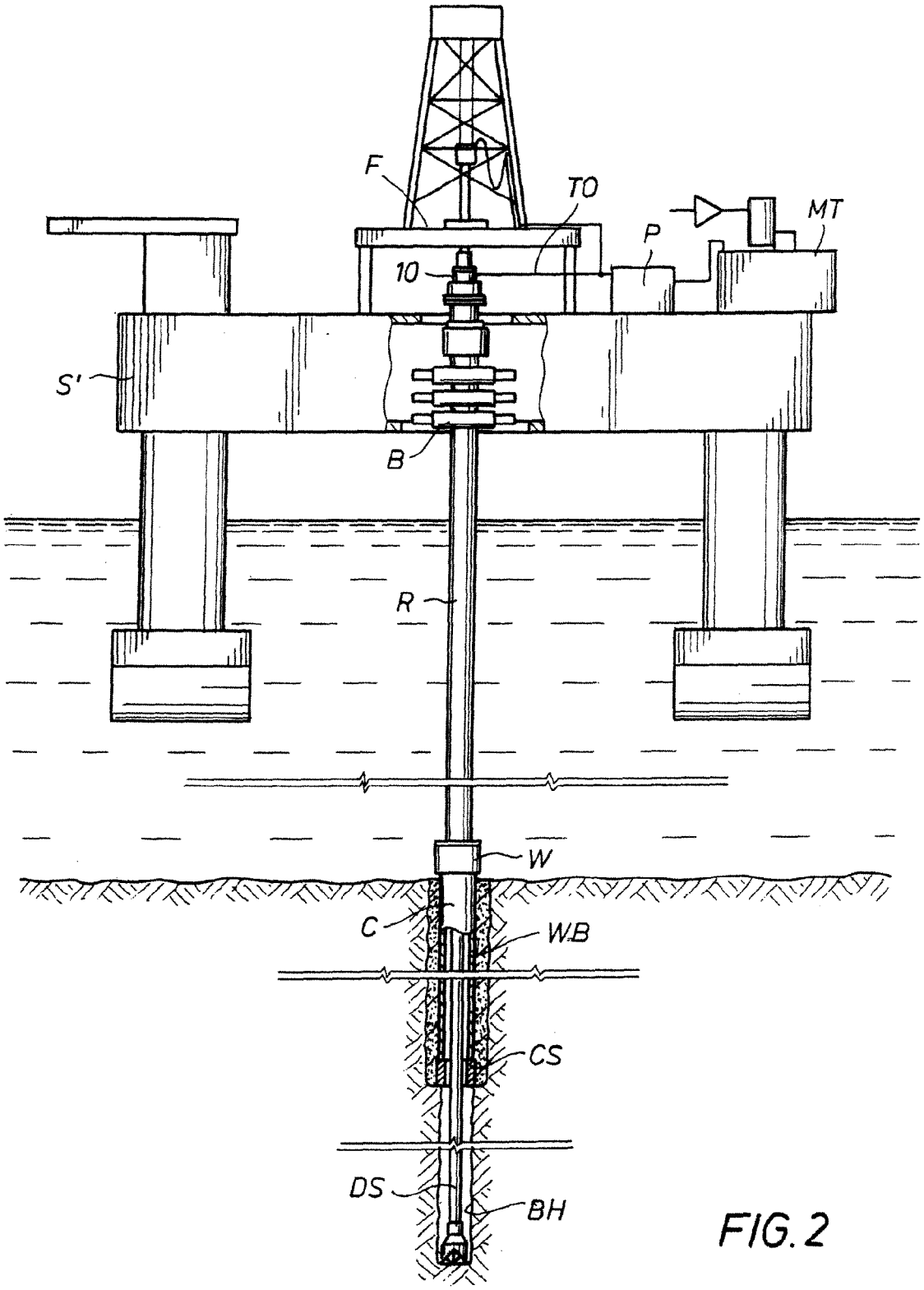
FIG. 2 is a multiple broken elevational view of an exemplary embodiment of a floating semi-submersible drilling rig showing a RCD positioned above a BOP stack, a marine riser extending upward from an annular BOP on the surface, a cemented casing and casing shoe in partial cut away section, and a drill string extending through a formation into the wellbore.

The DTTL method and the pressure sharing RCD systems may be used in many different drilling environments, including those environments shown in FIGS. 1 and 2. Exemplary drilling rigs or structures for use with the invention, generally indicated as S, are shown in FIGS. 1 and 2. Although a land drilling rig S is shown in FIG. 1, and an offshore floating semi-submersible rig S is shown in FIG. 2, other drilling rig configurations and embodiments are contemplated for use with the invention for both offshore and land drilling. For example, the invention is equally applicable to drilling rigs such as jack-up, semi-submersibles, submersibles, drill ships, barge rigs, platform rigs, and land rigs. Turning to FIG. 1, an RCD 10 is positioned below the drilling deck or floor F of the drilling rig S and above the BOP stack B. RCD 10 may include any of the RCD pressure sharing systems shown in FIGS. 7 to 17B or other adequately pressure rated RCD. The RCD, where possible, should be sized to be received through the opening in the drilling deck or floor F. The BOP stack B is positioned over the wellhead W. Casing C is hung from wellhead W and is cemented into position. Casing shoe CS at the base of casing C is also cemented into position. Drilling string DS extends through the RCD 10, BOP stack B, wellhead W, casing C, wellbore WB and casing shoe CS into the wellbore borehole BH. As used herein, a wellbore WB may have casing in it or may be open (i.e., uncased as wellbore borehole BH); or a portion of it may be cased and a portion of it may be open. Mud pump P is on the surface and is in fluid communication with mud pit MP and drill string DS.

In FIG. 2, casing C is hung from wellhead W, which is positioned on the ocean floor. Casing C is cemented in place along with casing shoe CS. Marine riser R extends upward from the top of the wellhead W. Drill string DS is positioned through the RCD 10, BOP stack B, riser R, wellhead W, casing C and wellbore WB into the wellbore borehole BH. BOP stack B is on top of riser R, and RCD 10 is positioned over BOP stack B and below rig floor F. Mud pump P is on the drilling rig and is in fluid communication with mud tank MT and drill string DS.

DTTL Method

In the DTTL method, a pressure containment system may be configured with casing C, a pressure rated RCD, such as a pressure sharing RCD system; for example, as shown in FIGS. 7 to 17B, drill string non-return or check valves, a drilling choke manifold with a manual or adjustable automatic choke valve, and a mud-gas separator or buster. As will be discussed below in detail, in the DTTL method, the weakest component of the well construction program is determined. This will usually be the fracture gradient of the formation, the casing shoe integrity, or the integrity of any other component of the closed pressurized circulating fluid system's pressure containment capability. A leak off test ("LOT"), as is known in the art, may be run on the casing shoe CS to determine its integrity. The LOT involves a pressure test of the formation directly below the casing shoe CS to determine a casing shoe fracture pressure. The LOT is generally conducted when drilling resumes after an intermediate casing string has been set. The LOT provides the maximum pressure that may be safely applied and is typically used to design the mud program or choke pressures for well control purposes. Although there may be more than one casing shoe in the well, the most likely candidate to be the weakest link relative to the integrity of all the other casing shoes in the casing program will typically be the casing shoe CS that is immediately above the open borehole BH being drilled. A formation integrity test ("FIT"), as is also known in the art, may be run on the formation. The fracture gradient for the formation may be calculated from the FIT results. Surface equipment that may limit the amount of pressure that may be applied with the DTTL method include the RCD, the choke manifold, the mud-gas separator, the flare stack flow rate, and the mud pumps. The casing itself may also be the weakest component. Some of the other candidates for the limiting component include the standpipe assembly, non-return valves (NRVs), and ballooning. It is also contemplated that engineering calculations and/or actual experience on similar wells and/or offset well data from, for example, development wells could be used to determine the "limit" when designing the DTTL method fluid program. With the DTTL method, hydraulic flow modeling may be used to determine surface back pressures to be used, and to aid in designing the fluids program and the casing seat depths. Hydraulic flow modeling may also determine if the drilling rig's existing mud-gas separator has the appropriate capacity.

The "ballooning", discussed above, is a phenomenon which occurs within the uncased hole as a direct result of pressures in the wellbore that cause an increase in the volume of fluids within, but do not fracture the wellbore to cause mud loss. Most geologically young sediments are somewhat elastic (e.g., not hard rock). Companion to ballooning is "breathing". Both contribute to wellbore instability by massaging the walls of the wellbore. Breathing raises questions for a driller when making jointed pipe connections; mud pumps are off, but the rig's mud pits continue to show flow from the wellbore. Specifically, the driller questions whether the well is taking a kick of formation fluids requiring mud weight to be added . . . or whether the well is giving back some of the volumes of fluid that expanded the wellbore with the last stand of pipe drilled (by Circulating Annulus Friction Pressure (AFP) being added to the hydrostatic weight of the mud). The FIT can detect ballooning as well as establish an estimate of the fracture pressure, similar to testing the "yield point" vs. "break point" of metals and "elongation" vs. "tensile strength" of an elastomeric. Whether real or perceived, ballooning may also be seen as the "limit" to the DTTL method when determining the mud to drill with and casing shoe depths.

Using the DTTL method, the wellbore WB may be drilled at a fluid pressure slightly lower than the weakest component. Less complex wells may not require hydraulic flow modeling, the LOT, or the FIT, if there is confidence that the wellbore WB may be drilled by just tooling up at the surface to deal with the uncertainties of the formation pressures. This may apply to the drilling of reservoirs that are progressively more depleted. It is also contemplated that the DTTL method may use a prior art RCD for certain low pressure formations rather than the pressure sharing RCD systems shown in FIGS. 7 to 17B. However, if an available RCD is used, it may be the weakest component, particularly if a factor of safety is applied. The Minerals Management Service (MMS) requires a 200% safety factor for offshore wells. In effect, this requires that the RCD be used at half its published pressure rating. One of the objectives of the high pressure rated RCD is to eliminate the RCD as the weakest component of the DTTL method.

Complimentary technologies that may be used with the DTTL method include downhole deployment valves, equivalent circulation density (ECD) reduction tools, continuous flow subs and continuous circulating systems, surface mud logging, micro-flux control, dynamic density control, dual gradient MPD, and gasified liquids. Surface mud logging allows for cuttings analysis for determining, among other things, rock strength and wellbore stability with lag time. Micro-flux control may allow early kick detection, real time wellbore pressure profile, and automated choke controls. As discussed above, Secure Drilling International, LP provides a micro-flux control system. Dynamic density control adds geomechanics capabilities to the real time analysis and prediction of stresses on the rock being drilled. Dynamic density control may be useful in determining the optimum DTTL method drilling fluid weight and casing set points in some complex wells. Gasified fluids may be used to keep the EMW of the drilling fluid low enough to avoid rupturing a casing seat, or exceeding the predetermined pressure of fracture gradient or FIT.

Figure 3:
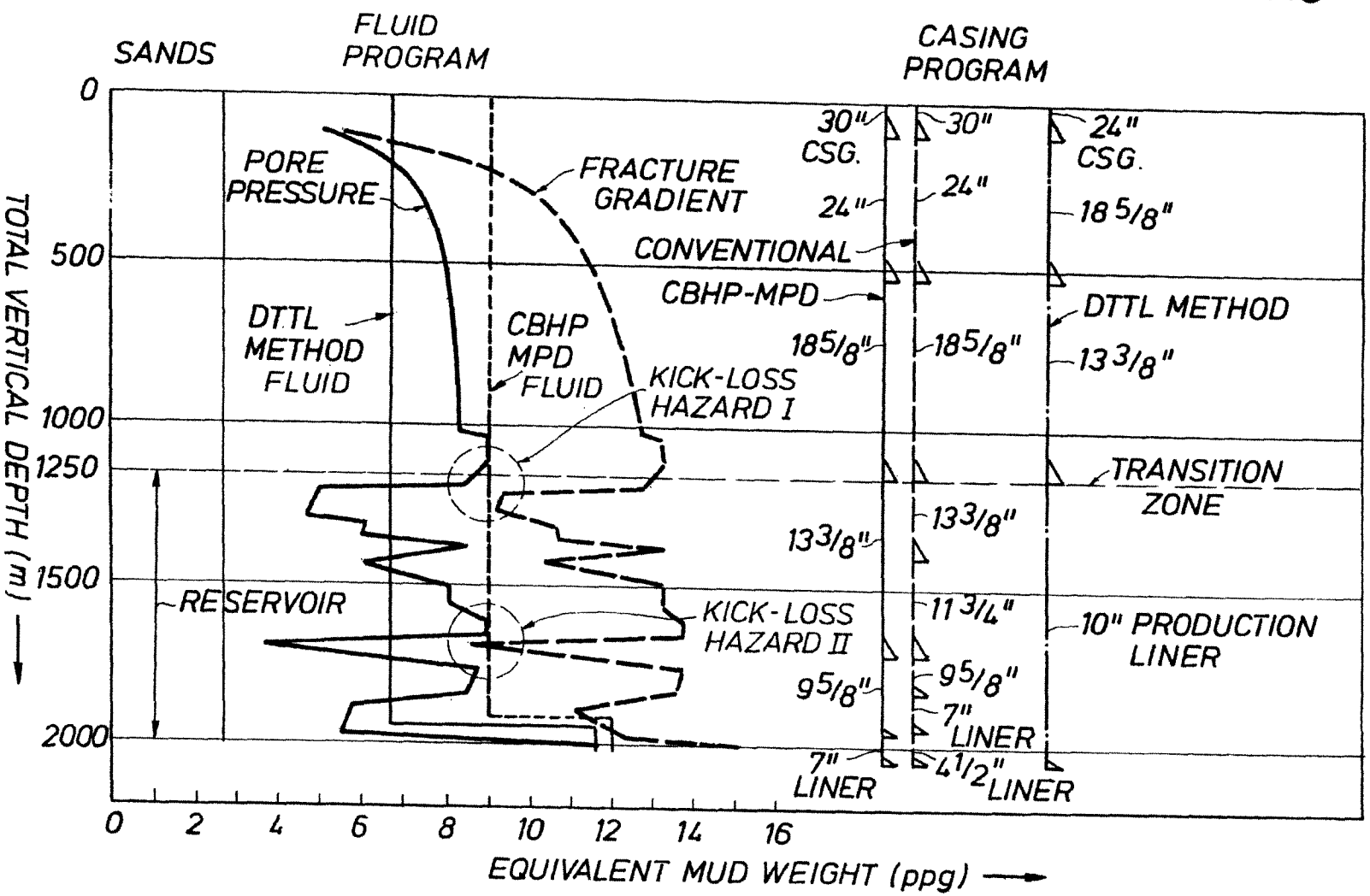
FIG. 3 is a comparison chart of fluid programs and casing programs for the prior art conventional and Constant Bottom Hole Pressure "CBHP" MPD methods versus the DTTL method while drilling through a number of geological anomalies such as the Touscelousa (near Baton Rouge, La.) sand problems.

Turning to FIG. 3, the advantages of the DTTL method are shown for a particular geologic formation. The formation pore pressure and fracture gradient are shown for an onshore geologic prospect. The prospect has a shifting drilling window, which is the area between the fracture gradient and the pore pressure. If the total EMW is less than the pore pressure, the well will flow. If the total EMW is greater than the fracture gradient, then there may be an underground blowout and loss of circulation. The formation has kick-loss hazard zones around 1300 meters (4265 feet) and 1700 meters (5577 feet) in the reservoir. These kick-loss hazards may manifest themselves as differential sticking, loss circulation, influx, twist-offs, well control issues, and non-productive time. With conventional drilling methods, including the CBHP MPD method, concerns with kick-loss hazards often cause casing program designers to specify fail safe casing string programs.

The left side of the chart of FIG. 3 shows a comparison of exemplary drilling fluids programs for the CBHP MPD method and the DTTL method. The Equivalent Mud Weight ("EMW") for the drilling fluid used with the CBHP MPD method is shown with a dashed line from the surface until a depth of about 2000 meters (6561 feet). Typically, the EMW is a measure of the pressure applied to the formation by the circulating drilling fluid at a depth. When referring to the CBHP and DTTL methods, the fluid systems are referred to as an equivalent from the conventional hydrostatic mud weight. The EMW for the drilling fluid is about 9 ppg for the CBHP MPD method. Hydrostatic mud weight is sometimes expressed in ppg. Dynamic or circulating mud weight (EMW) is expressed in ppge, where the "e" is for "equivalent." The EMW for the drilling fluid used with the DTTL method is shown with a solid line from the surface until a depth around 2000 meters (6561 feet). The EMW for the drilling fluid of the DTTL method is slightly less than 7 ppg. With the CBHP MPD method, the EMW of the drilling fluid is kept substantially constant to about 1900 meters (6233 feet), and within the drilling window except around 1700 meters (5577 feet), where it exceeds the fracture gradient. As shown in FIG. 3, with the DTTL method, the EMW of the drilling fluid may be a lower value than that for the drilling fluid with the CBHP MPD method for this prospect. It is contemplated that that the EMW of the drilling fluid may be two or three ppg less for the DTTL method, although other amounts are also contemplated.

In the DTTL method some amount of surface back pressure may be held whether or not the drilling fluid is circulating. Also, in the DTTL method, whatever the degree of static or dynamic underbalance of the EMW of the drilling fluid relative to the pore pressure, there will be an equivalent amount of surface back pressure applied to keep the total EMW in the drilling window above the pore pressure and below the fracture gradient. The objective is not to maintain a constant EMW, as CBHP MPD, but to keep it within the drilling window. The static and dynamic pressure imparted by the drilling fluid will usually become progressively less than the formation pore pressure as the depth increases, such as shown in FIG. 3, from the surface to a depth of about 1200 meters (3937 feet). Therefore, a progressively higher surface back pressure may be required as the drill bit travels deeper. In FIG. 3, the drilling fluid weight for the DTTL method is lower than the pore pressure in many depth locations, so that surface back pressure is needed whether circulating or not to keep the well from flowing (i.e. prevent influx). The amount of surface back pressure required is directly related to the hydrostatic or circulating amount of underbalance of the drilling fluid in the open hole. Because there may be a gross underbalance of the drilling fluid in the borehole at any particular time, the pressure containment capability of the RCD becomes paramount. The back pressure may be maintained with a back pressure control or choke system, such as proposed in U.S. Pat. Nos. 4,355,784; 7,044,237; 7,278,496; and 7,367,411; and Pub. No. US 2008/0041149. A hydraulically operated choke valve sold by M-I Swaco of Houston, Tex. under the name SUPER AUTOCHOKE may be used along with any known regulator or choke valve. The choke valve and system may have a dedicated hydraulic pump and manifold system. A positive displacement mud pump may be used for circulating drilling fluids. It is contemplated that there may be a system of choke valves, choke manifold, flow meter, and hydraulic power unit to actuate the choke valves, as well as sensors and an intelligent control unit. It is contemplated that the system may be capable of measuring return flow using a flow meter installed in line with the choke valves, and to detect either a fluid gain or fluid loss very early, allowing gain/loss volumes to be minimized.

It is contemplated that the DTTL method may use drill string non-return valves. Non-return or check valves are designed to prevent fluid from returning up the drill string. It is also contemplated that the DTTL method may use downhole deployment valves to control pressure in the wellbore, including when the drill string is tripped out of the wellbore. Downhole deployment valves are proposed in U.S. Pat. Nos. 6,209,663; 6,732,804; 7,086,481; 7,178,600; 7,204,315; 7,219,729; 7,255,173; 7,350,590; 7,413,018; 7,451,809; 7,475,732; and Pub. Nos. US 2008/0060846 and 2008/0245531; which are all hereby incorporated by reference for all purposes in their entirety and are assigned to the assignee of the present application. For the drilling fluid traveling down the wellbore, it may be pressurized in a system of the positive displacement mud pump, standpipe hose, the drill string, and the drill string non-return valves. For the drilling fluid returning up the annulus, it may be pressurized in a system of the casing shoe, casing and surface equipment, the RCD system, such as shown in FIGS. 7 to 17B, and the dedicated choke manifold. The DTTL method may also be used for running tubulars without rotating, including, but not limited to, drill string, drill pipe, casing, and coiled tubing, into and out of the hole.

While rock mechanics, rheological and chemical compatibility issues with the formation to be drilled are factors to be considered, the DTTL method allows for lighter, more hydrostatically underbalanced, more readily available, and less expensive drilling fluids to be used. The DTTL method simplifies the drilling process by reducing non-productive time (NPT) dealing with drilling windows. Also, the lighter drilling fluid allows for faster and less resistive rotation of the drill string. Circulating Annular Friction Pressure (AFP) increases in a proportion to the weight and viscosity of the drilling fluid. It is important to recognize that AFP is a significant limiting factor to conventional drilling and the objective of CBHP is to counter its effect on the wellbore pressure profile by the application of surface back pressure when not circulating. The DTTL method's use of much lighter drilling fluids result in a significant reduction in pressures imparted by the circulation rate of the drilling fluid and offers the option to circulate at much higher rates with no ill effects. The DTTL method's drilling fluid offers another distinct advantage in that lighter fluids are less prone for its viscosity to increase during periods of idleness. This "jelling" manifests itself as a spike in the EMW upon restarting the rig's mud pumps to regain circulation. As such pressure fluctuations are detrimental to precise management of the uncased hole pressure environment, the DTTL method significantly minimizes the impact of jelling. However, one must be mindful that some formations require a minimum mud weight to aid in supporting the walls of the uncased hole, formations such as unconsolidated sand, rubble zones, and some grossly depleted formations. Given these considerations, the criteria for selection of the drilling fluids may be focused upon (1) the ability to clean the hole (cuttings carrying ability), (2) a light enough weight to avoid loss circulation, and (3) a heavy enough weight so that the back pressure required to prevent an influx from the formation will not exceed the limits of the weakest component of the well construction program. In designing the fluids program for the DTTL method, the formation pore pressure is not used, with the objective being to avoid exceeding the "weakest link" of the fracture gradient, the casing shoe integrity, or the integrity of any other component of the closed pressurized circulating fluid system's pressure containment capability. A LOT, offset well information or rock mechanics calculations should provide the maximum allowable pressure for the casing shoe. In land drilling programs, the casing shoe fracture pressure will most often not be the "weakest link" of the pressure containment system. However, the casing shoe pressure integrity may be less than the formation fracture pressure when drilling offshore, such as in geologically young particulate sediments, through salt domes, whose yielding characteristics challenge the ability to obtain an acceptable casing and casing shoe cement job.

The right side of the chart in FIG. 3 shows a comparison of casing programs for the conventional and CBHP MPD methods to the DTTL method. Like the drilling fluids program, the casing program using the DTTL method for this geologic formation is simplified in comparison with the prior art casing programs. Simplification of the casing program with the DTTL method is a direct result of two distinguishing characteristics: 1.) a lighter mud imparting less depth vs. pressure gradient upon the wellbore, enabling deeper open holes than conventional or CBHP to be drilled before the fracture pressure is approached requiring a casing shoe set point as best shown in FIG. 4A, and 2.) to maintain the EMW further away from the formation fracture gradient. For example, the DTTL method allows for a 24 inch wellhead, as compared with a more expensive 30 inch wellhead required by the conventional and CBHP MPD methods. The DTTL method also allows the total depth objective to be obtained with a larger and longer open hole than is possible with the prior art methods. In the example of FIG. 3, the DTTL method allows for a 10 inch diameter production liner (gravel pack-type completion or open hole) as compared with a 7 inch production liner for the conventional method or a 4½ inch production liner for the CBHP MPD method. The 10 inch production liner in the DTTL method advantageously extends completely through the reservoir, unlike the prior art methods. As a result, the DTTL method only requires three casing/liner size changes, compared with five changes with the CBHP MPD method and seven changes with the conventional method. Both the conventional and CBHP MPD methods require a dedicated casing set point around 1700 meters (5577 feet) for the kick hazard, but the DTTL method does not. In summary, the DTTL method allows use of smaller diameter wellhead and casing initially and a larger diameter liner to total depth (TD) with fewer tubular changes and with less expensive, more readily available lighter fluids. The contemplated maximum surface back pressure on the DTTL method would be 975 psi (circulating); 1030 psi (during connection) and 2713 psi (shut in). The LOT on the 13⅜" casing shoe must be less than 4140 psi.

Figure 4:
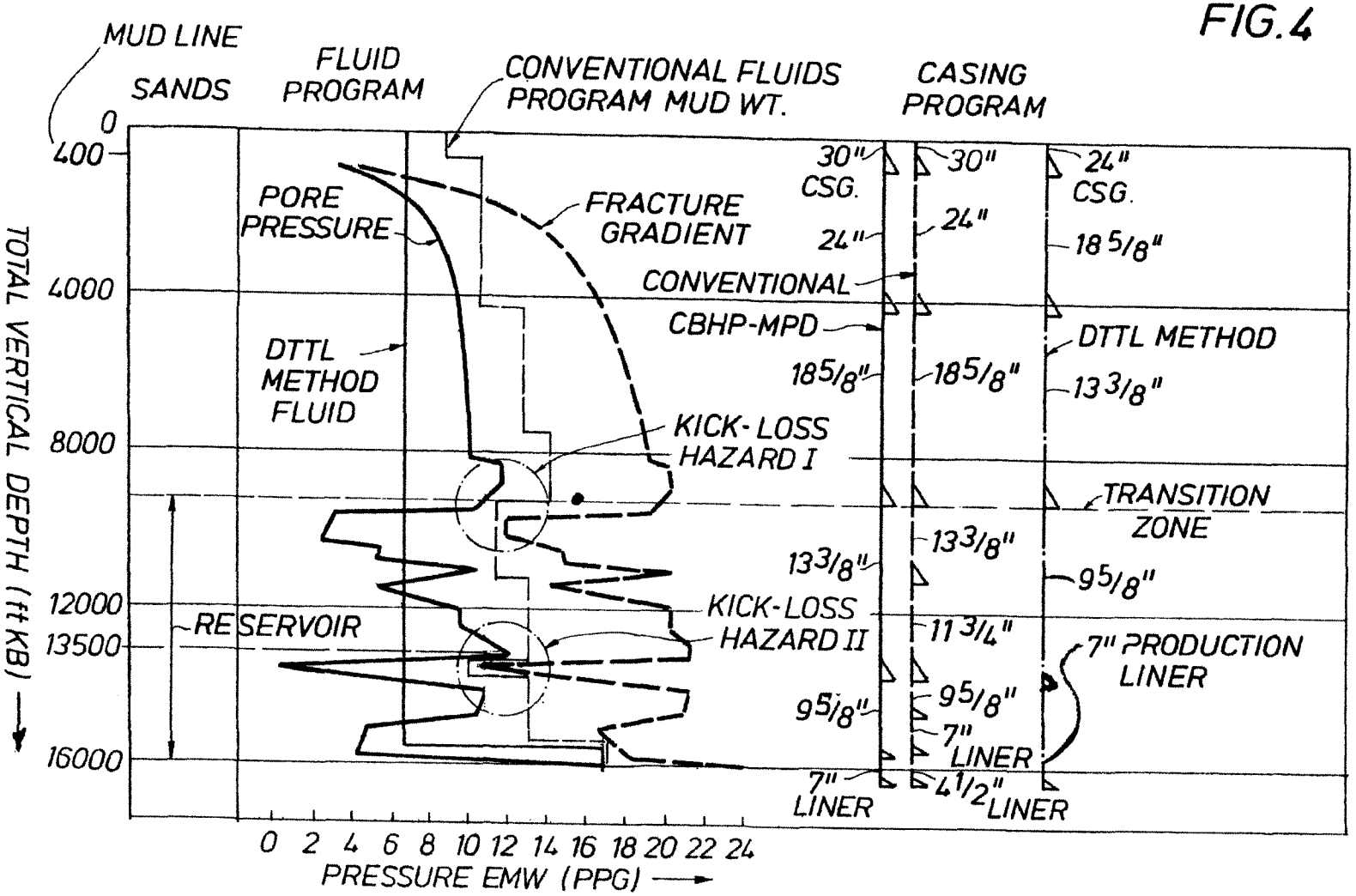
FIG. 4 is a comparison chart comparing the fluid programs and casing programs for prior art conventional and CBHP MPD methods versus the DTTL method for a jack-up rig in 400' of water.

Turning to FIG. 4, the advantages of the DTTL method are shown in a different geologic formation with objectives of lightest mud, highest rate of penetration (ROP), slimmest casing program, deepest open hole below 9⅝" casing for maximum access to reservoir. The formation pore pressure and fracture gradient are shown for an offshore geologic prospect for a jack-up rig having a mud line at 400 feet (122 meters). The prospect has a shifting drilling window. The shallow gas hazard is mitigated because the DTTL method teaches the application of surface backpressure whether circulating or not, and encountering a shallow gas hazard simply implies additional surface backpressure. There are kick-loss hazard zones around 9000 feet (2743 meters) and 14,000 feet (4267 meters). The left side of the chart shows a comparison of exemplary drilling fluids programs for the conventional method to the DTTL method. Note that the pressure-containing integrity of the 13⅝" casing shoe at 9,500' has a LOT value less than the fracture pressure. Therefore, this casing shoe is considered the limiting component relative to DTTL fluids selection and determines the maximum amount of surface backpressure that may be applied without risk of fracturing the casing shoe. The EMW for the drilling fluid used with the conventional method is shown with a series of dashed lines starting at about 9 ppg at the surface and making several changes until ending at about 17 ppg at a depth of about 16,000 feet (4877 meters). The conventional method is complicated by the need for eight drilling fluid density changes to navigate through the drilling window. The EMW for the drilling fluid of the DTTL method is shown with a solid line at about 6.7 ppg starting at the surface. The kick-loss hazards present challenges for the conventional method, and require rapid mud weight changes to navigate. In the DTTL method, the kick-loss hazards become a moot point, unlike in the conventional method, which must rely on mud weight changes. With CBHP, placing a casing shoe above the kick-loss hazard zones is a prudent and common practice, typically because of uncertainty of the accuracy of the estimated drilling window in the kick-loss hazard zone, and one should keep the option open to deviate from the pre-planned CBHP mud weight. With the DTTL method, the EMW of the drilling fluid is kept substantially constant to about 16,000 feet (4877 meters). Unlike the conventional method, in the DTTL method some amount of surface back pressure may be held on the drilling fluid. In the DTTL method surface back pressure is provided to keep the total EMW above pore pressure but below the fracture gradient. As should now be understood, the DTTL method simplifies the drilling process as it allows for less changes in the drilling fluid as compared with the conventional method. Again, the DTTL method allows for lighter, more hydrostatically underbalanced, more readily available, and less expensive drilling fluids to be used. In designing the fluids program with the DTTL method, the formation pore pressure is not used, with the objective being to avoid exceeding the fracture gradient, the casing shoe integrity, or the integrity of any other component of the closed pressurized circulating fluid system's pressure containment capability.

The right side of the chart in FIG. 4 shows a comparison of casing programs for the conventional and CBHP MPD methods to the DTTL method. Like the drilling fluids program, the casing program of the DTTL method for this geologic formation is simplified in comparison with the prior art casing programs. For example, the DTTL method allows for a 24 inch wellhead, as compared with a more expensive 30 inch wellhead required by the conventional and CBHP MPD methods. The DTTL method also allows the total depth objective to be obtained with a larger and longer open hole than is possible with the prior art methods. The 9⅝" casing and 7 inch production liner in the DTTL method extends completely through the Reservoir, unlike the prior art methods. In the example of FIG. 4, the DTTL method has three casing/liner size changes, compared with five changes with the CBHP MPD method. The conventional, CBHP MPD and DTTL methods require a dedicated casing set point around 14,000 feet (4267 meters). The casing shoe is set at 14,000 feet (4267 meters) for the kick-loss hazard and for enabling drilling fluid density adjustments below that point required to handle the new drilling window. This DTTL method illustrates a case study where a cemented casing shoe is the limit, as determined by a LOT, calculations or offset well data. In this case study, the DTTL method 13⅝" casing shoe was determined to have a limit of 13.6 ppg equivalent mud weight at the beginning of the Reservoir. As best shown in FIG. 4, a 6.7 ppg oil-based mud is used below the 13⅜" casing (LOT, calculations or offset well data of 13.6 ppge limit) in the DTTL method and supplied through a 5 inch drill string DS at 500 gallons per minute. At 13,500 feet the pore pressure is 12.5 ppge. With a surface back pressure is 4,800 psi (circulating) and 5,015 psi (static), a high pressure RCD, as discussed below in detail, will be required.

As is known in the art, the calculated formation pore pressure and fracture gradient are usually not exact, and margins of error must be considered in selecting casing set points. This uncertainty may prompt additional casing set points in the conventional and CBHP MPD methods that are avoided in the DTTL method. Additional casing set points create added expense and casing shoe issues. The DTTL method uses required amounts of surface back pressure to guard against these uncertainties in the formation. There is a reasonable probability that the conventional and CBHP MPD methods as applied to the formation shown in FIG. 4 would result in a drilling program that ultimately exceeds budget (known in the art as authorization for expenditure "AFE") due to extra casing sizes, extra casing strings, and non-productive time dealing with the loss portion of the kick-loss hazards, such as differential sticking of the drill string with potential twisting and severing of the string, loss of circulation with attendant drilling fluid cost, and well control issues. A kick in the kick-loss hazard zone results in having to shut in and circulate out the kick, including waiting to increase the weight of the drilling fluid. The DTTL method advantageously allows the operation to avoid many kick-loss hazards. The DTTL method allows for drilling with a lighter drilling fluid and staying further away from the loss portion of the kick-loss hazard zone. Since there is constant surface back pressure even when there is no circulation, the kick portion may be more easily compensated for and controlled using the DTTL method.

For the geologic formation depicted in FIGS. 3 and 4, the DTTL method achieves its objectives of using the lightest and less expensive drilling fluid, the highest rate of penetration (ROP), the slimmest casing program, and a deeper open hole for more access to the reservoir than either conventional or CBHP. The DTTL method allows for the formation fracture gradient to be focused on instead of the formation pore pressure. The drilling fluid may be selected as described above. When the EMW of the drilling fluid is less than the formation pore pressure, surface pressure is applied to prevent or limit influx into the wellbore when the mud pumps are on and drilling is occurring. When the mud pumps are off, an additional amount of surface back pressure is applied to offset the loss of Circulating Annular Friction Pressure (AFP). The DTTL method effectively broadens the drilling window by not using the formation pore pressure. The DTTL method is particularly helpful where the formation pore pressure is relatively unknown, such as in exploratory wells and sub-salt reservoirs, as are common in the Gulf of Mexico.

FIG. 5A is a chart of depth in feet versus pressure equivalent in ppg for an exemplary prior art Gulf of Mexico deep water geologic prospect with a salt layer. A floating drilling rig may be used to drill the well. The drilling fluid weight for conventional drilling techniques in the salt layer is shown as greater than the salt overburden gradient and less than the salt fracture gradient. The prior art drilling fluid program is complicated by the need to continuously monitor and change the weight of the drilling fluid to stay within the drilling window. The left side of the chart shows the casing design for prior art conventional drilling techniques. The right side of the chart shows the casing design for prior art Drilling with Casing ("DwC"). DwC is an enabling technology that can be a mitigant for managing shallow hazards. An objective of the technology is to set the first and possibly the second casing strings significantly deeper than with conventional drilling techniques. DwC addresses shallow geologic hazards, wellbore instability, and other issues that would otherwise require additional casing string sizes, ultimately limiting open hole size at total depth ("TD").

Figure 5B:
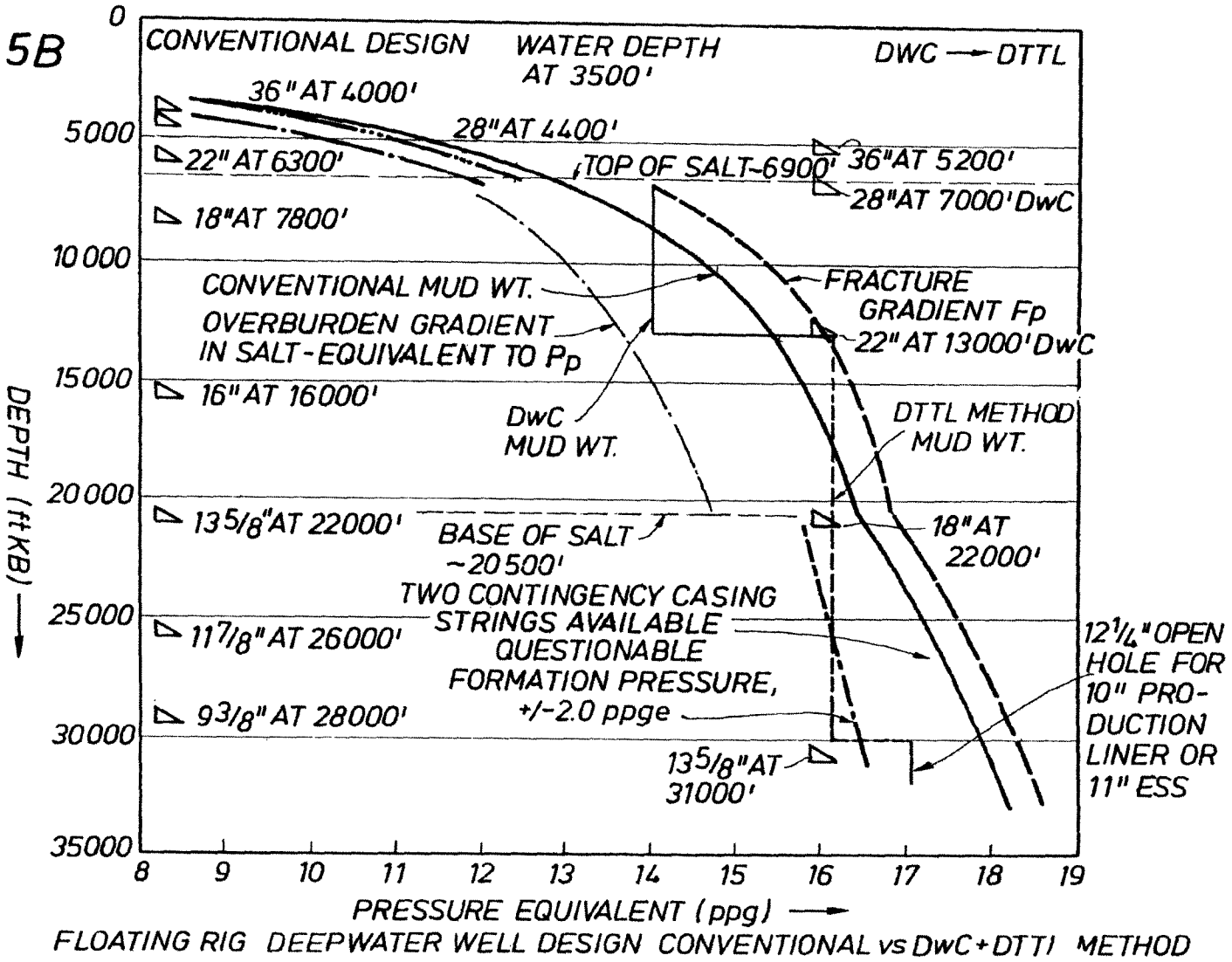
FIG. 5B is a comparison chart of casing programs comparing the prior art conventional program to the DTTL method program that provides two contingency casing strings.

FIG. 5B shows the same geologic prospect as in FIG. 5A. The pressure equivalent of the drilling fluid is shown as substantially constant at 14 ppg from a depth of around 6,900 feet (2103 meters) to about 13,000 feet (3962 meters) while DwC. The DTTL method is used beginning with 13,000 feet (3962 meters). The pressure equivalent of the drilling fluid of the DTTL method is shown as substantially constant from a depth of about 13,000 feet (3962 meters) to about 30,000 feet (9144 meters). The DTTL method simplifies the drilling fluids program by using a lighter weight drilling fluid than the conventional technique, and by requiring only one change of fluid weight after a depth of 30,000 feet (9144 meters), in comparison with continuous changes required by conventional techniques. The left side of the chart again shows the casing design for conventional drilling techniques. The right side of the chart shows the casing design for the DTTL method. Using the DTTL method, a 13⅝ inch casing shoe may be used at total depth of 31,000 feet (9449 meters), compared with a 9⅜ inch casing shoe at TD of 28,000 feet (8534 meters) for the conventional drilling method. The DTTL method provides for a larger hole and deeper total depth (TD). There are also two contingency casing strings available with the DTTL method. It is contemplated that the DTTL method could be used with DwC having a 13⅝" casing.

Figure 5C:
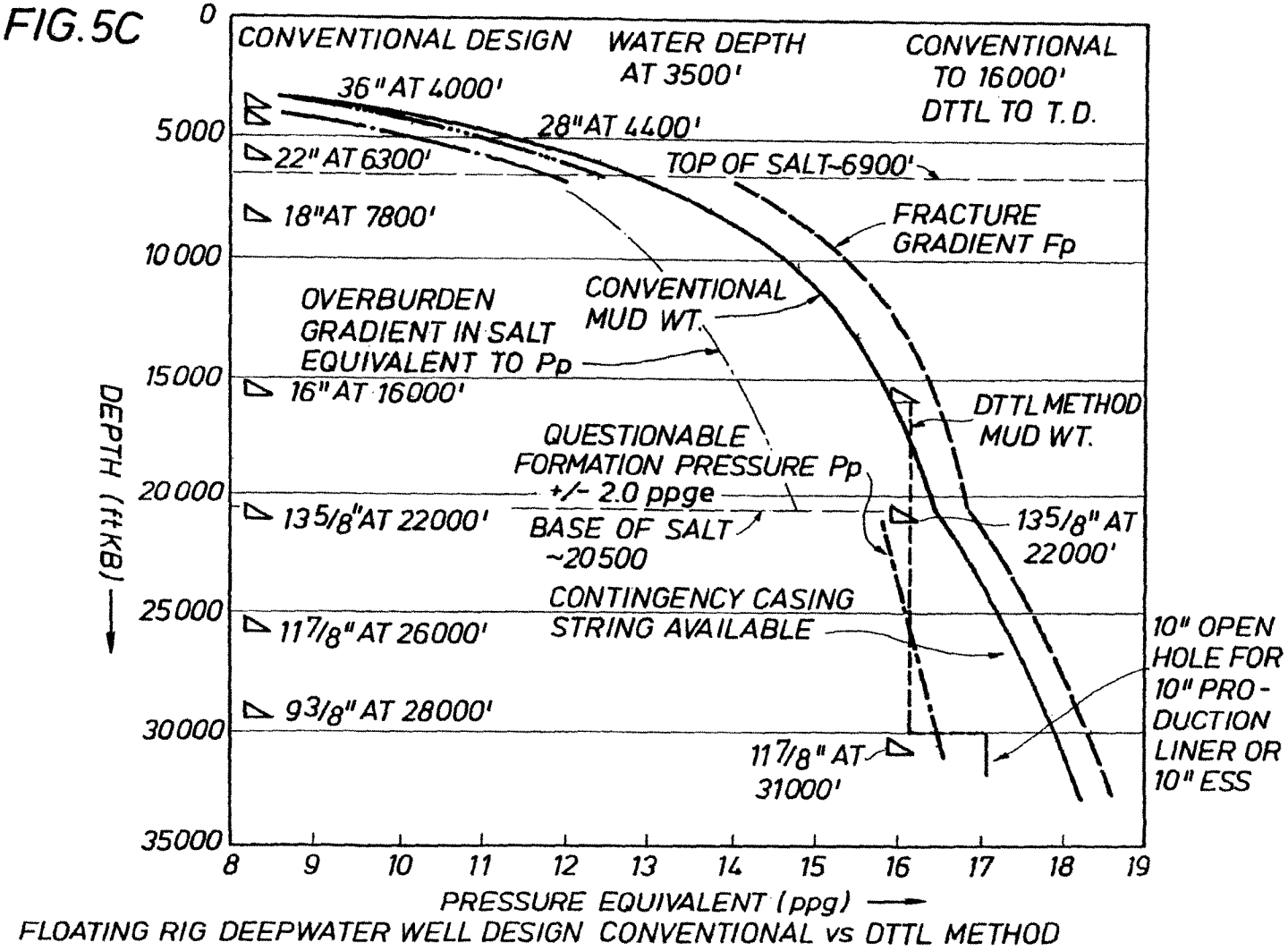
FIG. 5C is a comparison chart of casing programs using the prior art conventional fluid program to 16,000' then using the DTTL method to provide a contingency casing string.

FIG. 5C is the same as FIG. 5B, except that in the DTTL method one of the contingency casing strings has been removed, resulting in a 11⅞ inch casing shoe at TD of 31,000 feet (9449 meters). As can now be understood, sub-salt, the DTTL method advantageously achieves the largest and deepest open hole at total depth (TD) for production liners and expandable sand screens (ESS). The DTTL method is particularly beneficial beneath the transition zone in the reservoir. In conventional drilling, drilling fluid weight is typically increased to be safe in light of the margin of error in predicting the pore pressure. The prediction of sub-salt formation pore pressures and formation fracture pressures has been shown on a number of deepwater wells to be in a range of error of as much as 2 to 3 ppge. This much error in predicting the actual drilling window plays a continuous role in the design of a conventional casing and fluids program. The worst case scenario must always be planned for long in advance to obtain a permit to drill from the MMS, in procurement decisions, in logistics of delivery considerations, in requirements for deck space for various casing sizes, and for other contingencies. This has an adverse affect on the cost of the well. If the well is sub salt, then seismographic imaging may be blurred by the plastic nature of the salt dome. Accurate prediction of the drilling window may be difficult. This may result in estimating on the high side when designing the fluids program, which may explain why loss circulation and the resulting well control issues often arise in many drilling programs when the bit penetrates through the base of salt in the Gulf of Mexico. The MMS requires EMW to be at least 0.5 ppge above formation pore pressure, which is a relative unknown. Sub salt prospects in the Gulf of Mexico include Atwater Valley, Alaminos Canyon, Garden Banks, Keathley Canyon, Mississippi Banks, and Walker Ridge.

There are other uncertainties in the open hole below the last casing seat that complicate conventional and CBHP MPD casing and fluids programs. These include compressibilites, solubilities, mechanical, thermal, and fluid transport characteristics of each formation, natural and/or operationally induced wellbore communicating fracture systems, undisturbed states prior to drilling sand, and time-dependent behaviors after being penetrated by the wellbore. With the DTTL method, surface equipment pressure rating may be advantageously used to compensate for the relative unknown, such as the range of error. With the DTTL method, the driller may tool up at the surface to deal with downhole uncertainties, rather than complicating the downhole casing and fluids programs to handle the worst case scenario of each. As discussed above, the DTTL method also advantageously increases the contingency for additional casing sizes, if needed. Failed drilling programs sometimes occur because the conventional casing program has no margin for contingency if the geo-physics or rock mechanics (i.e. wellbore instability) are different than planned. As can now be understood, the DTTL method achieves a simplified and lower cost well construction casing program. The DTTL method is applicable for land, shallow water, and deep water prospects. The DTTL method allows for a higher safety factor than prior art conventional methods. The MMS requires at least a 200% safety factor on pressure ratings of all surface equipment. The DTTL method gets to TD with the deepest and largest open-hole possible for reservoir access. Simply stated, the DTTL method is faster, cheaper and better than the conventional or CBHP MPD methods.

High Pressure Rotating Control Device

FIG. 6 is a prior art pressure rating graph for the prior art Weatherford Model 7800 RCD that shows wellbore pressure in pounds per square inch (psi) on the vertical axis, and RCD rotational speed in revolutions per minute (rpm) on the horizontal axis. The maximum allowable wellbore pressure without exceeding operational limits for the prior art RCD is 2500 psi for rotational speeds of 100 rpm or less. The maximum allowable pressure decreases for higher rotational speeds. Weatherford also manufactures an active seal RCD, RBOP 5K RCD with 7 inch ID, which has a maximum allowable stripping pressure of 2500 psi, maximum rotating pressure of 3500 psi, and maximum static pressure of 5000 psi. The pressure sharing RCDs shown in FIGS. 7 to 17B allow for a much higher pressure rating both in the static and dynamic conditions than the prior art RCDs. These pressure sharing RCDs will allow a large number of tool joints to be stripped out under high pressure conditions with greater sealing element performance capabilities.

Figure 7:
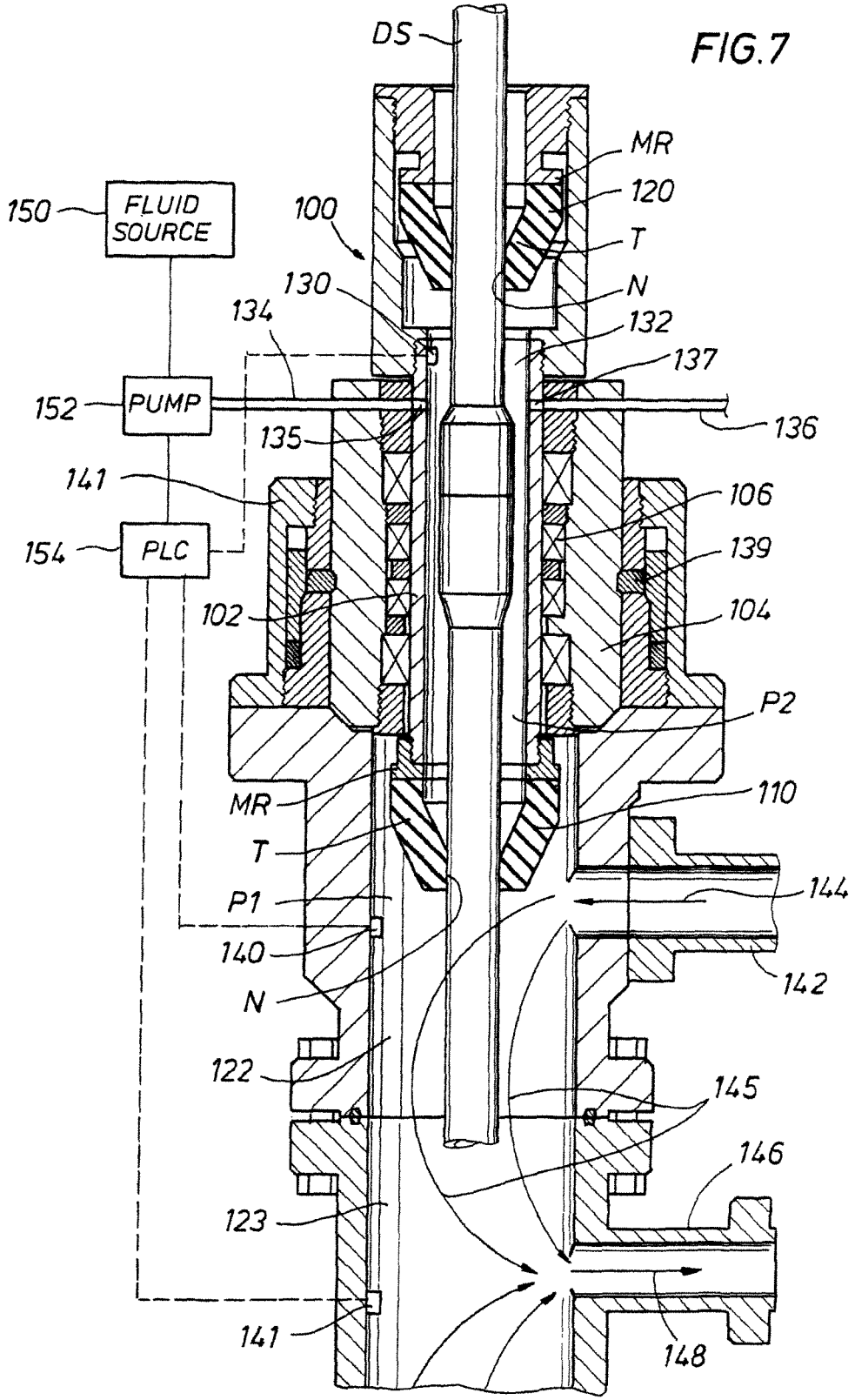
FIG. 7 is a cut away section elevational view of an RCD with two passive sealing elements, sensors for measuring pressures and temperatures in the diverter housing and the RCD internal cavity, and influent and effluent lines for circulating cavity fluid into, in and out of the RCD internal cavity. Also, arrows illustrate pressurized flow of fluids to cool the bottom passive sealing element.

While pressure sharing RCD systems are shown in FIGS. 7 to 17B, embodiments other than those shown are also contemplated. Turning to FIG. 7, RCD, generally indicated at 100, has an inner member 102 rotatable relative to an outer member 104 about bearing assembly 106. A first sealing element 110 and a second sealing element 120 are attached so as to rotate with inner member 102. Sealing elements (110, 120) are passive stripper rubber seals. First cavity 132 is defined by inner member 102, drill string DS, first sealing element 110, and second sealing element 120. A first sensor 130 is positioned in first cavity 132. A second sensor 140 is positioned in housing 122 and a third sensor 141 is positioned in diverter housing 123. Sensors (130, 140, 141), like all other sensors in all embodiments shown in FIGS. 7 to 17B, may at least measure temperature and/or pressure. Additional sensors and different measured values, such as rotation speed RPM, are also contemplated for all embodiments shown in FIGS. 7 to 17B. It is contemplated that sensors fabricated to tolerate for high pressure/high temperature geothermal drilling, with methane hydrates may be used in the cavities. Sensors (130, 140, 141), like all other sensors in all embodiments shown in FIGS. 7 to 17B, may be hard wired for electrical connection with a programmable logic controller ("PLC"), such as PLC 154 in FIG. 7. It is also contemplated that the connection for all sensors and all PLCs shown in all embodiments in FIGS. 7 to 17B may be wireless or a combination of wired and wireless. Sensors may be embedded within the walls of components and fitted to facilitate easy removal and replacement.

PLC 154 is in electrical connection with a positive displacement pump 152. It is also contemplated that the connection for all pumps and all PLCs shown in all embodiments in FIGS. 7 to 17B may be wired, wireless or a combination of wired and wireless and the pumps could be positive displacement pumps. Pump 152 is in fluid communication with fluid source 150. The fluid source 150 could include fluid from take off lines TO, as shown in FIGS. 1 and 2. Pump 152 is in fluid communication with first cavity 132 through influent line 134 and a sized influent port 135 in inner member 102. Optional effluent line 136 is in fluid communication with first cavity 132 through a sized effluent port 137 in inner member 102. If desired, line 136, or any other line discussed herein, could include a sized orifice or a valve to control flow. Based upon information received from sensors (130, 140, 141), PLC 154 may signal pump 152 to communicate a change in the pressurized fluid to first cavity 132 to provide a predetermined fluid pressure P2 to first cavity 132 to change the differential pressure between the fluid pressure P1 in the housing 122 and the predetermined fluid pressure P2 in first cavity 132 on first sealing element 110. It is contemplated that the predetermined fluid pressure P2 may be changed to be greater than, less than, or equal to P1. It is contemplated that the cavity 132 could hold pressure P2 that is in the range of 60-80% of the pressure P1 below element 110. However, any reduction of differential pressure will be beneficial and an improvement. The predetermined fluid pressure P2 may be calculated by PLC 154 using a number of variables, such as pressure and temperature readings from sensors 140, 141. These variables could be weighted, based on location of the sensor. As is now understood fluid may be circulated in, into and out of first cavity 132 or bullheaded. Likewise, fluid may be circulated, into and out of in all cavities of all embodiments shown in FIGS. 7 to 17B or bullheaded.

For all embodiments of the invention, the PLC, like PLC 154 in FIG. 7, may allow adjustable calculations of differential pressure sharing and supplying RCD cavity fluid. As will be discussed in detail below, a choke valve may receive from the PLC set points and the ratio of the shared pressure determined by the wellbore pressure in keeping with the pressure rating of the RCD. During operations, the commands of the PLC to the pressure sharing choke valve may be variable, such as to change the ratio of sharing to compensate for a sealing element that may have failed. The PLC may send hydraulic pressure to adjust the choke valve. The PLC may also signal the choke valve electrically. It is contemplated that there may be a dedicated hydraulic pump and manifold system to control the choke valve. It is further contemplated that a proportional relief valve may be used, and may be controllable with the PLC.

As can now be understood, RCD 100 and the pressure sharing RCD system of FIG. 7 allow for pressure sharing to reduce the differentiated pressure applied to the first sealing element 110 exposed directly to the wellbore pressure in the housing 122. The pressure differential across first sealing element HO, which for a prior art RCD would be substantially the wellbore pressure in the housing 122, may be reduced so that some of the pressure is shared with second sealing element 120. In a similar manner, all embodiments in FIGS. 8 to 17B provide for pressure sharing to reduce the pressure differential across the first sealing element that is exposed directly to the wellbore pressure. Other sealing elements may be used to further "share" some of the pressure with the first sealing element. This is accomplished by pressurizing the additional cavities in those embodiments. When the cavity pressure is different than the pressure across the sealing element immediately below, then there will be pressure sharing with that sealing element. When the cavity pressure is greater than the pressure that the sealing element immediately below is subjected to, there may be flushing or "burping" through the sealing element via counteracting the sealing element's stretch-tightness and the cavity pressure below the sealing element.

Returning to FIG. 7, an optional first upper conduit 142 and second lower conduit 146 allow for pressurized flow of fluids, shown with arrows (144, 145, 148) to cool first sealing element 110. The pressurized flow of fluids (144, 145, 148) may also shield first sealing element 110 from cuttings in the drilling fluid and hot returns from the wellbore in housing 122. It is contemplated that RCD 100, as well as all other RCD embodiments shown in FIGS. 8 to 17B, may have a pressure rating substantially equal to a BOP stack pressure rating.

It is contemplated for all embodiments that the fluid to a cavity may be a liquid or a gas, including, but not limited to, water, steam, inert gas, drilling fluid without cuttings, and nitrogen. A cooling fluid, such as a refrigerated coolant or propylene glycol, may reduce the high temperature to which a sealing element may be subjected. It may lubricate the throat and the nose of the passive sealing element, and flush and clean the sealing surfaces of any scaling element that would otherwise be in contact with the tubular, such as a drill string. It may also cool the RCD inner member, such as inner member 102 in FIG. 7, and assist in removing some frictional heat. A nitrogen pad in a cavity that can be "burped" into the below wellbore may be beneficial when drilling in sour formations. It is contemplated for all embodiments that a gas may be injected into a cavity through a gas expansion nozzle or a refrigerant orifice.

It is also contemplated that a single pass of a gas may be made into a cavity at a pressure that is greater, such as by 200 psi, than the pressure below the lower sealing element of the cavity. Alternatively, a single pass of chilled liquid or cuttings free drilling fluid may be made into a cavity at a greater pressure than the pressure below the lower sealing element of the cavity. Single-pass fluids that "burp" downward through the lower sealing element of the cavity may be deposited into the annulus returns via the lowest sealing element. A single-pass fluid, such as cuttings free drilling fluid, that burps downward may provide lubrication and/or cooling between the annular sealing element and drill string, as well as off-setting some of the pressure below. This may increase sealing element life.

It is contemplated that first sealing element 110, as well as all sealing elements in all other embodiments shown in FIGS. 7 to 17B, may be allowed to pass a cavity fluid, including, but not limited to, nitrogen. Returning to FIG. 7, second sealing element 120 may be removed and/or replaced from above while leaving first sealing element 110 in position in the housing 122. Removal of either sealing element may be necessary for inspection, repair, or replacement. Alternatively, RCD 100 may be removed using latch 139 of single latching mechanism 141, and sealing elements (110, 120) thereafter removed. Single and double latching mechanisms for use with RCD docketing stations are proposed in US Pub. Nos. US 2006/0144622A1 US 2008/0210471A1, which are hereby incorporated by reference for all purposes in their entirety and assigned to the assignee of the present application. It is contemplated that all embodiments may use latching mechanisms and a docketing station, such as proposed in the '622 and '471 publications.

Sealing Elements

As is known, passive sealing elements, such as first sealing element 110 and second sealing element 120, may each have a mounting ring MR, a throat T, and a nose N. The throat is the transition portion of the stripper rubber between the nose and the metal mounting ring. The nose is where the stripper rubber seals against the tubular, such as a drill string, and stretches to pass an obstruction, such as tool joints. The mounting ring is for attaching the sealing element to the inner member of the RCD, such a inner member 102 in FIG. 7. At high differential pressure, the throat, which unlike the nose does not have support of the tubular, may extrude up towards the inside diameter of the mounting ring. This may typically occur when tripping out under high pressure. A portion of the throat inside diameter may be abraded off, usually near the mounting ring, leading to excessive wear of the sealing element. For use with the DTTL method, it is contemplated that the throat profile may be different for each tubular size to minimize extrusion of the throat into the mounting ring, and/or to limit the amount of deformation and fatigue before the tubular backs up the throat. For the DTTL method, it is contemplated that the mounting ring will have an inside diameter most suitable for pressure containment for each size of tubular and the obstruction outside diameter. U.S. Pat. No. 5,901,964 proposes a stripper rubber sealing element having enhanced properties for resistance to wear.

It is contemplated that first sealing element 110 and second sealing element 120, as well as all sealing elements in any other embodiment shown in FIGS. 8 to 17B, may be made in whole or in part from SULFRON® material, which is available from Teijin Aramid BV of the Netherlands. SULFRON® materials are a modified aramid derived from TWARON® material. SULFRON material limits degradation of rubber properties at high temperatures, and enhances wear resistance with enough lubricity, particularly to the nose, to reduce frictional heat. SULFRON material also is stated to reduce hysteresis, heat build-up and abrasion, while improving flexibility, tear and fatigue properties. It is contemplated that the stripper rubber sealing element may have para aramid fibers and dust. It is contemplated that longer fibers may be used in the throat area of the stripper rubber sealing element to add tensile strength, and that SULFRON material may be used in whole or in part in the nose area of the stripper rubber sealing element to add lubricity. The '964 patent, discussed in the Background of the Invention, proposes a stripper rubber with fibers of TWARON® material of 1 to 3 millimeters in length and about 2% by weight to provide wear enhancement in the nose area. It is contemplated that the stripper rubber may include 5% by weight of TWARON to provide stabilization of elongation, increase tensile strength properties and resist deformation at elevated temperatures. Para amid filaments may be in a pre-form, with orientation in the throat for tensile strength, and orientation in the nose for wear resistance. TWARON and SULFRON are registered trademarks of Teijin Aramid BV of the Netherlands.

It is further contemplated that material properties may be selected to enhance the grip of the scaling element. A softer elastomer of increased modulus of elasticity may be used, typically of a lower durometer value. An elastomer with an additive may be used, such as aluminum oxide or pre-vulcanized particulate dispersed in the nose during manufacture. An elastomer with a tackifier additive may be used. This enhanced grip of the sealing element would be beneficial when one of multiple sealing elements is dedicated for rotating with the tubular.

It is also contemplated that the sealing elements of all embodiments may be made from an elastomeric material made from polyurethane, HNBR (Nitrile), Butyl, or natural materials. Hydrogenated nitrile butadiene rubber (HNBR) provides physical strength and retention of properties after long-term exposure to heat, oil and chemicals. It is contemplated that polyurethane and HNBR (Nitrile) may preferably be used in oil-based drilling fluid environments 160° F. (71° C.) and 250° F. (121° C.), and Butyl may preferably be used in geothermal environments to 250° F. (121° C.). Natural materials may preferably be used in water-based drilling fluid environments to 225° F. (107° C.). It is contemplated that one of the stripper rubber sealing elements may be designed such that its primary purpose is not for sealability, but for assuring that the inner member of the RCD rotates with the tubular, such as a drill string. This sealing element may have rollers, convexes, or replacement inserts that are highly wear resistant and that press tightly against the tubular, transferring rotational torque to the inner member. It is contemplated that all sealing elements for all embodiments in FIGS. 7 to 17B will comply with the API-16RCD specification requirements.

Tripping out under high pressure is the most demanding function of annular sealing elements.

The sized port 135 to first cavity 132 in RCD 100 in FIG. 7 may be used for circulating a coolant or lubricant and/or pressurizing the cavity 132 with inert gas and/or pressurizing the cavity 132 with different sources of gas or liquids. Likewise, the access to all of the cavities in all embodiments shown in FIGS. 8 to 17B may be used for circulating or flushing with a coolant or lubricant and/or pressurizing the cavity with inert gas and/or pressurizing the cavity with different sources of gas or liquids. The pressure sharing capabilities of the embodiment in FIG. 7 allow the RCD 100 to have a higher pressure rating than prior art RCDs. The pressure sharing RCD system embodiment shown in FIG. 7, as well as the embodiments shown in FIGS. 8 to 17B, allow for higher pressure ratings and may be used with the DTTL method discussed above. In addition to using the high pressure RCDs in the DTTL method, the RCDs in all embodiments disclosed herein are desirable when a higher factor of safety is desired for the geologic prospect. The RCDs in all embodiments disclosed herein allow for enhanced well control. Some formation pressure environments are relatively unknown, such as sub-salt. High pressure RCDs allow for higher safety for such prospects. "Dry holes" have resulted in the past from not knowing the formation pore pressure, and grossly overweighting the drilling fluid to be safe, thereby masking potentially acceptable pay zones at higher oil and gas market prices.

Figure 8:
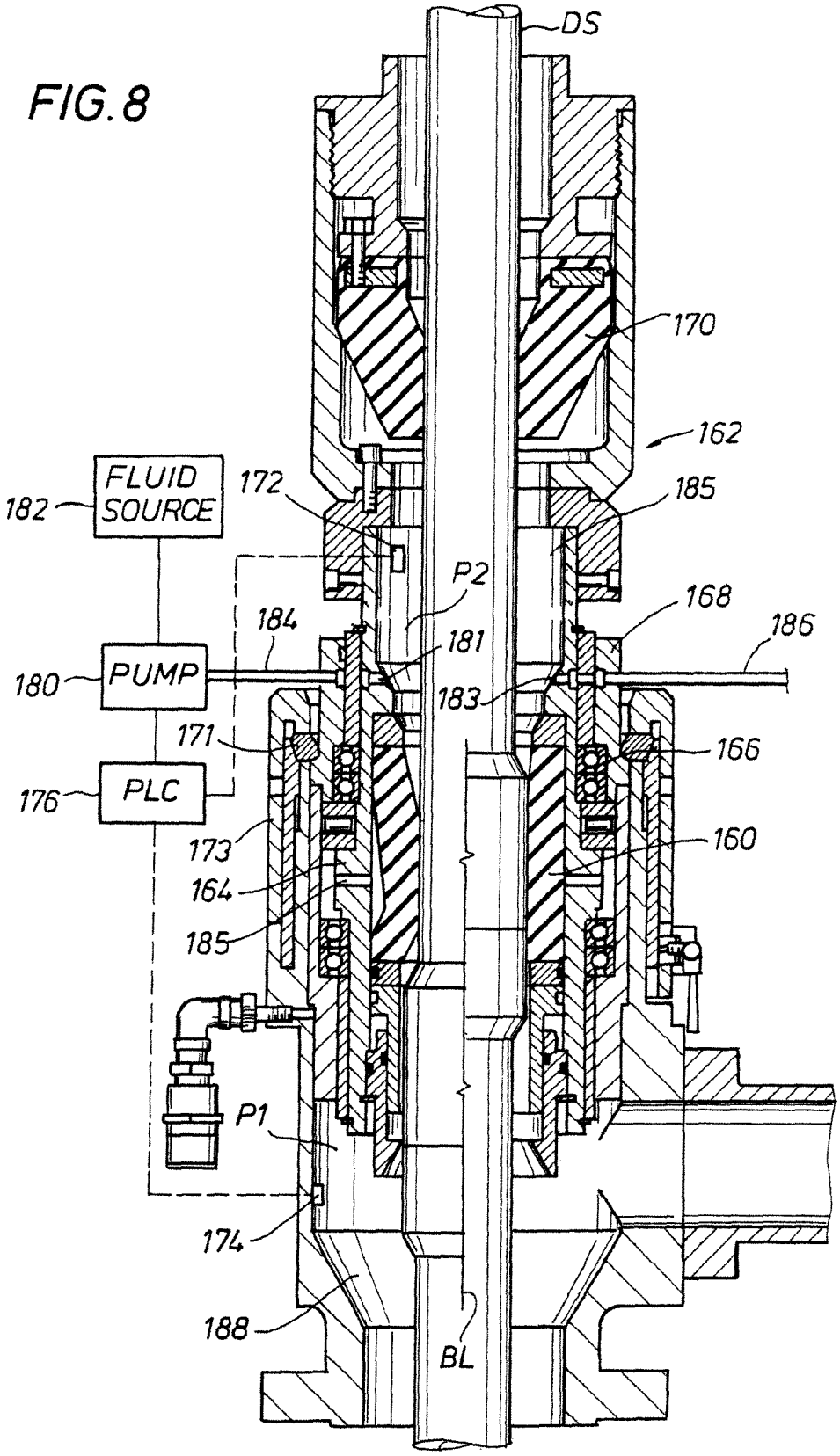
FIG. 8 is a cut away section elevational view of an RCD with a lower active sealing element (shown inflated on one side and deflated on the other side to allow the tool joint to pass) and an upper passive sealing element, sensors for measuring pressures and temperatures in the diverter housing and the RCD internal cavity, and influent and effluent lines for circulating cavity fluid into, in and out of the RCD internal cavity.

Turning to FIG. 8, RCD, generally indicated at 162, has an inner member 164 rotatable relative to an outer member 168 about bearing assembly 166. RCD 162 is latchingly attached with latch 171 to housing 173. A first sealing element 160 and a second sealing element 170 are attached to and rotate with inner member 164. First sealing element 160 is an active sealing element. As with other active sealing elements proposed herein, the active sealing element 160 is preferably engaged on a drill string DS, as shown on the left side of the vertical break line BL, when drilling, and deflated, as shown at the right side of break line BL, to allow passage of a tool joint of drill string DS when tripping in or out. It is also contemplated that the PLC in all the embodiments could receive a signal from a sensor that a tool joint is passing a sealing element and pressure is then regulated in each cavity to minimize load across all the sealing elements. Second sealing element 170 is a passive stripper rubber sealing element. First cavity 185 is defined by inner member 164, drill string DS, first sealing element 160, and second sealing element 170. A first sensor 172 is positioned in first cavity 185. A second sensor 174 is positioned in diverter housing 188. Sensors (172, 174) may measure at least temperature and/or pressure. Sensors (172, 174) are in electrical connection with PLC 176. PLC 176 is in electrical connection with pump 180. Pump 180 is in fluid communication with fluid source 182. Pump 180 is in fluid communication with first cavity 185 through influent line 184 and sized influent port 181 (though shown blocked) in inner member 164. Effluent line 186 is in fluid communication with first cavity 185 though sized effluent port 183 in inner member 164. Based upon information received from sensors (172, 174), PLC 176 may signal pump 180 to communicate a pressurized fluid to first cavity 185 to provide a predetermined fluid pressure P2 to first cavity 185. The differential pressure change is between the fluid wellbore pressure P1 in the housing 188 and the predetermined fluid pressure P2 in first cavity 185 on first sealing element 160. It is contemplated that P2 may be greater than, less than, or equal to P1.

Active sealing element 160 can be in fluid communication with a pump (not shown) in electrical connection with PLC 176. The activation of fluid communication between all active sealing elements (160, 190, 461, 466, 540, 654, 720) by all PLCs in all embodiments in FIGS. 8, 9, 13A, 13C, 14B, 16A, and 17B may be hard wired, wireless or a combination of wired and wireless. Fluid can be supplied or evacuated through port 185 to activate/deflate sealing element 160.

A hydraulic power unit (HPU), comprising an electrically driven variable displacement hydraulic pump, can be used to energize the sealing element. The pump can be controlled via an integrated computer controller within the unit. The computer monitors the input from the control panel and drives the pump system and hydraulic circuits to control the RCD. The HPU requires an external 460 volt power supply. This is the only power supply required for the system. The HPU has been designed for operation in Class 1, Division 1 hazardous situation.

The control system has been designed to allow operation in an automated manner. Once the job conditions have been set on the control panel, the hydraulic power unit will automatically control the RCD to meet changes in well conditions as they happen. This reduces the number of personnel required on the drill floor during the operation and provides greater safety.

In FIG. 8, the means for accessing the first cavity 185 allows for pressure sharing and/or circulating coolant or inert gas. Second sealing element 170 may be removed and/or replaced from the above while leaving first sealing element 160 in position in the housing 173. Alternatively, RCD 162 may be removed from housing 173 using latch 171 to obtain access to the sealing elements (160, 170). For the embodiment shown in FIG. 8, as well as all other embodiments of the invention, a data information gathering system, such as DIGS, available from Weatherford may be used with the PLC to monitor and reduce relative slippage of the sealing elements with the tubular, such as drill string DS. It is contemplated that real time revolutions per minute (RPM) of the sealing elements may be measured. If one of the sealing elements is on an independent inner member and is turning at a different rate than another sealing element, then it may indicate slippage of one of the sealing elements with tubular. Also, the rotation rate of the sealing elements can be compared to the drill string DS measured at the top drive (not shown) or at the rotary table in the drilling floor F.

For all embodiments in FIGS. 7 to 17B, it is contemplated that passive sealing elements and active sealing elements may be used interchangeably. The selection of the RCD system and the number and type of sealing elements may be determined in part from the maximum expected wellbore pressure. It is contemplated that passive sealing elements may be designed for maximum lubricity in the sealing portion. Less frictional heat may result in longer seal life, but at the expense of tubular rotational slippage due to the torque required to rotate the inner member of the RCD. It is contemplated that active sealing elements may be designed with friction enhancing additives for rotational torque transfer, perhaps only being energized if rotational slippage is detected. It is contemplated that one of the annular sealing elements, active or passive, may be dedicated to a primary function of transferring rotational torque to the inner member of the RCD. If the grip of the active sealing elements are enhanced, they may be energized whenever slippage is noticed, with enough closing pressure to assure rotation. The active sealing elements may have modest closing pressure to conserve their life, and have minimal differential pressure across the seal. For all embodiments, it is contemplated that the active sealing elements may allow tripping out under pressure by, among other things, deflating the active sealing element.

Figure 9:
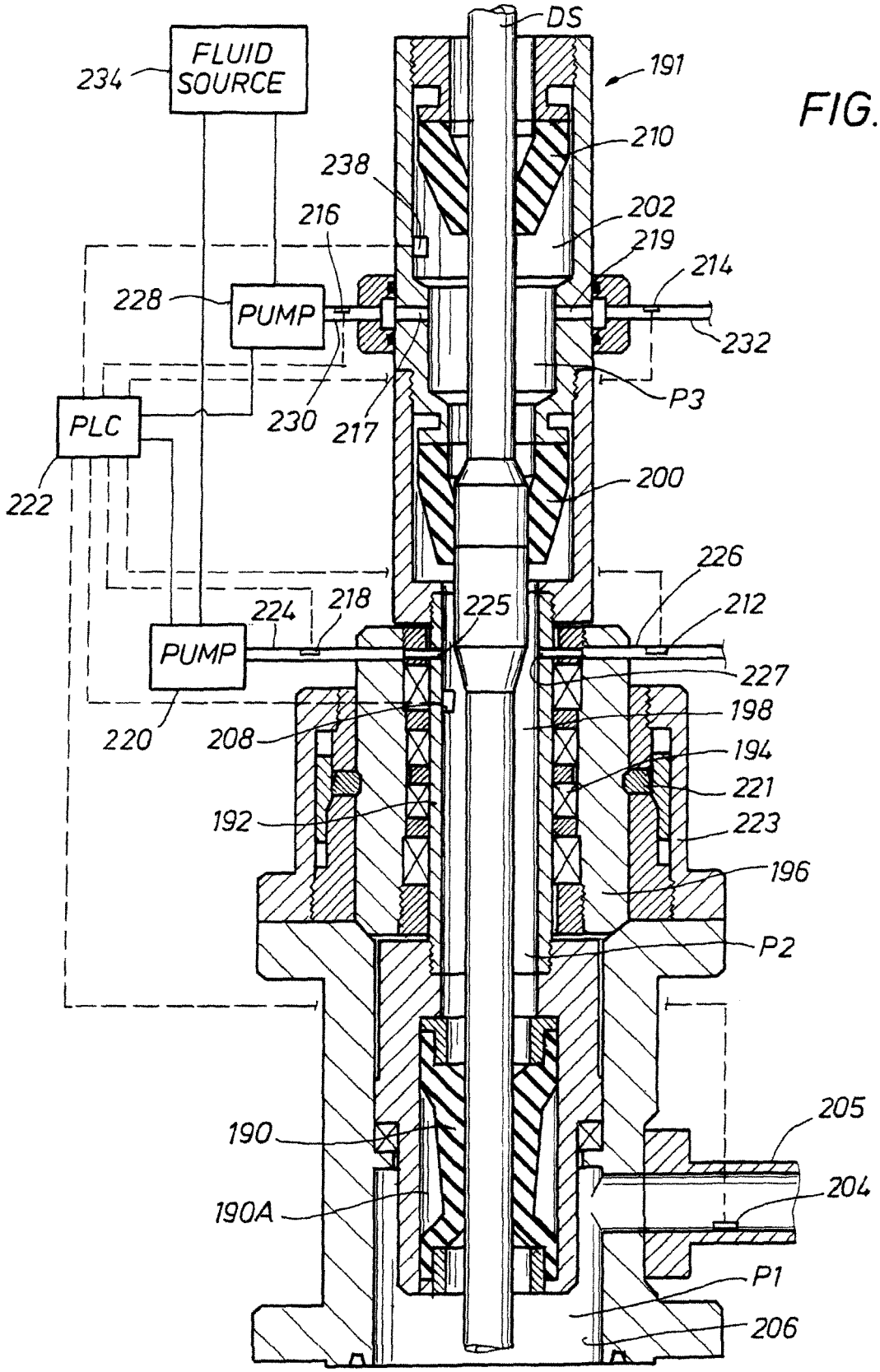
FIG. 9 is a cut away section elevational view of an RCD with a lower active sealing element and two upper passive sealing elements, sensors for measuring pressures and temperatures from the diverter housing and into, in and out of the RCD upper and lower internal cavities, and influent and effluent lines for communicating cavity fluid into, in and out of each RCD internal cavity.

Turning to FIG. 9, RCD, generally indicated at 191, has an inner member 192 rotatable relative to an outer member 196 about bearing assembly 194. A first sealing element 190, a second sealing element 200, and a third sealing element 210 are attached to and rotate with inner member 192. First sealing element 190 is an active sealing element shown engaged on a drill string DS. Second sealing element 200 and third sealing element 210 are passive stripper rubber sealing elements. First cavity 198 is defined by inner member 192, drill string DS, first sealing element 190, and second sealing element 200. Second cavity 202 is defined by inner member 192, drill string DS, second sealing element 200, and third sealing element 210.

A first sensor 208 is positioned in first cavity 198. A second sensor 204 is positioned in first conduit 205, which is in fluid communication with diverter housing 206. PLC 222 is in electrical connection with first pump 220. First pump 220 is in fluid communication with fluid source 234. First pump 220 is in fluid communication with first cavity 198 through first influent line 224 and sized first influent port 225 in inner member 192. First effluent line 226 is in fluid communication with first cavity 198 through sized first effluent port 227 in inner member 192. A third sensor 218 is positioned in first influent line 224. A fourth sensor 212 is positioned in first effluent line 226. A fifth sensor 238 is positioned in second cavity 202. PLC 222 is in electrical connection with second pump 228. Second pump 228 is also in fluid communication with fluid source 234. Second pump 228 is in fluid communication with second cavity 202 through second influent line 230 and sized second influent port 217 in inner member 192. Second effluent line 232 is in fluid communication with second cavity 202 through sized second effluent port 219 in inner member 192. A sixth sensor 216 is positioned in second influent line 230. A seventh sensor 214 is positioned in second effluent line 232. Active sealing element 190 pump (not shown) can be in electrical connection with PLC 222. Fluid can be supplied or evacuated to active sealing elements chamber 190A to activate/deflate sealing element 190. Sensors (204, 208, 212, 214, 216, 218, 238) may at least measure temperature and/or pressure. Sensors (204, 208, 212, 214, 216, 218, 238) are in electrical connection with PLC 222. Other sensor locations are contemplated for this and all other embodiments as desired.

Based upon information received from sensors (204, 208, 212, 214, 216, 218, 238), PLC 222 may signal first pump 220 to communicate a pressurized fluid to first cavity 198 to provide a predetermined fluid pressure P2 to first cavity 198 to reduce the differential pressure between the fluid wellbore pressure P1 in the diverter housing 206 and the predetermined fluid pressure P2 in first cavity 198 on first sealing element 190. It is contemplated that P2 may be greater than, less than, or equal to P1. PLC 222 may also signal second pump 228 to communicate a pressurized fluid to second cavity 202 to provide a predetermined fluid pressure P3 to second cavity 202 to reduce the differential pressure between the fluid pressure P2 in the first cavity 198 and the predetermined fluid pressure P3 in second cavity 202 on second sealing element 200. It is contemplated that P3 may be greater than, less than, or equal to P2. Active sealing element 190 may be pressurized to increase sealing with drill string DS if the PLC 222 determines leakage between the tubular and active sealing element 190. Third sealing element 210 may be removed from above while leaving second sealing element 200 in position. Second sealing element 200 may also be removed from above while leaving first sealing element 190 in position. Alternatively, RCD 191 may be removed from single latching mechanism 223 by unlatching latch 221 to obtain access to the sealing elements (190, 200, 210).

Figure 10:
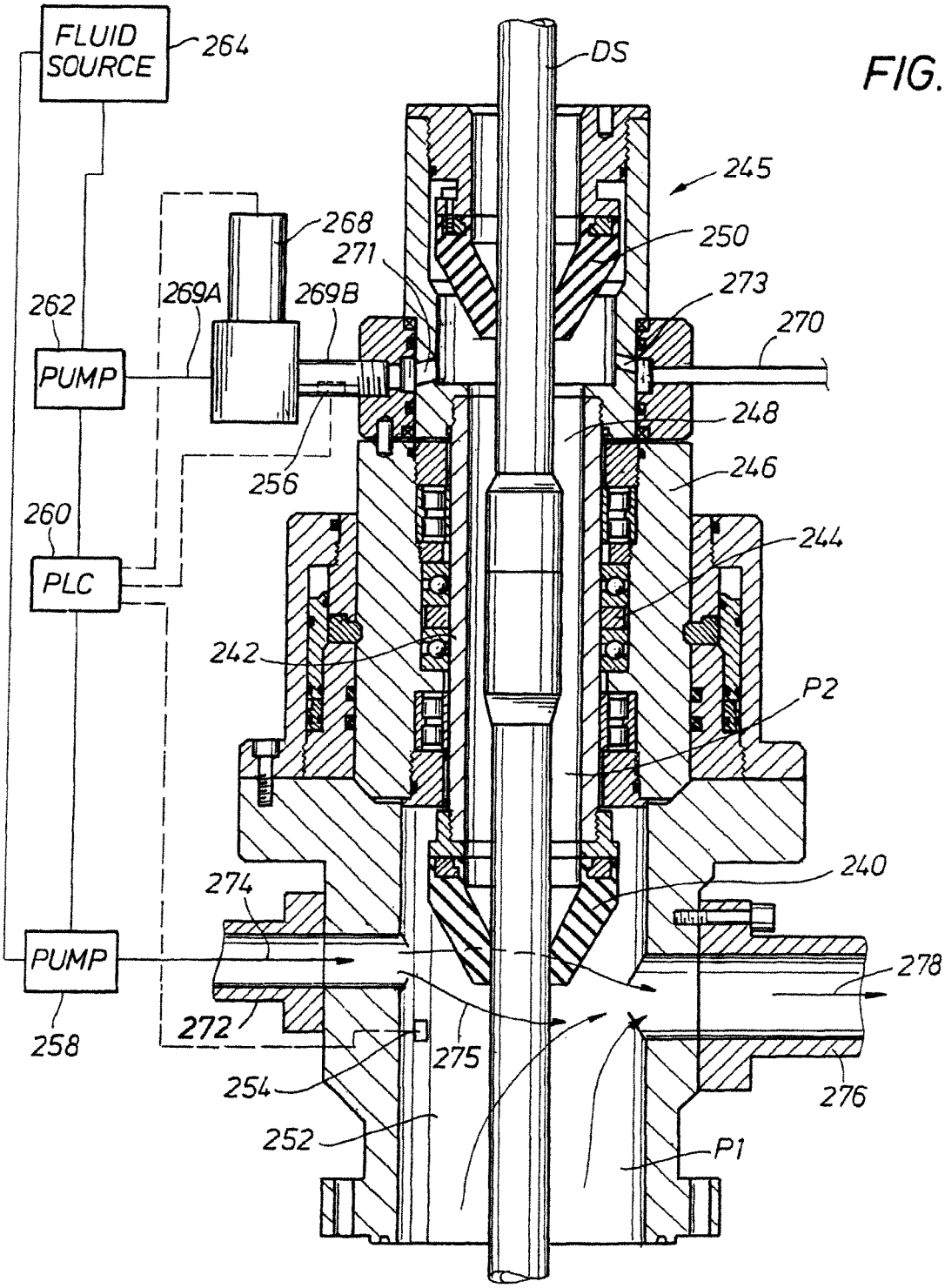
FIG. 10 is a cut away section elevational view of an RCD with two passive sealing elements, sensors for measuring pressures and temperatures in the diverter housing and into the RCD internal cavity, a pressure regulator, and influent and effluent lines for circulating cavity fluid into, in and out of the RCD internal cavity. Also, arrows illustrate pressurized flow of fluids to cool the bottom passive sealing element.

In FIG. 10, RCD, generally indicated at 245, has an inner member 242 rotatable relative to an outer member 246 about bearing assembly 244. A first sealing element 240 and a second sealing element 250 are attached to and rotate with inner member 242. Sealing elements (240, 250) are passive stripper rubber sealing elements. First cavity 248 is defined by inner member 242, tubular or drill string DS, first sealing element 240, and second sealing element 250. Pressure regulator, such as choke valve 268, is in fluid communication with first cavity 248 through influent line 269B and sized influent port 271 in inner member 242. A first sensor 256 is positioned in influent line 269B. A second probe sensor 254 is positioned in diverter housing 252. Sensors (254, 256) may at least measure temperature and/or pressure. Pressure regulator or choke valve 268, like all pressure regulators or choke valves in all embodiments shown in FIGS. 10, 11, 12A, 12B, 13A, 13B, 14A, 14B, 15A, 15B, 15C, 16A, 16B, and 17A can be in electrical connection with a PLC, such as PLC 260 in FIG. 10. As discussed above, these regulators can be manual, semi automatic or automatic and hydraulic or electronic. The electrical connection may be hard wired, wireless or a combination of wired and wireless. PLC 260 is in electrical connection with first pump 262. First pump 262 is in fluid communication with fluid source 264. First pump 262 is in fluid communication with first cavity 248 through pressure regulator or choke valve 268 and influent lines 269A, 269B through sized influent port 271 in inner member 242. Effluent line 270 is in fluid communication with first cavity 248 through sized effluent port 273 in inner member 242. It is contemplated that in applicable (not an electronic choke valve) embodiments, a PLC will transmit hydraulic pressure to adjust the choke valve, e.g. setting the choke valve. Therefore, a dedicated hydraulic pump and manifold system is contemplated to control the choke valve.

Based upon information received from sensors (254, 256), PLC 260 may signal first pump 262 to communicate a pressurized fluid to first cavity 248 to provide a predetermined fluid pressure P2 to first cavity 248 to reduce the differential pressure between the fluid wellbore pressure P1 in the diverter housing 252 and the predetermined fluid pressure P2 in first cavity 248 on first sealing element 240. It is contemplated that P2 may be greater than, less than, or equal to P1. Second pump 258 is in fluid communication with fluid source 264 and electrical connection with PLC 260. PLC 260 may signal second pump 258 to send pressurized fluid through first conduit 272 into diverter housing 252. First conduit 272 and second conduit 276 allow for pressurized flow of fluids, shown with arrows (274, 278), to cool and clean/flush first sealing element 240. The pressurized flow (274, 275, 278) also shields first sealing element 240 from cuttings in the drilling fluid and hot returns in the diverter housing 252 from the wellbore. The same or a similar system may be used for all other embodiments. Other configurations of pressure regulators or choke valves, accumulators, pumps, sensors, and PLCs are contemplated for FIG. 10 and for all other embodiments shown in FIGS. 7 to 17B.

Figure 11:
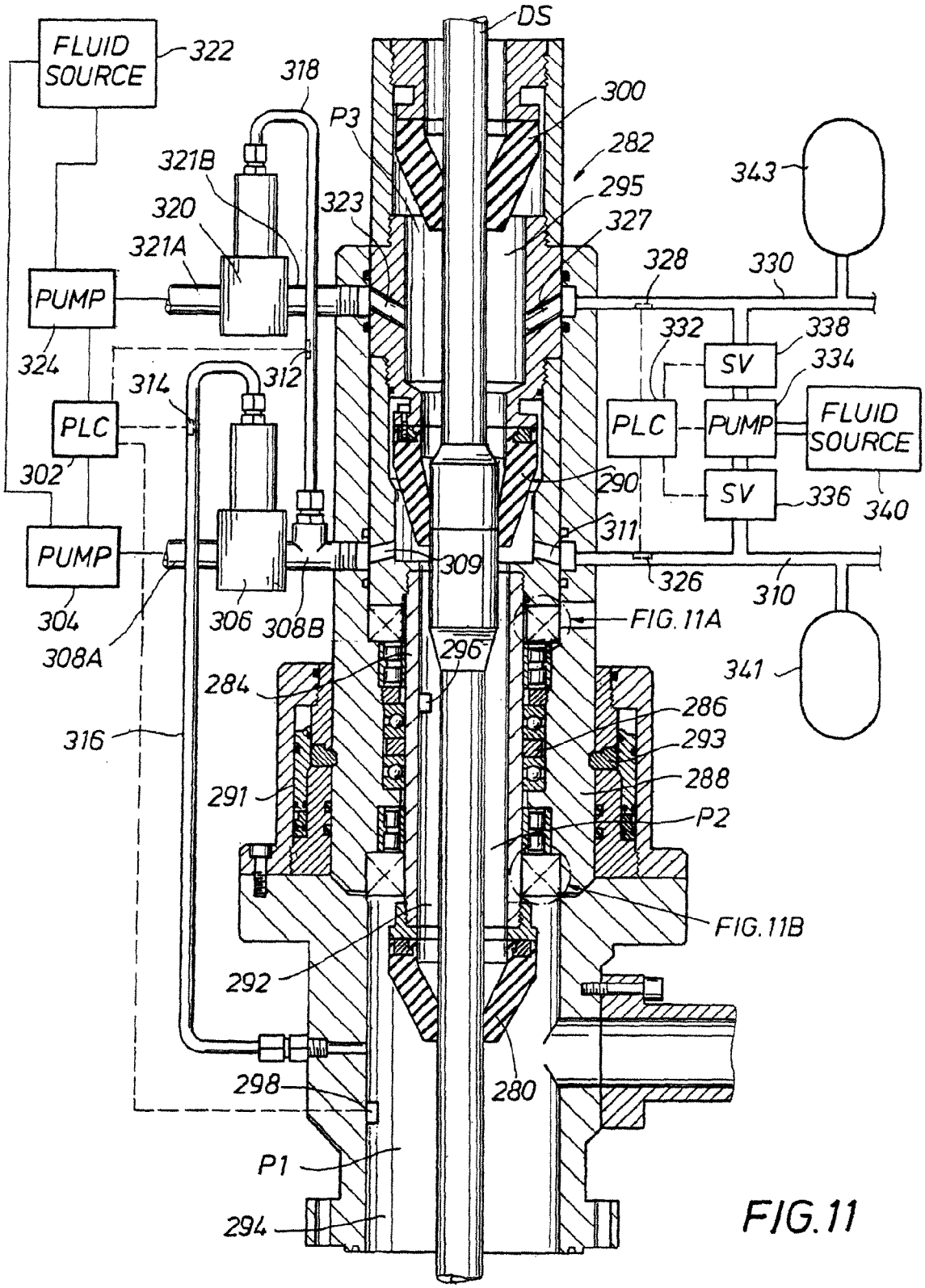
FIG. 11 is a cut away section elevational view of an RCD with three passive sealing elements positioned with a unitary housing, sensors for measuring pressures and temperatures in the diverter housing and into and out of the RCD upper and lower internal cavities, upper and lower RCD internal cavity pressure regulators, a mud line to communicate mud to the cavities via their respective regulators and influent and effluent lines for communicating cavity fluid into, in and out of each RCD internal cavity.

Turning to FIG. 11, RCD, generally indicated at 282, has an inner member 284 rotatable relative to an outer member 288 about bearing assembly 286. A first sealing element 280, a second sealing element 290, and a third sealing element 300 are attached to and rotate with inner member 284. Sealing elements (280, 290, 300) are passive stripper rubber sealing elements. First cavity 292 is defined by inner member 284, tubular or drill string DS, first sealing element 280, and second sealing element 290. Second cavity 295 is defined by inner member 284, tubular or drill string DS, second sealing element 290, and third sealing element 300.

A first sensor 296 is positioned in first cavity 292. A second sensor 298 is positioned in the diverter housing 294. First PLC 302 is in electrical connection with first pump 304. First pump 304 is in fluid communication with first fluid source 322. First pump 304 is in fluid communication with first cavity 292 through first pressure regulator, such as choke valve 306, first influent lines 308A, 308B, and first sized influent port 309 in inner member 284. First effluent line 310 is in fluid communication with first cavity 292 through first sized effluent port 311 in inner member 284. A third sensor 326 is positioned in first effluent line 310. First pressure regulator 306 is in fluid communication with diverter housing 294 through first regulator line 316. A fourth sensor 314 is positioned in first regulator line 316.

First PLC 302 is in electrical connection with second pump 324. Second pump 324 is in fluid communication with fluid source 322. Second pump 324 is in fluid communication with second cavity 295 through second pressure regulator 320, second influent lines 321A, 321B, and second sized influent port 323 in inner member 284. Second effluent line 330 is in fluid communication with second cavity 295 through second effluent port 327. Fifth sensor 328 is positioned in second effluent line 330. Second pressure regulator 320 is in fluid communication with first influent line 308B through second regulator line 318. Sixth sensor 312 is positioned in second regulator line 318. Sensors (296, 298, 312, 314, 326, 328) may at least measure temperature and/or pressure. Though sensors 326 and 328 are shown in electrical connection with second PLC 336, sensors (296, 298, 312, 314, 326, 328) can be in electrical connection with first PLC 302. Based upon information received from sensors (296, 298, 312, 314, 326, 328), first PLC 302 may signal first pump 304 to communicate a pressurized fluid to first cavity 292 to provide a predetermined fluid pressure P2 to first cavity 292 to reduce the differential pressure between the fluid pressure P1 in the diverter housing 294 and the predetermined fluid pressure P2 in first cavity 292 on first sealing element 280. It is contemplated that P2 may be greater than, less than, or equal to P1. First PLC 302 may also signal second pump 324 to communicate a pressurized fluid to second cavity 295 to provide a predetermined fluid pressure P3 to second cavity 295 to reduce the differential pressure between the fluid pressure P2 in the first cavity 292 and the predetermined fluid pressure P3 in second cavity 295 on second sealing element 290. It is contemplated that P3 may be greater than, less than, or equal to P2.

Third sealing element 300 may be threadedly removed from above while leaving second sealing element 290 in position. Second sealing element 290 may be threadedly removed from above while leaving first sealing element 280 in position. Alternatively, RCD 282 may be unlatched from single latching mechanism 291 by unlatching latch 293 and removed for access to the sealing elements (280, 290, 300).

Second PLC 332 is in electrical connection with sensors 326, 328, first solenoid valve 336 and second solenoid valve 338 and third pump 334. Third pump 334 is in fluid communication with second fluid source 340 and lines 310, 330. First accumulator 341 is in fluid communication with line 310, and second accumulator 343 is in fluid communication with line 330. When first pressure regulator 306 is closed, PLC 332 may signal first valve 336 to open and third pump 334 to move fluid from second fluid source 340 through line 310 into first cavity 292. Likewise, when second pressure regulator 320 is closed, second PLC 332 may signal second valve 338 to open and third pump 334 to move fluid from second fluid source 340 through line 330 into second cavity 295. It is contemplated that both pressure regulators 306, 320 may be closed and both valves 336, 338 open. It is contemplated that the functions of second PLC 332 may be performed by first PLC 302. Valves or orifices may be placed in lines 310, 330 to ensure that the flow moves into first cavity 292 and second cavity 295 rather than away from them. It is contemplated that the system of third pump 334, second fluid source 340, and valves 336, 338 may be used when cuttings free fluid different from fluid source 322, such as a gas or cooling fluid in a geothermal application, is desired.

As now can be understood, a "Bare Bones" RCD differential pressure sharing system could use an existing dual sealing element design RCD, such as shown in FIG. 10, with the cavity between the sealing elements having communication with the annulus returns under the bottom sealing element via a high-pressure line, such as line 316 shown in FIG. 11. Also, a cuttings filter could be positioned immediately outside the RCD in the annulus returns line to filter the annulus returns fluid. An off-the-shelf pressure relief valve could be substituted in place of the PLC and adjustable choke valve, e.g., choke valve 306. This substituted pressure relief valve may be pre-set to open to expose the top sealing element to full wellbore pressure when the bottom sealing element senses a predetermined amount of pressure. The top sealing element may handle some of the wellbore pressure when tripping out drill string. A reduction of differential pressure would significantly improve overall performance of the dual sealing element design RCD and meet AP1 16 RCD "stripping-out-under-dynamic pressure rating" guidelines. When the wellbore pressure subsides, the cuttings-free mud of higher pressure in the cavity can be burped down past (flushing) the sealing surface of the bottom sealing element. Also, the next tool joint passing thru will further aid in reducing any bottled up pressure in the cavity.

Figure 11A:
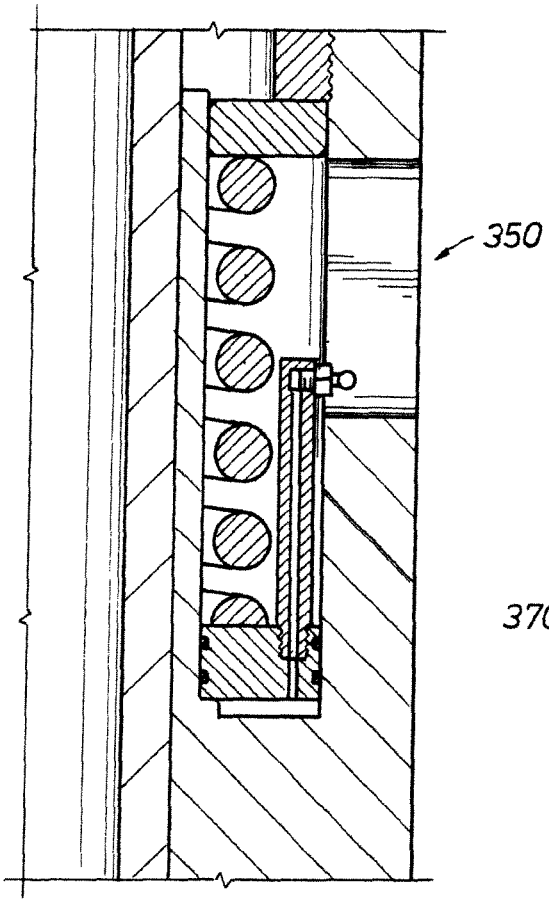
FIG. 11A is enlarged detailed elevational cross-sectional view of the RCD upper pressure compensation means as indicated in FIG. 11 to maintain the lubrication pressure above the wellbore pressure.
Figure 11B:
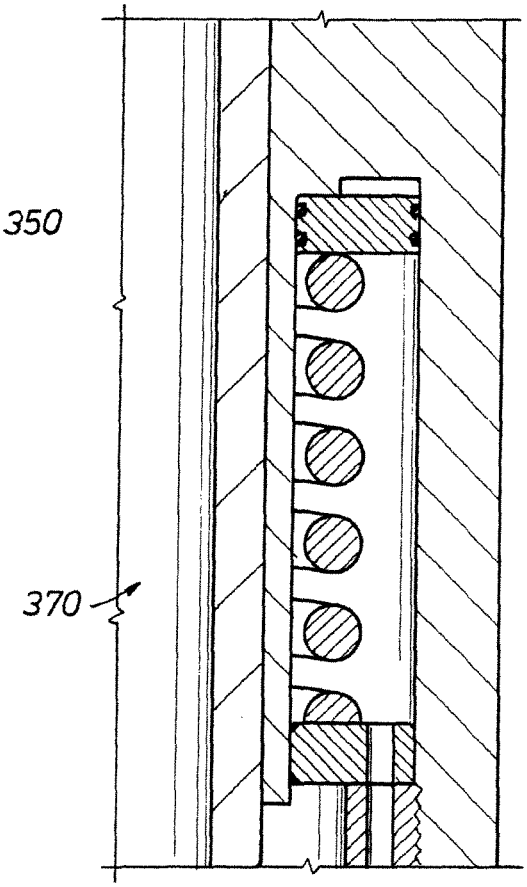
FIG. 11B is enlarged detailed elevational cross-sectional view of the RCD lower pressure compensation means as indicated in FIG. 11 to maintain the lubrication pressure above the wellbore pressure.

Turning to FIGS. 11A and 11B, pressure compensation mechanisms (350, 370) of the RCD 282 allow for maintaining a desired lubricant pressure in the bearing assembly at a predetermined level higher than the pressures surrounding the mechanisms (350, 370). For example, the upper and lower pressure compensation mechanisms provide 50 psi additional pressure over the maximum of the wellbore pressure in the diverter housing 294. Similar pressure compensation mechanisms are proposed in U.S. Pat. No. 7,258,171 (see '171 patent FIGS. 26A to 26F), which is hereby incorporated by reference for all purposes in its entirety and is assigned to the assignee of the present invention. It is contemplated that similar pressure compensation mechanisms may be used with all embodiments shown in FIGS. 7 to 17B. Although only three sealing elements (280, 290, 300) are shown in FIG. 11, it is contemplated that there may be more or less and different types of sealing elements. For all embodiments shown in FIGS. 7 to 17B, it is contemplated that there may be more or less and different types of sealing elements than shown to increase the pressure capacity or provide other functions, e.g. rotation, of the pressure sharing RCD systems.

Figure 12A:
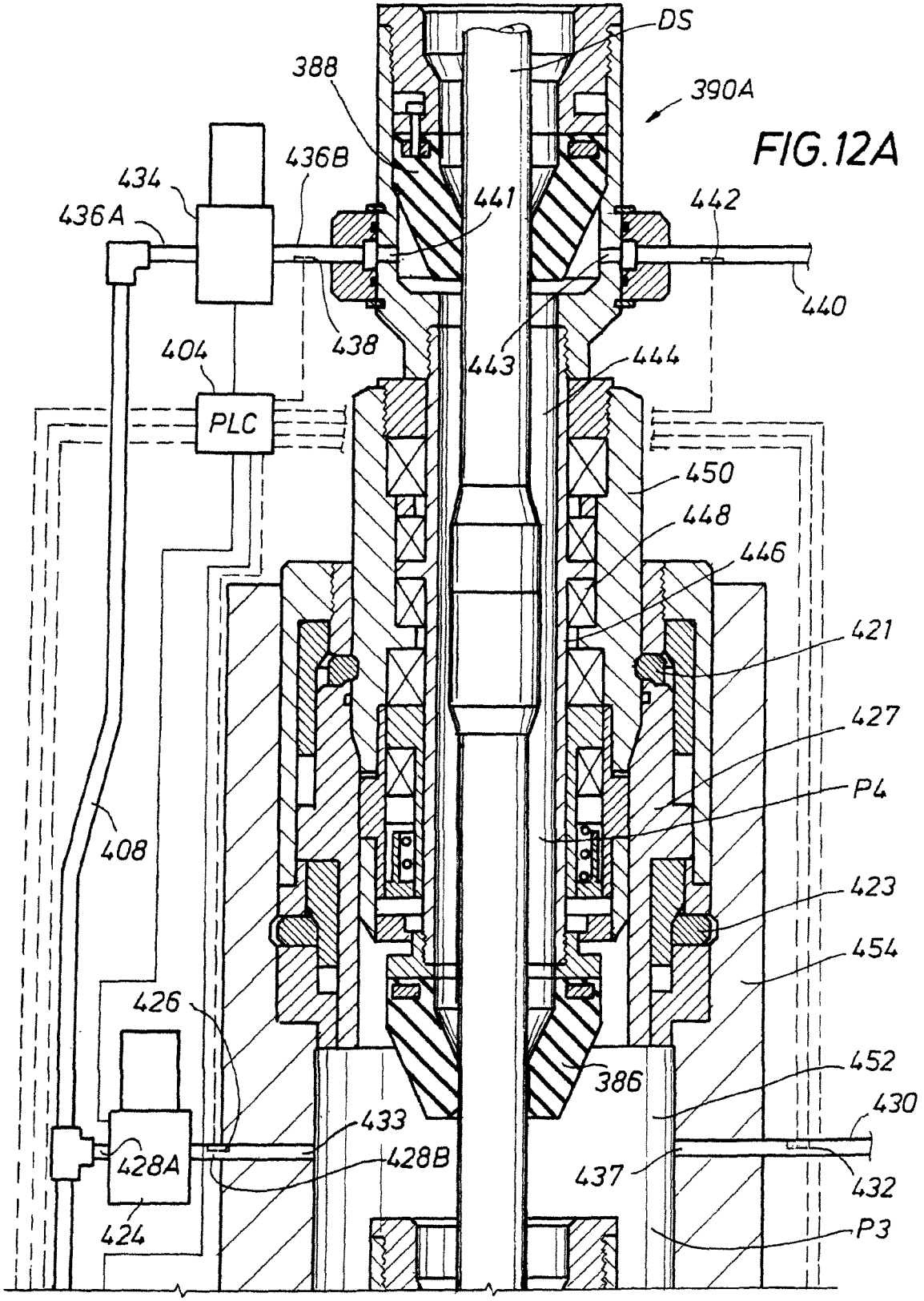
FIGS. 12A and 12B is a cut away section elevational view of an RCD with four passive sealing elements, sensors for measuring pressures and temperatures into, in and out of the diverter housing and into and out of the three RCD internal cavities, three RCD internal cavity pressure regulators and influent and effluent lines for communicating cavity fluid into, in and out of each RCD internal cavity. A programmable logic controller "PLC" is wired to the three pressure regulators to provide desired relative pressures in each cavity for differential pressure and/or "burps" of the sealing elements with, for example, a nitrogen pad.
Figure 12B:
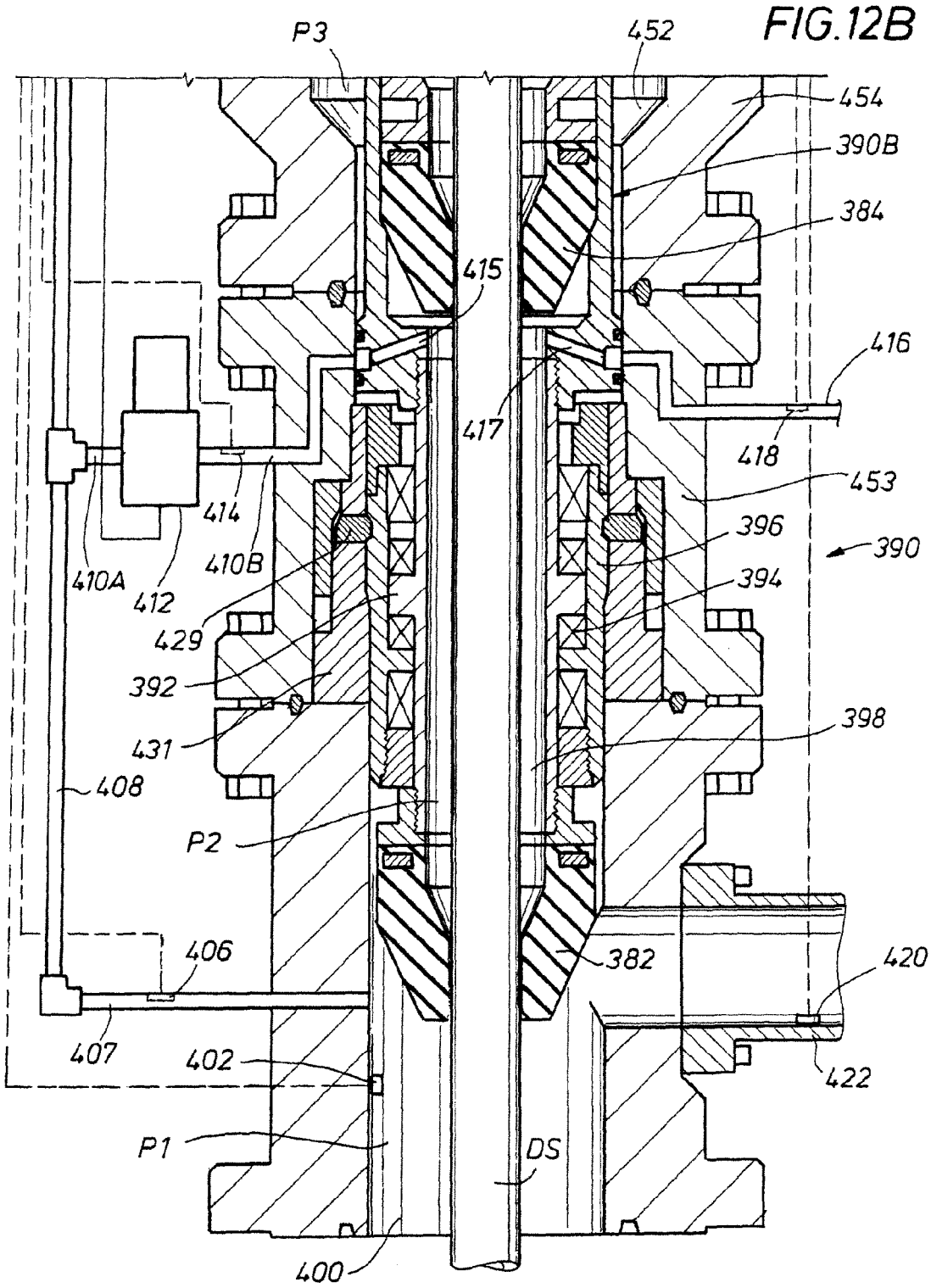

In FIGS. 12A and 12B, second RCD, generally indicated at 390A, is positioned with third housing 454 over first RCD, generally indicated at 390B, so as to be aligned with tubular or drill string DS. The combined RCD 390A and RCD 390B is generally indicated as RCD 390. First RCD 390B has a first inner member 392 rotatable relative to a first outer member 396 about first bearing assembly 394. A first sealing element 382 and a second sealing element 384 are attached to and rotate with inner member 392. Sealing elements (382, 384) are passive stripper rubber sealing elements. Second RCD 390A has a second inner member 446, independent of first inner member 392, rotatable relative to a second outer member 450 about second bearing assembly 448. A third sealing element 386 and a fourth sealing element 388 are attached to and rotate with second inner member 446. Sealing elements (386, 388) are also passive stripper rubber sealing elements.

In first RCD 390B, first cavity 398 is defined by first inner member 392, tubular or drill string DS, first sealing element 382, and second sealing element 384. Between first RCD 390B and second RCD 390A, second cavity 452 is defined by the inner surface of third housing 454 sealed with first RCD 390B and second RCD 390A, tubular or drill string DS, second sealing element 384, and third sealing element 386. Third cavity 444 is in second RCD 390A, and is defined by second inner member 446, tubular or drill string DS, third sealing element 386, and fourth sealing element 388.

First pressure regulator or choke valve 412, second pressure regulator or choke valve 424, and third pressure regulator or choke valve 434 are in fluid communication with each other and the wellbore pressure in diverter housing 400 through first regulator line 408 (via influent lines 410A, 428A, 436A) and second regulator line 407. Pressure regulators (412, 424, 434) are in electrical connection with PLC 404. A first sensor 406 is positioned in second regulator line 407. A second sensor 420 is positioned in first conduit 422 extending from diverter housing 400. First pressure regulator 412 is in fluid communication with first cavity 398 through first influent line 410B and first sized influent port 415 in first inner member 392. A third sensor 414 is positioned in first influent line 410B. First effluent line 416 is in fluid communication with first cavity 398 through first sized effluent port 417 in first inner member 392. A fourth sensor 418 is positioned in first effluent line 416. Second pressure regulator 424 is in fluid communication with second cavity 452 through second influent line 428B and second sized influent port 433 in third housing or member 454. A fifth sensor 426 is positioned in second influent line 428B. Second effluent line 430 is in fluid communication with second cavity 452 through second sized effluent port 437 in third housing or member 454. A sixth sensor 432 is positioned in second effluent line 430. Third pressure regulator 434 is in fluid communication with third cavity 444 through third influent line 436B and third sized influent port 441 in second inner member 446. A seventh sensor 438 is positioned in third influent line 436B. Third effluent line 440 is also in fluid communication with third cavity 444 through third sized effluent port 443 in second inner member 446. An eighth sensor 442 is positioned in third effluent line 440. A ninth probe sensor 402 is positioned in diverter housing 400.

The nine sensors (402, 406, 414, 418, 420, 426, 432, 438, 442) may at least measure temperature and/or pressure. Sensors (402, 406, 414, 418, 420, 426, 432, 438, 442) are in electrical connection with PLC 404. The connection may be hard wired, wireless or a combination of wired and wireless. Based upon information received from sensors (402, 406, 414, 418, 420, 426, 432, 438, 442), PLC 404 may signal pressure regulators (412, 424, 434) so as to provide desired respective pressures (P2, P3, P4) in the first cavity 398, second cavity 452, and third cavity 444, respectively, in relation to each other and the wellbore pressure P1. Fourth sealing element 388 may be removed from above while leaving third sealing element 386 in position. Removal of second RCD 390A allows for removal of first RCD 390B with second sealing element 384 and first sealing element 382. Alternatively, after the second RCD 390A is removed, second sealing element 384 may be removed from above while leaving first sealing element 382 in position. Alternatively to, or in some combination with the above, RCDs (390A, 390B) may be removed for access to all of the sealing elements. Second RCD 390A is latchingly attached with third housing 454 by double latch mechanism 427. Double latch mechanism upper inner latch 421 may be unlatched to remove RCD 390A. Double latch mechanism lower outer latch 423 may be used to unlatch double latch mechanism 427 from third housing 454 with or without the RCD 390A. First RCD 390B may be unlatched from single latch mechanism 431 using second housing latch 429. A single and double latch mechanism is proposed in greater detail in U.S. Pat. No. 7,487,837. Third housing 454 is bolted with second housing 453, and second housing 453 is bolted with first or diverter housing 400. Although only two independent RCDs (390A, 390B) are shown in FIGS. 12A and 12B, it is contemplated that there may be more or less RCDs and more or less and different types of sealing elements. As can be understood from FIGS. 12A and 12B, more than two RCDs, may be stacked in series to create more cavities and more potential for pressure sharing, thereby increasing the pressure rating of the stacked combined RCD, such as RCD 390.

Figure 13A:
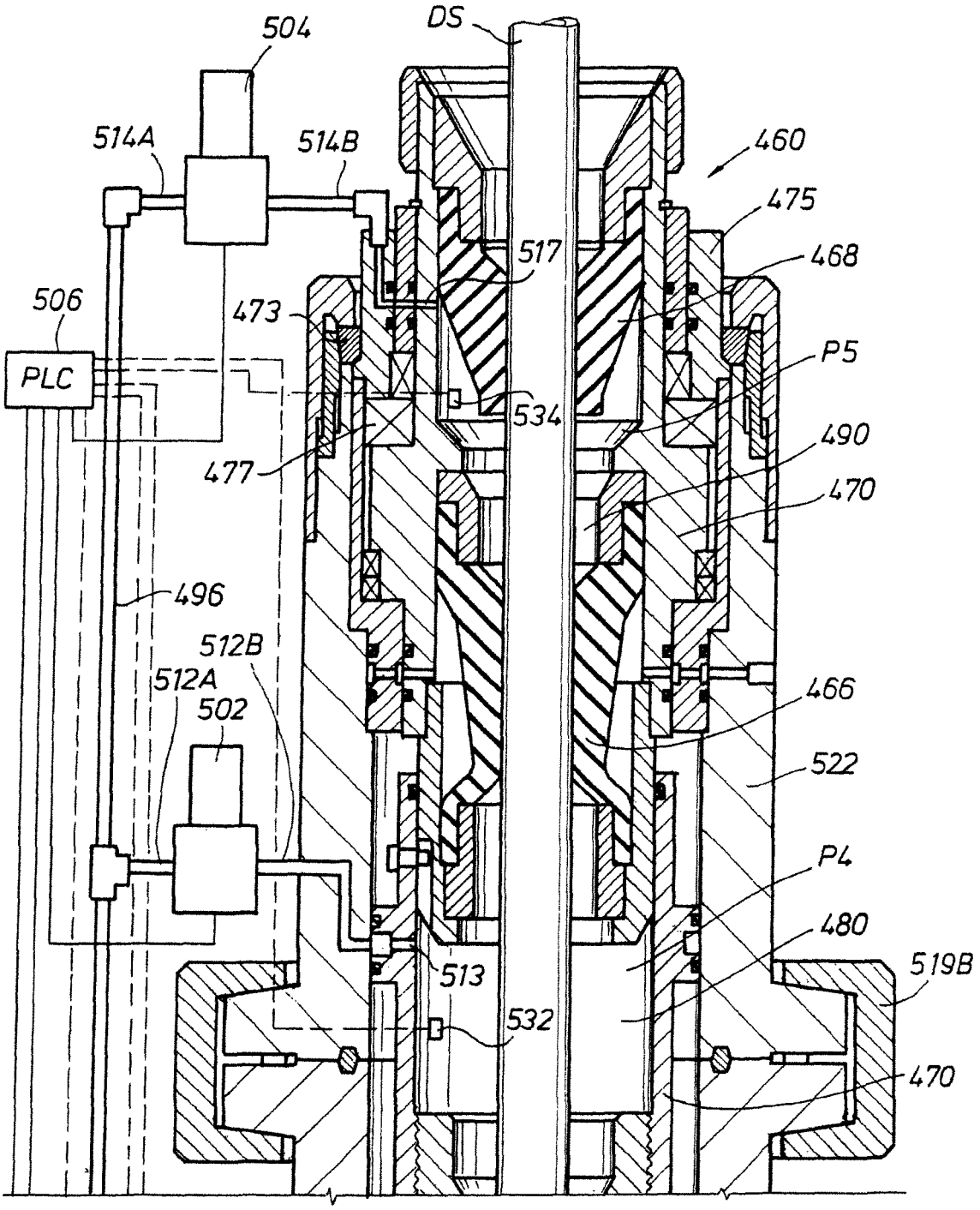
FIGS. 13A, 13B and 13C is a cut away section elevational view of an RCD with an active sealing element and three passive sealing elements on a common RCD inner member above another independent active sealing element, sensors for measuring pressures and temperatures in the diverter housing and the RCD four internal cavities between these five sealing elements, four RCD internal cavity pressure regulators, ports in the RCD bearing assembly for communicating cavity fluid with each RCD internal cavity. Some of the housings and spools are connected by bolting and the remaining housing and spools are connected using a clam shell clamping device.
Figure 13B:
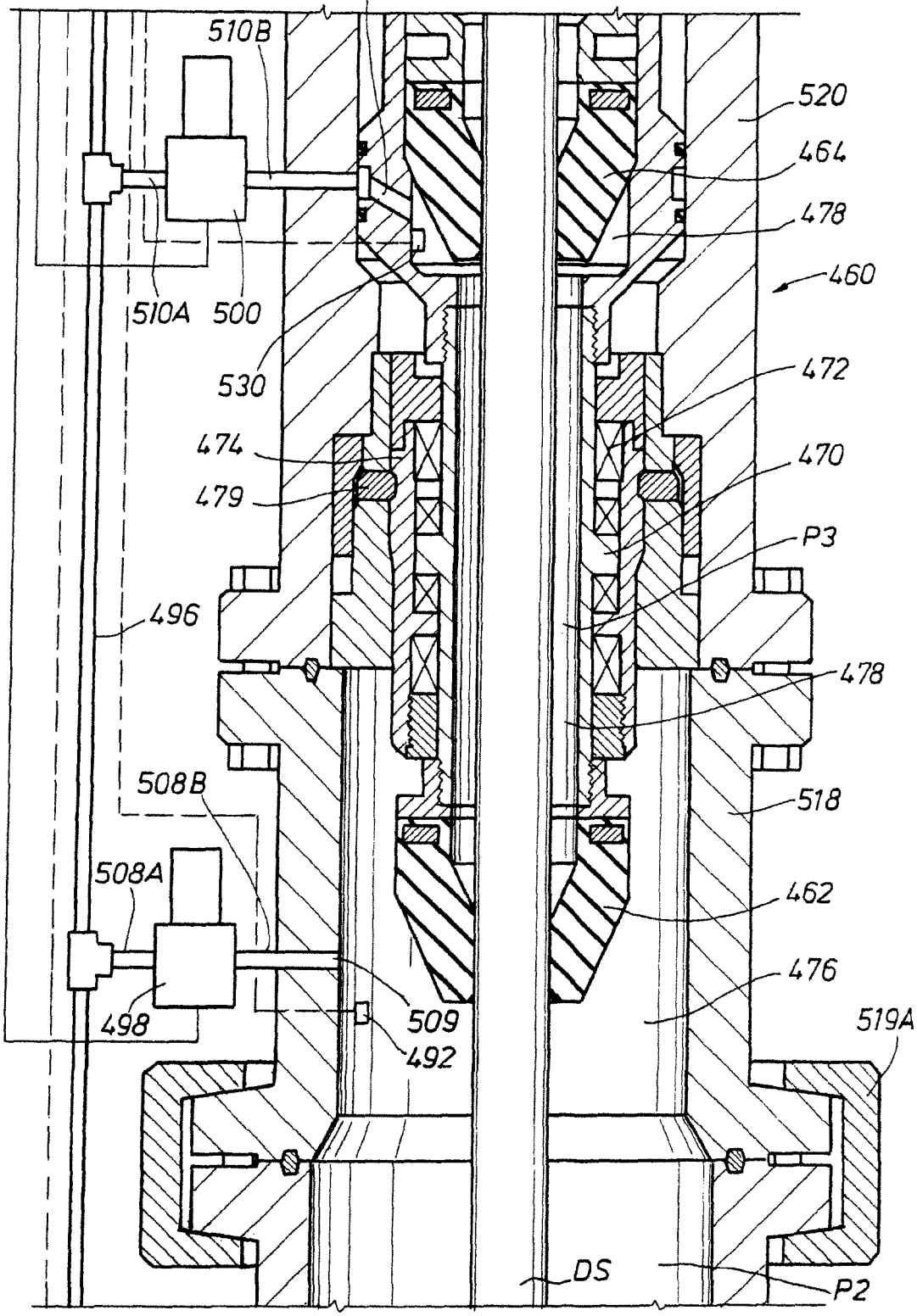
Figure 13C:
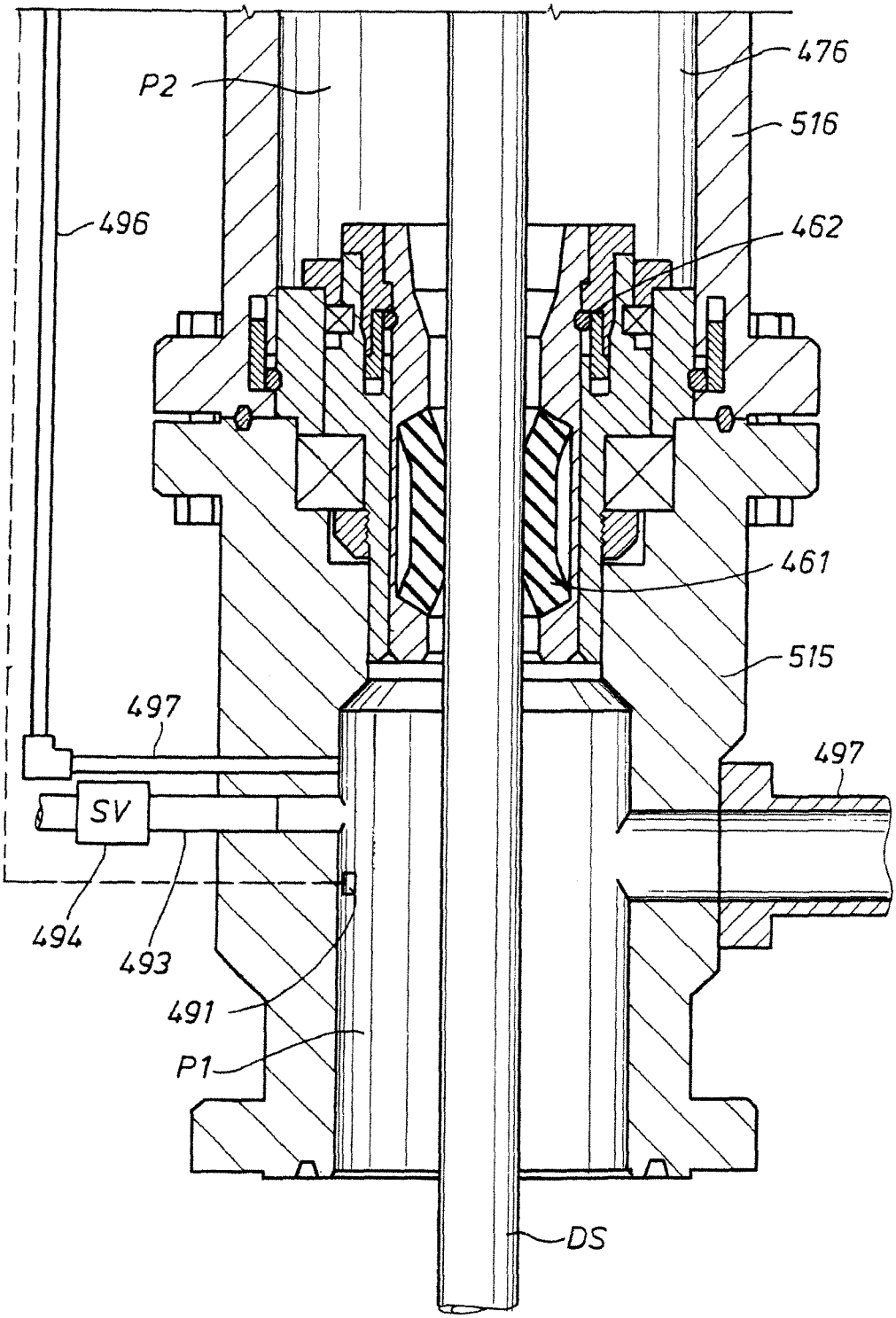

Turning to FIGS. 13A, 13B and 13C, RCD, generally indicated as 460, is positioned clamped or bolted in housings (518, 520, 522) over independent active sealing element 461, which is shown engaged on tubular or drill string DS. RCD 460 has a common inner member 470 rotatable relative to a first outer member 474 and second outer member 475 about first bearing assemblies 472 and second bearing assemblies 477. A first sealing element 462, second sealing element 464, third sealing element 466, and fourth sealing element 468 are attached to and rotate with inner member 470. Sealing elements (462, 464, 468) are passive stripper rubber sealing elements. Third sealing element 466 is an active sealing element, and is shown engaged on tubular or drill string DS.

First cavity 476 is defined by second housing or member 516, third housing or member 518, tubular or drill string DS, independent active sealing element 461, and first sealing element 462. Within RCD 460, second cavity 478 is defined by inner member 470, tubular or drill string DS, first sealing element 462, and second sealing element 464. Third cavity 480 is defined by inner member 470, tubular or drill string DS, second sealing element 464, and third sealing element 466. Fourth cavity 490 is defined by inner member 470, tubular or drill string DS, third sealing element 466, and fourth sealing element 468.

First pressure regulator or choke valve 498, second pressure regulator or choke valve 500, third pressure regulator or choke valve 502, and fourth pressure regulator or choke valve 504 are in fluid communication with each other and the wellbore pressure P1 through first regulator line 496 (via influent lines 508A, 510A, 512A, 514A) and second regulator line 497. Pressure regulators (498, 500, 502, 504) are in electrical connection with PLC 506. A first probe sensor 491 is positioned in the diverter housing 515. A second sensor 492 is positioned in first cavity 476. First pressure regulator 498 is in fluid communication with first cavity 476 through first influent line 508B and first sized influent port 509 in inner member 470. A third sensor 530 is positioned in second cavity 478. Second pressure regulator 500 is in fluid communication with second cavity 478 through second influent line 510B and second sized influent port 511 in inner member 470. A fourth sensor 532 is positioned in third cavity 480. Third pressure regulator 502 is in fluid communication with third cavity 480 through third influent line 512B and third sized influent port 513 in inner member 470. A fifth sensor 534 is positioned in fourth cavity 490. Fourth pressure regulator 504 is in fluid communication with fourth cavity 490 through fourth influent line 514B and fourth sized influent port 517 in inner member 470.

Sensors (491, 492, 530, 532, 534) may at least measure temperature and/or pressure. Sensors (491, 492, 530, 532, 534) are in electrical connection with PLC 506. Based upon information received from sensors (491, 492, 530, 532, 534), PLC 506 may signal pressure regulators (498, 500, 502, 504) so as to provide desired pressures (P2, P3, P4, P5) in the first cavity 476, second cavity 478, third cavity 480, and fourth cavity 490, respectively, in relation to each other and the wellbore pressure P1. Pumps (not shown) for active sealing elements (461, 466) are in electrical connection with PLC 506. Either one of active sealing elements (461, 466) or both of them may be pressurized to reduce slippage with the tubular or drill string DS if the PLC 506 indicates rotational difference between RCD 460 and independent sealing elements 461. Fourth sealing element 468 may be removed from above without removing any sealing element below it. Third sealing element 466 may thereafter be removed without removing the sealing elements below it, and second sealing element 464 may be removed without removing first sealing element 462. Alternatively, RCD 460 may be removed by unlatching first latch member 473 and second latch member 479. After RCD 460 is removed, latch member 462 can be unlatched and independent sealing element 461 may be removed.

First or diverter housing 515 and second housing 516 are bolted together, as are third housing 518 and fourth housing 520. However, second housing 516 and third housing 518 are clamped together with clamp 519A, and fourth housing 520 and fifth housing 522 are clamped with clamp 519B. Other alternative configurations and attachment means, as are known in the art, are contemplated. Clamps 519A and 519B may be an automatic clam shell clamping means, such as proposed in U.S. Pat. No. 5,662,181, which is incorporated herein by reference for all purposes in its entirety and is assigned to the assignee of the present invention. It is contemplated that a clamp like clamps 519A and 519B may be used in all embodiments, including where bolts are used to connect housings. Clamps allow for the housings, such as fifth housing 522 in FIG. 13A, to be remotely disassembled so as to obtain access to or remove a sealing element, such as sealing element 464 in FIG. 13B. Likewise clamp 519A can be unclamped to obtain access to or remove independent active sealing element 461.

As with other active sealing elements proposed herein, the active sealing elements 466, 461 are preferably engaged on a drill string DS when drilling and deflated to allow passage of a tool joint of drill string DS when tripping in or out. It is also contemplated that the PLC in all the embodiments could receive a signal from a sensor that a tool joint is passing a sealing element and pressure is then regulated in each cavity to inflate or deflate the respective active sealing element to minimize load across all the respective active sealing elements. As now can be better understood, the pressure regulators 498, 500, 502 and 504 can be controlled by PLC 506 to reduce wear on selected sealing elements. For example, when tripping out, the PLC automatically, or the operator could manually, deflate the active sealing elements 461, 466 so that cavity 476 pressure P2 would be equal to wellbore pressure P1. PLC 506 could then signal pressure regulator 500 to increase the pressure P3 in cavity 478 so that pressure P3 is equal to or greater than pressure P2. With pressure P3 greater than P2, it is contemplated that passive stripper rubber sealing element 462 would open/expand with less wear when a tool joint engages the nose of the sealing element 462 to begin to pass therethrough or to be stripped out. Furthermore, the pressure P4 in cavity 480 could be controlled by pressure regulator 502 so that both pressures P4 and P5, since active sealing element 466 is deflated, would be equal to or greater than pressure P3 to reduce wear on passive stripper rubber sealing element 464. In this case, passive sealing element 468 would be exposed to the higher pressure differential of atmospheric pressure resulting from pressures P3 and P4. In other words, sealing element 468 would be the sacrificial sealing element to enhance the life and wearability of the remaining sealing elements 461, 462, 464, 466.

Pressure relief solenoid valve 494 is sealingly connected with conduit 493 that is positioned across from conduit 497. Pressure relief valve 494 and conduit 493 are in fluid communication with diverter housing 515. Valve 494 may be pre-adjusted to a setting that is lower than the weakest subsurface component that defines the limit of the DTTL method, such as the casing shoe LOT or the formation fracture gradient (FIT). In the event that the wellbore pressure P1 exceeds the limit (including any safety factor), then valve 494 may open to divert the returns away from the rig floor. In other words, this valve opening may also occur if the surface back pressure placed on the wellbore fluids approaches the weakest component upstream. Alternatively, fluid could be moved through open valve 494 through conduit 493 and across housing 515 to conduit 497 to cool and clean independent sealing element 461.

Figure 14A:
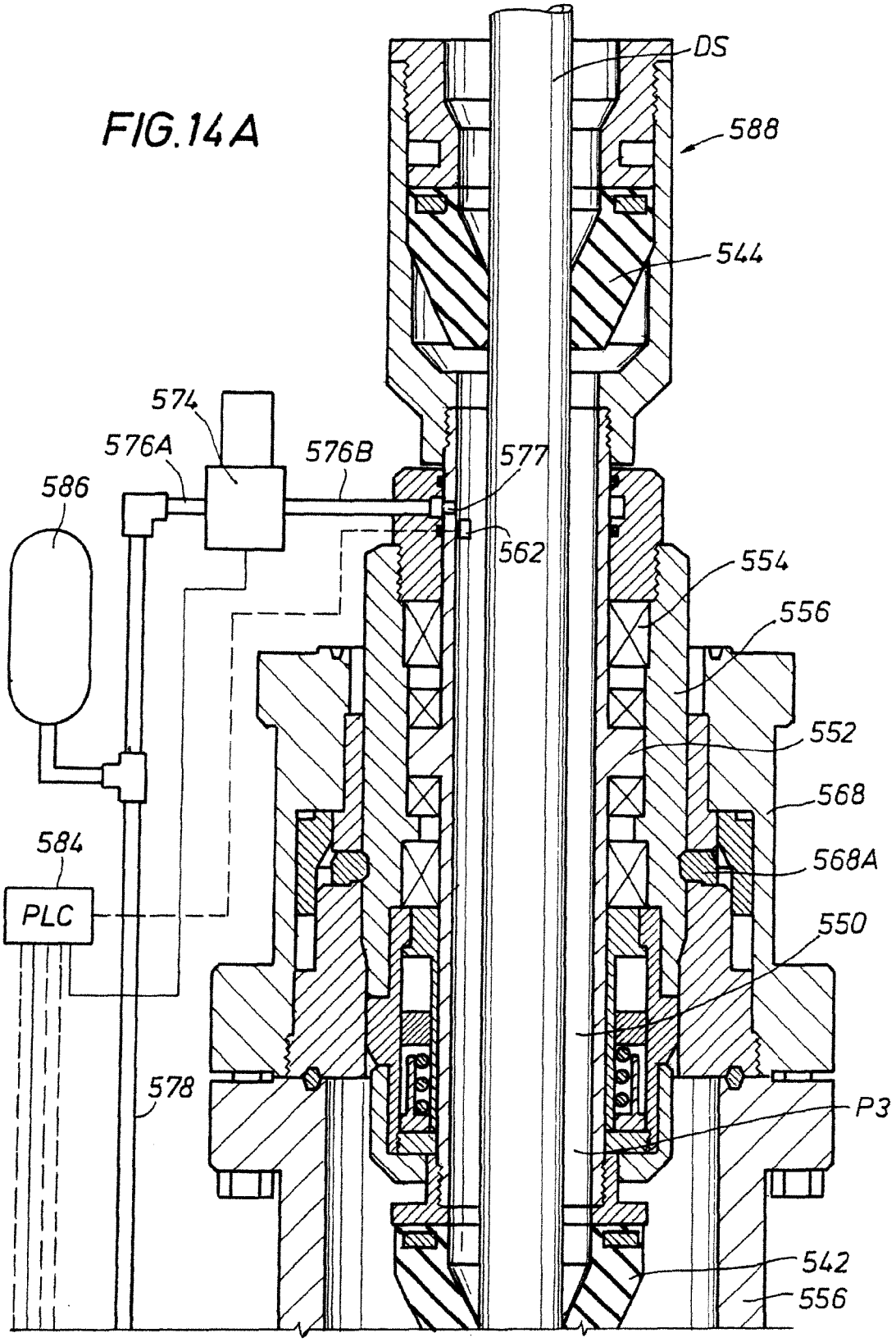
FIGS. 14A and 14B is a cut away section elevational view of an RCD with two passive sealing elements above an independent active sealing element, sensors for measuring pressures and temperatures in the diverter housing and the RCD internal cavities, upper and lower RCD internal cavity pressure regulators, sized ports in the RCD bearing assembly for communicating cavity fluid with each RCD internal cavity. The regulators are provided with an accumulator, and a solenoid valve is located in a line running from the diverter housing for controlling mud with cuttings to the upper two pressure regulators. The active sealing element can be pressurized to reduce slippage with the tubular if the PLC indicates rotational velocity differences between the passive sealing elements and the active sealing element.
Figure 14B:
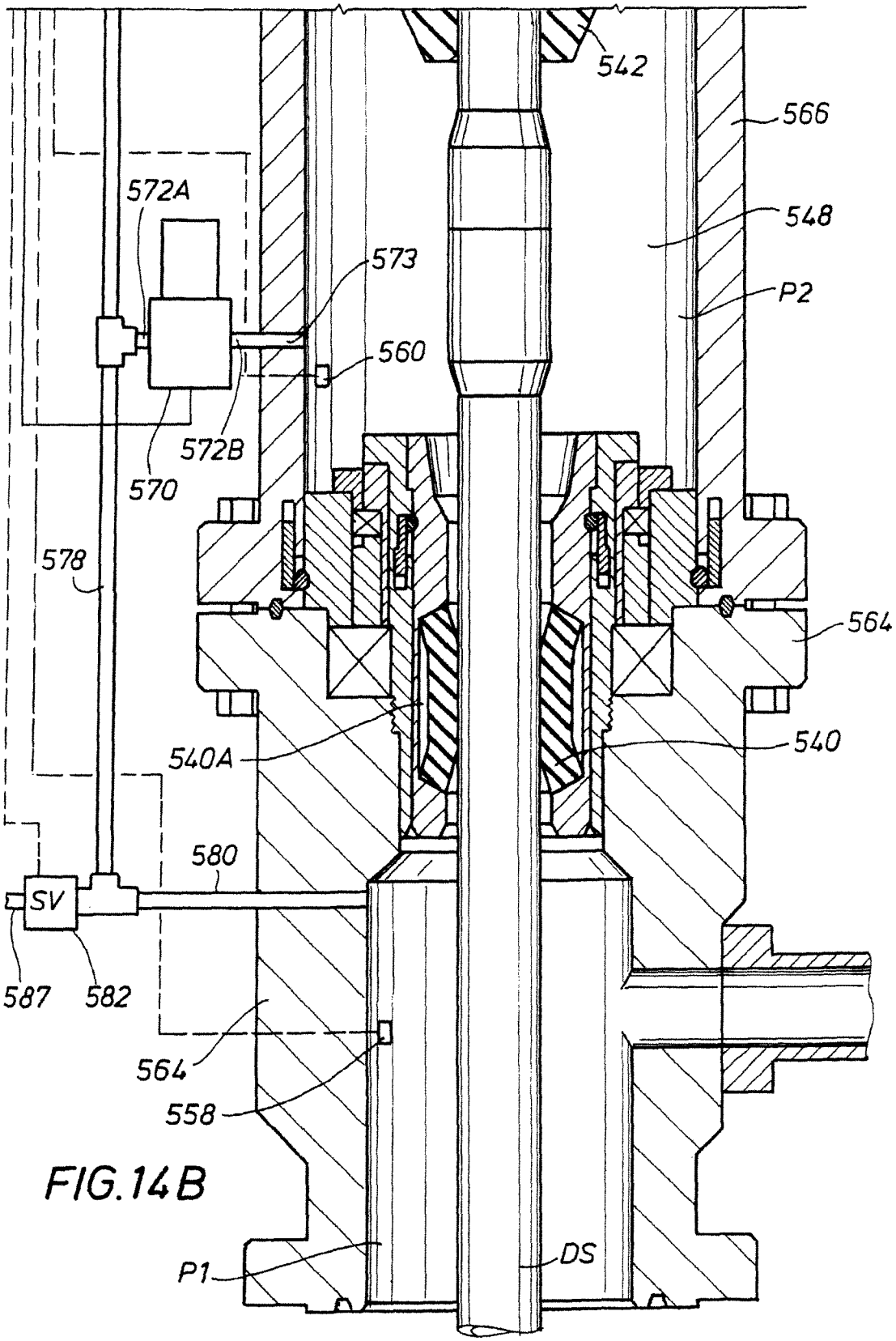

Turning to FIGS. 14A and 14B, RCD, generally indicated as 588, is latched with third housing 568, above independent active sealing element 540, which is shown engaged on tubular or drill string DS. Third housing 568 is bolted with second housing 566, and second housing 566 is bolted with first or diverter housing 564. RCD 588 has an inner member 552 rotatable relative to an outer member 556 about bearing assembly 554. A first sealing element 542 and second sealing element 544 are attached to and rotate with inner member 552. First sealing element and second sealing element (542, 544) are passive stripper rubber sealing elements.

First cavity 548 is defined by second housing or member 566, tubular or drill string DS, independent active sealing element 540, and first sealing element 542. Within RCD 588, second cavity 550 is defined by inner member 552, tubular or drill string DS, first sealing element 542, and second sealing element 544. First pressure regulator or choke valve 570 and second pressure regulator or choke valve 574 are in fluid communication with each other and the diverter housing 564 through first regulator line 578 (via influent lines 572A, 576A) and second regulator line 580. Pressure regulators (570, 574) are also in fluid communication with an accumulator 586. Accumulator 586, as well as all other accumulators as shown in all other embodiments in FIGS. 14A to 17B, may accumulate fluid pressure for use in supplying a predetermined stored fluid pressure to a cavity, such as first cavity 548 and second cavity 550 in FIGS. 14A and 14B. Accumulators may be used with all embodiments to both compensate or act as a shock absorber for pressure surges or pulses and to provide stored fluid pressure as described or predetermined. Pressure surges may occur when the diameter of the drill string DS moved through the sealing element changes, such as for example the transition from the drill pipe body to the drill pipe tool joint. The change from the volume of the drill pipe body to the tool joint in the pressurized cavity may cause a pressure surge or pulse of the pressurized fluid for which the accumulator may compensate. Pressure regulators (570, 574) are in electrical connection with PLC 584. A first sensor 558 is positioned in the diverter housing 564. A second sensor 560 is positioned in first cavity 548. First pressure regulator 570 is in fluid communication with first cavity 548 through first influent line 572B and first sized influent port 573 in second housing 566. A third sensor 562 is positioned in second cavity 550. Second pressure regulator 574 is in fluid communication with second cavity 550 through second influent line 576B and second sized influent port 577 in inner member 552.

Sensors (558, 560, 562) may at least measure temperature and/or pressure. Sensors (558, 560, 562) are in electrical connection with PLC 584. Based upon information received from sensors (558, 560, 562), PLC 584 may signal pressure regulators (570, 574) so as to provide desired pressures (P2, P3) in the first cavity 548 and second cavity 550, respectively, in relation to each other and the wellbore pressure P1. Solenoid valve 582 is positioned between the juncture of first regulator line 578 and second regulator line 580 and valve line 587. Solenoid valve 582 is in electrical connection with PLC 584. Based upon information received from sensors (558, 560, 562), PLC 584 may signal pressure solenoid valve 582 to open to relieve drilling fluid wellbore pressure from diverter housing 564 and signal the regulators (570, 574) to open/close as is appropriate. The pump (not shown) for independent active sealing element 540 is in electrical connection with PLC 584. Pressure to chamber 540A can be increased or decreased by PLC 584 to compensate for slippage, for example of sealing element 540 relative to rotation of inner member 552. Third sealing member 544 may be removed from above without removing the sealing members below it, and second sealing member 542 may be removed after removing RCD 588. First independent active sealing member 540 may be removed from above after removal of RCD 588. A single latching mechanism having latch member 568A is shown for removal of RCD 588 while a double latching mechanism having latch members 541A, 541B is provided for sealing element 540.

Figure 15A:
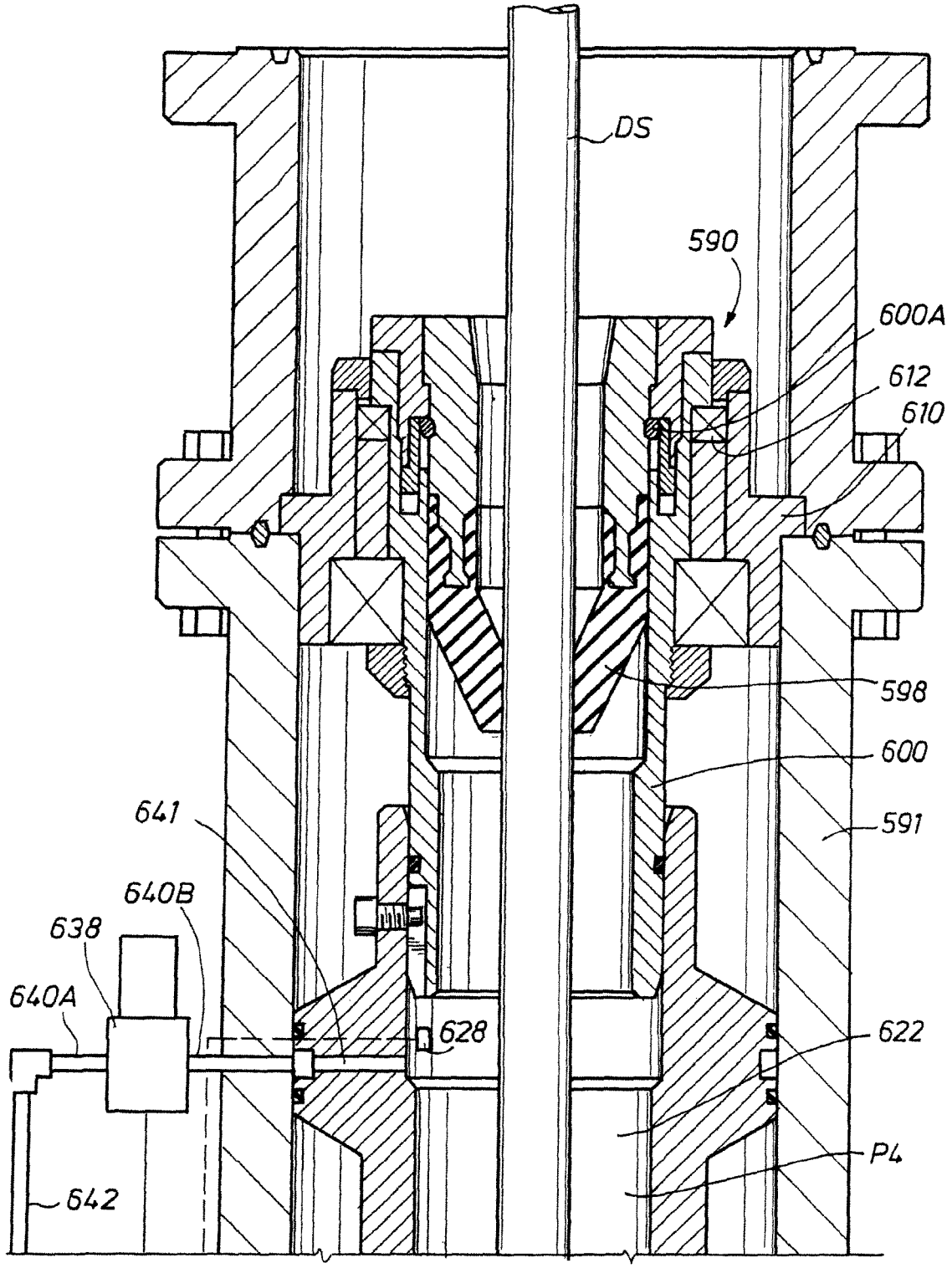
FIGS. 15A, 15B and 15C is a cut away section elevational view of an RCD with four passive sealing elements, sensors for measuring pressures and temperatures in the diverter housing and the three RCD internal cavities, three RCD internal cavity pressure regulators and sized ports in the RCD bearing assembly for communicating cavity fluid with each RCD internal cavity.
Figure 15B:
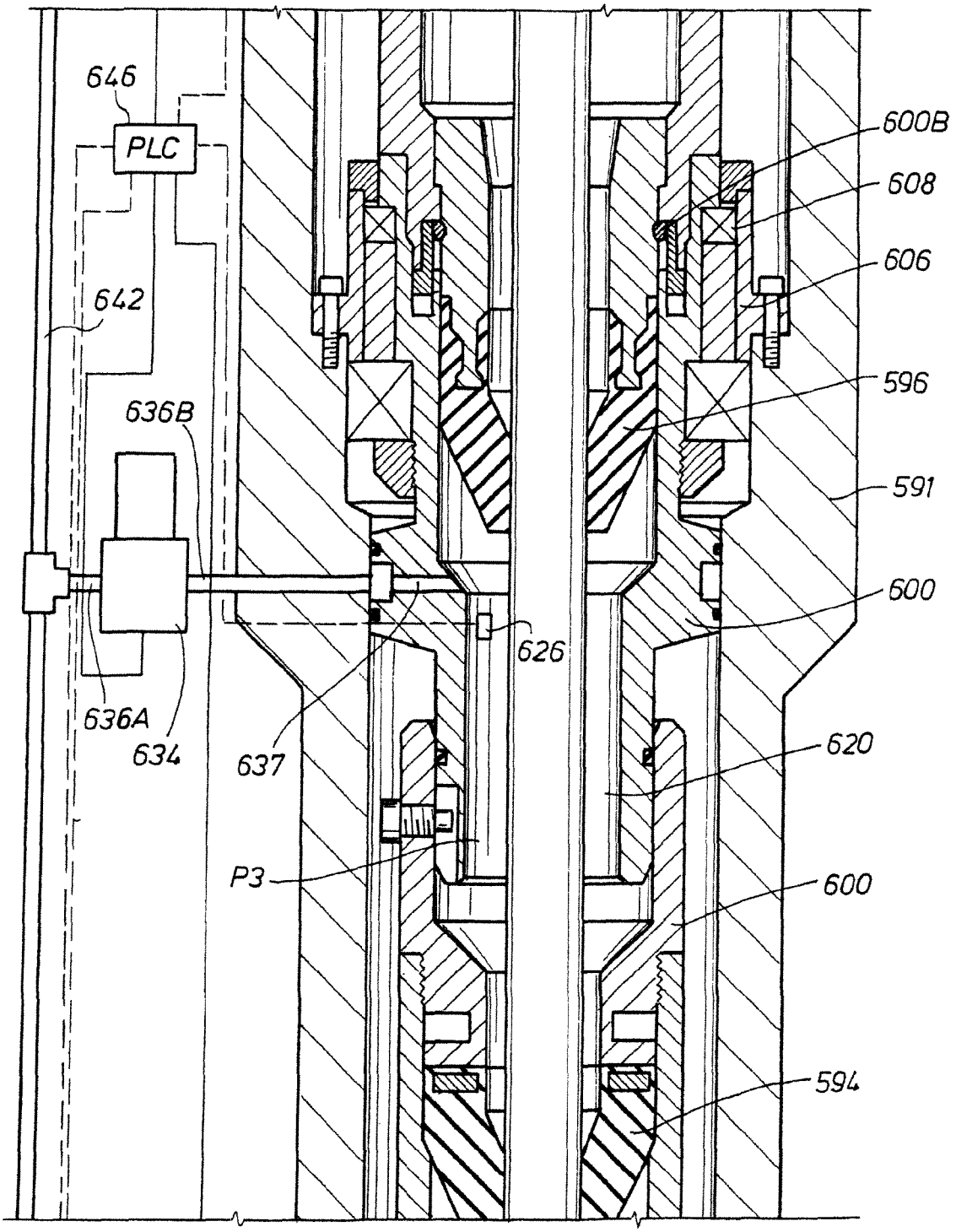
Figure 15C:
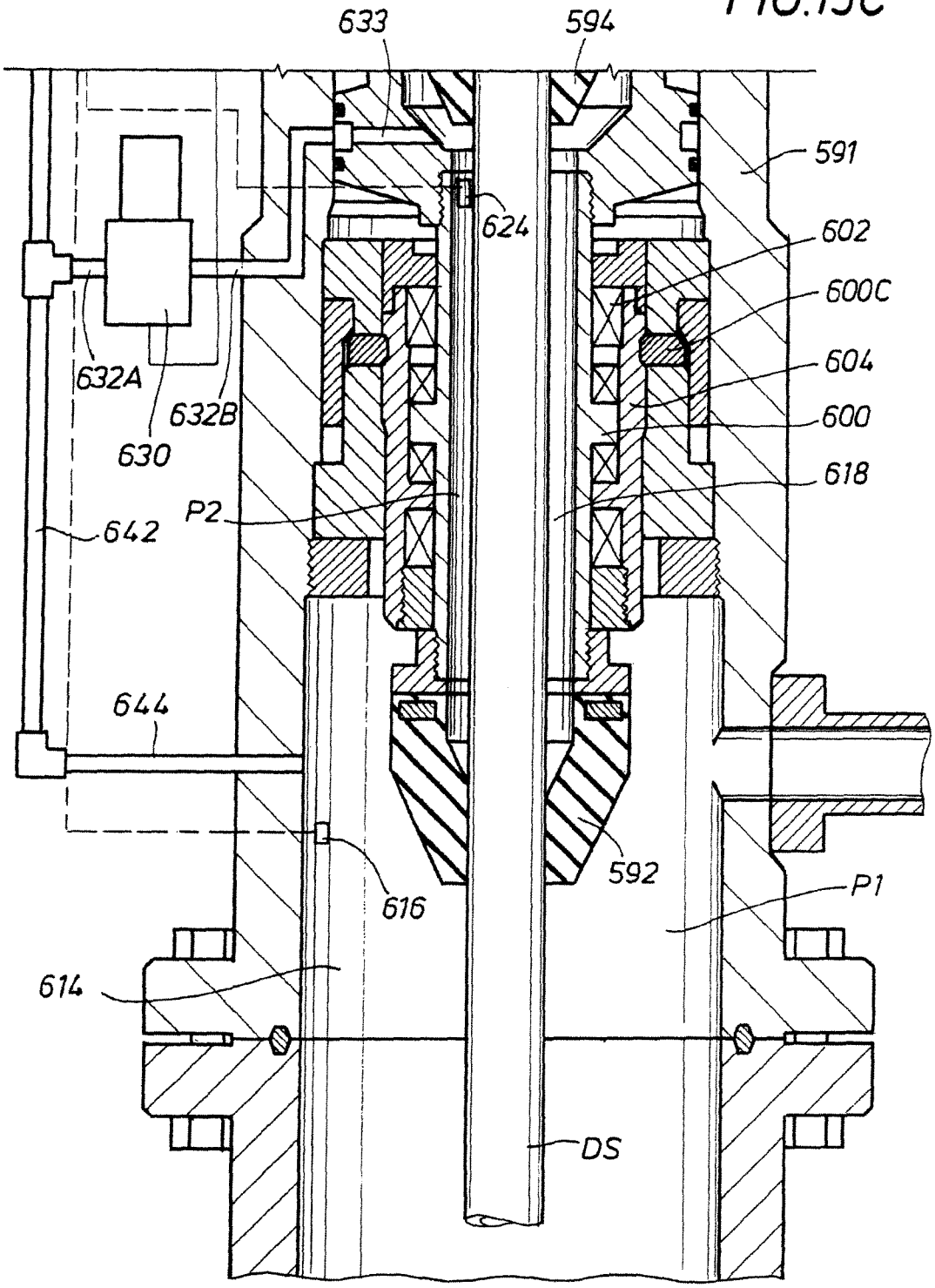

In FIGS. 15A, 15B and 15C, RCD, generally indicated as 590, is positioned in a unitary diverter housing 591. Tubular or drill string DS is positioned in RCD 590. RCD 590 has a common inner member 600 rotatable relative to a first outer member 604, second outer member 606 and third outer member 610 about a first bearing assembly 602, second bearing assembly 608 and third bearing assembly 612. A first sealing element 592, second sealing element 594, third sealing element 596, and fourth sealing element 598 are attached to and rotate with inner member 600. Sealing elements (592, 594, 596, 598) are passive stripper rubber sealing elements.

First cavity 618 is defined by inner member 600, tubular or drill string DS, first sealing element 592, and second sealing element 594. Second cavity 620 is defined by inner member 600, tubular or drill string DS, second sealing element 594, and third sealing element 596. Third cavity 622 is defined by inner member 600, tubular or drill string DS, third sealing element 596, and fourth sealing element 598.

First pressure regulator or choke valve 630, second pressure regulator or choke valve 634, and third pressure regulator or choke valve 638 are in fluid communication with each other and the wellbore pressure P1 in the lower end of diverter housing 591 through first regulator line 642 (via influent lines 632A, 636A, 640A) and second regulator line 644. Pressure regulators (630, 634, 638) are in electrical connection with PLC 646. A first probe sensor 616 is positioned in the lower end of diverter housing 591. A second sensor 624 is positioned in first cavity 618. First pressure regulator 630 is in fluid communication with first cavity 618 through first influent line 632B and first sized influent port 633 in inner member 600. A third sensor 626 is positioned in second cavity 620. Second pressure regulator 634 is in fluid communication with second cavity 620 through second influent line 636B and second sized influent port 637 in inner member 600. A fourth sensor 628 is positioned in third cavity 622. Third pressure regulator 638 is in fluid communication with third cavity 622 through third influent line 640B and third sized influent port 641 in inner member 600.

Sensors (616, 624, 626, 628) may at least measure temperature and/or pressure. Sensors (616, 624, 626, 628) are in electrical connection with PLC 646. Other sensor configurations are contemplated for FIG. 15A-15C and for all other embodiments. Based upon information received from sensors (616, 624, 626, 628), PLC 646 may signal pressure regulators (630, 634, 638) so as to provide desired pressures (P2, P3, P4) in the first cavity 618, second cavity 620, and third cavity 622, respectively, in relation to each other and the wellbore pressure P1. Fourth sealing member 598 may be removed from above without removing sealing members below it using latch 600A, third sealing member 596 may also be removed without removing the sealing members below it using latch 600B. Once the fourth sealing element is removed, the second sealing member 594 may be removed without removing first sealing member 592. First sealing member 592 may be removed with inner member 600 using latch 600C.

The pressure regulators 630, 634, 638 could be controlled by PLC 646 so that the two lower stripper rubber sealing elements 592, 594 would experience high wear. In this case, pressure P2 would be less than, perhaps one half of, the pressure P1 and pressure P3 would be less than, perhaps one-quarter of, pressure P1. This high differential pressure across sealing elements 592, 594 would cause the sealing elements 592, 594 to experience higher wear when the drill string DS and its tool joints are tripped out of the well. As a result, pressure P4 in cavity 622 could be regulated at less than one-quarter of the pressure P1 so that the differential pressure across passive sealing elements 596, 598 is reduced or mitigated. In summary, upon tripping out sacrificial passive stripper rubber sealing elements 592, 594 would experience higher wear and protected passive stripper rubber sealing elements 596, 598 would experience less wear, thereby increasing their wearability for when drilling ahead.

Figure 16A:
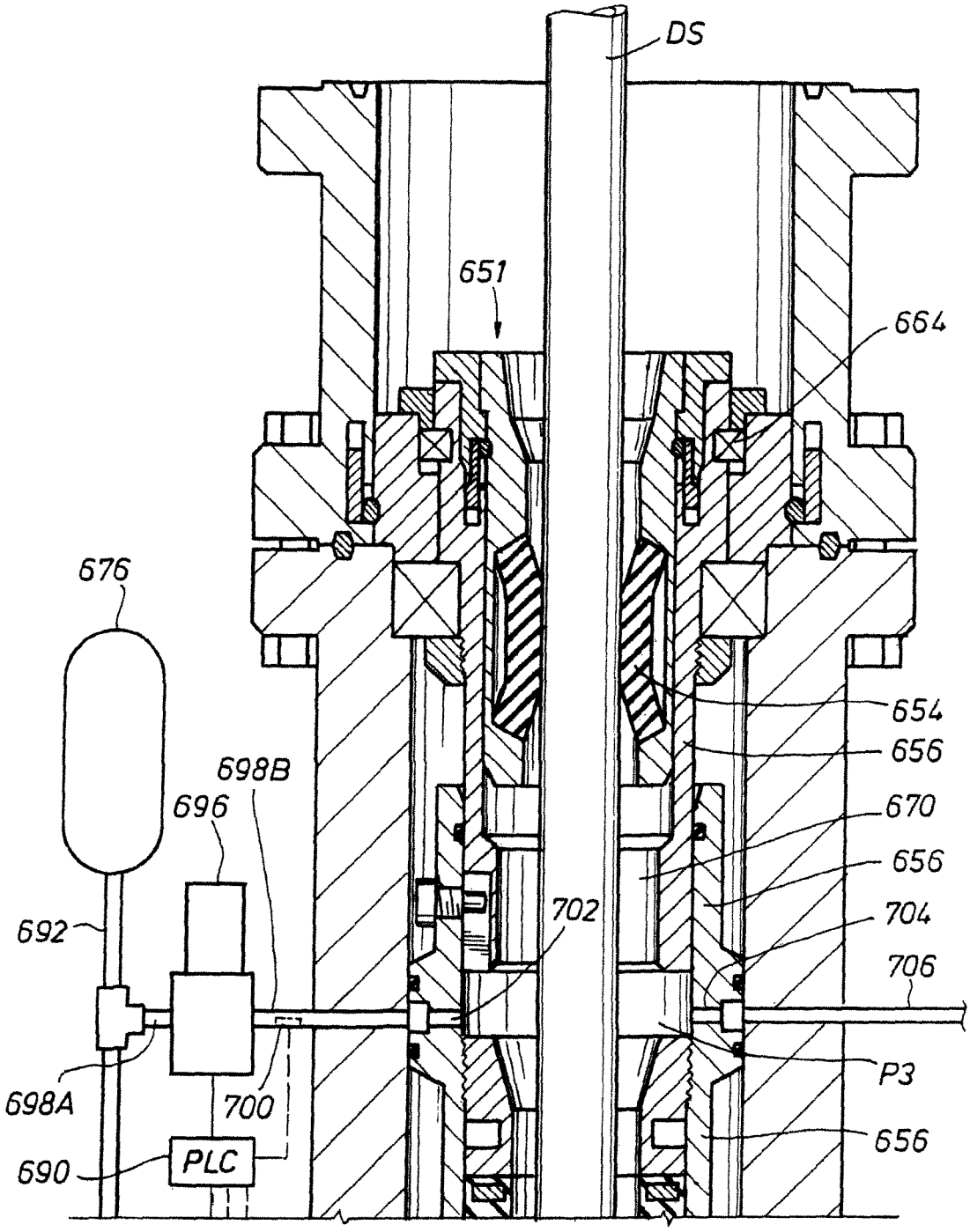
FIGS. 16A and 16B is a cut away section elevational view of an RCD with one active sealing element and two passive sealing elements, sensors for measuring pressures and temperatures in the diverter housing and into the RCD upper and lower internal cavities, upper and lower RCD internal cavity pressure regulators, and influent and effluent lines for communicating cavity fluid into, in and out of each RCD internal cavity. Three accumulators are provided in the line connecting the upper and lower pressure regulators. The active sealing element pressure can be controlled by the PLC relative to the rotation of the inner member supporting the two passive sealing elements.
Figure 16B:
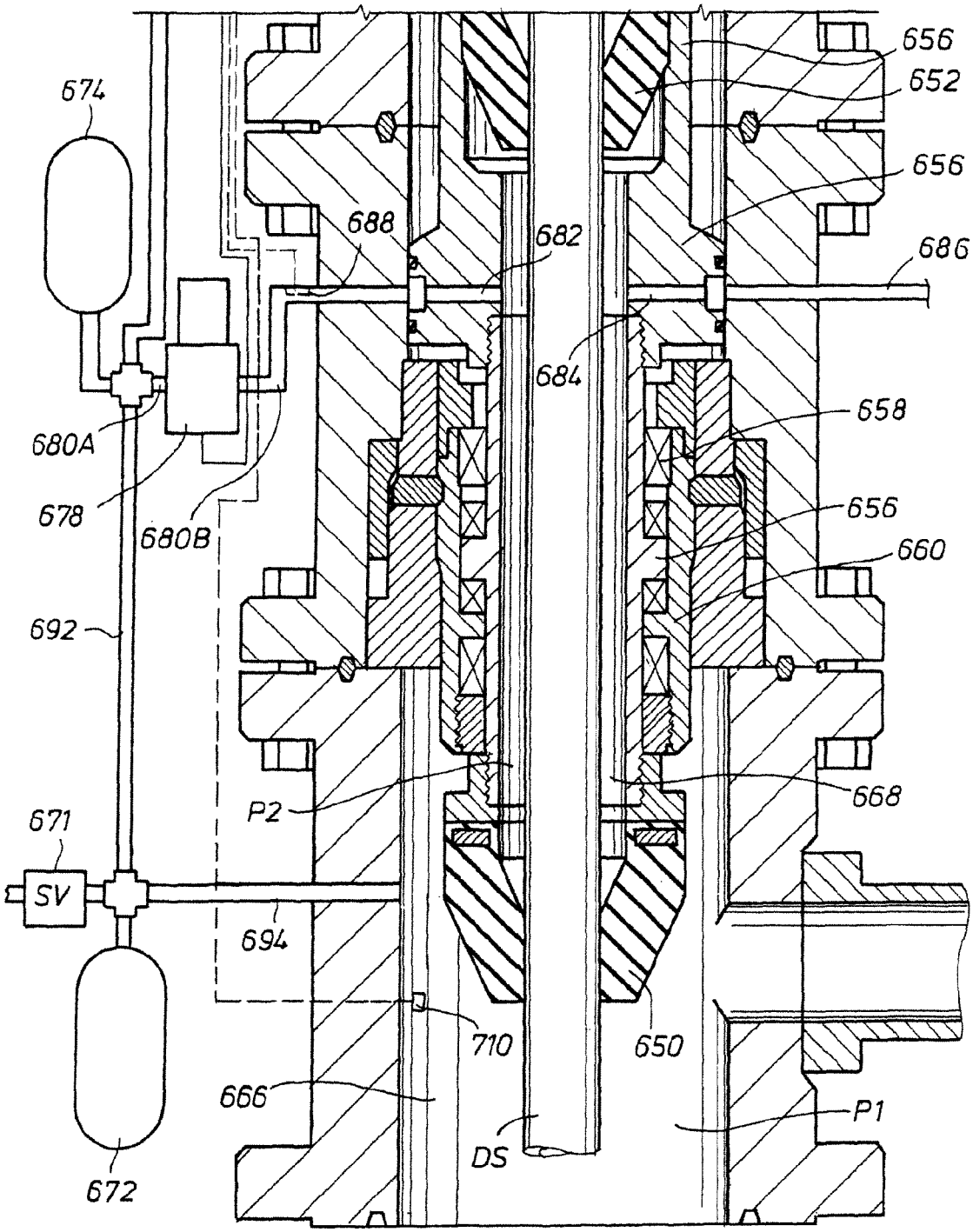

Turning to FIGS. 16A and 16B, RCD, generally indicated as 651, is positioned above diverter housing 666. Tubular or drill string DS is positioned in RCD 651. RCD 651 has a common inner member 656 rotatable relative to a first outer member 660 about a first bearing assembly 658 and second bearing assembly 664. A first sealing element 650, second sealing element 652, and third sealing element 654 are attached to and rotate with inner member 656. First sealing element 650 and second sealing element 652 are passive stripper rubber sealing elements. Third sealing element 654 is an active sealing element. First cavity 668 is defined by inner member 656, tubular or drill string DS, first sealing element 650, and second sealing element 652. Second cavity 670 is defined by inner member 656, drill string DS, second sealing element 652, and third sealing element 654.

First pressure regulator or choke valve 678 and second pressure regulator or choke valve 696 are in fluid (via influent lines 680A, 698A) communication with each other and the wellbore pressure P1 in diverter housing 666 through first regulator line 692 and second regulator line 694. Pressure regulators (678, 696) are in electrical connection with PLC 690. First accumulator 672, second accumulator 674 and third accumulator 676 are in fluid communication with first regulator line 692 and the wellbore pressure P1. Accumulators (672, 674, 676) operate as discussed above. Solenoid valve 671 is in fluid communication with first regulator line 692, second regulator line 694, and accumulator 672 and operates as discussed above. A first probe sensor 710 is positioned in the diverter housing 666 for measuring wellbore pressure P1 and temperature. A second sensor 688 is positioned in first influent line 680B. First pressure regulator 678 is in fluid communication with first cavity 668 through first influent line 680B and first-sized influent port 682 in inner member 656. First effluent line 686 is in fluid communication with first cavity 668 through first-sized effluent port 684 in inner member 656. Second pressure regulator 696 is in fluid communication with second cavity 670 through second influent line 698B and second sized influent port 702 in inner member 656. A third sensor 700 is positioned in second influent line 698B. Second effluent line 706 is in fluid communication with second cavity 670 through second sized effluent port 704 in inner member 656.

Sensors (688, 700, 710) may at least measure temperature and/or pressure. Sensors (688, 700, 710) are in electrical connection with PLC 690. Based upon information received from sensors (688, 700, 710), PLC 690 may signal pressure regulators (678, 696) so as to provide desired pressures (P2, P3) in the first cavity 668 and second cavity 670, respectively, in relation to each other and the wellbore pressure P1. Pump (not shown) for active sealing element 654 is in electrical connection with PLC 690. PLC 690 may also signal solenoid valve 671 to open or close as discussed above in detail.

Figure 17A:
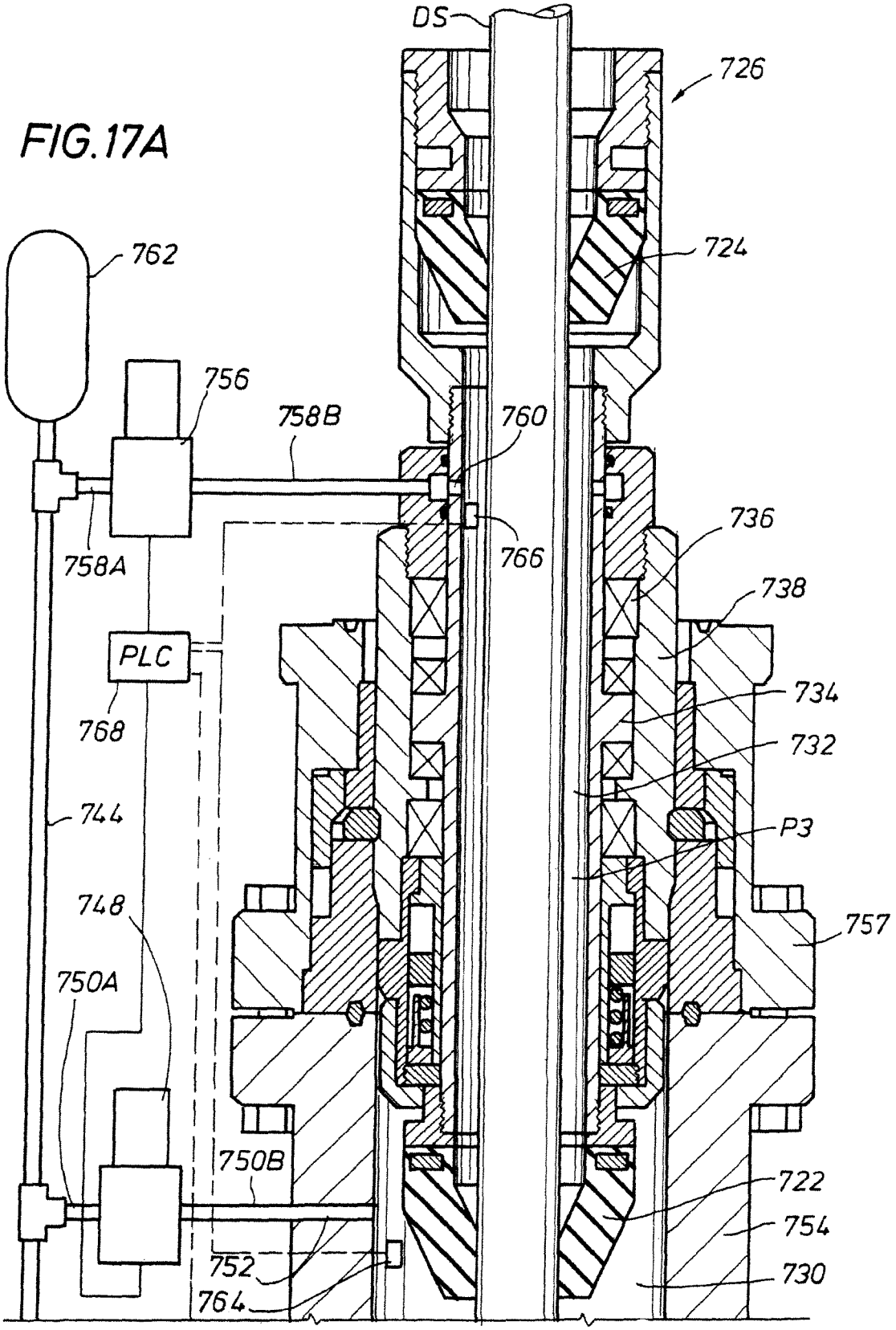
FIGS. 17A and 17B is a cut away section elevational view of an RCD with two passive sealing elements above an independent active sealing element, sensors for measuring pressures and temperatures in the diverter housing and the RCD upper and lower internal cavities, upper and lower RCD internal cavity pressure regulators and ports in the RCD bearing assembly for communicating cavity fluid with each RCD internal cavity. An accumulator is provided in the lines between the pressure regulators and a solenoid valve is provided in the line from the diverter housing. Additionally, the tubular extending through the RCD is provided with a stabilizer below the RCD.
Figure 17B:
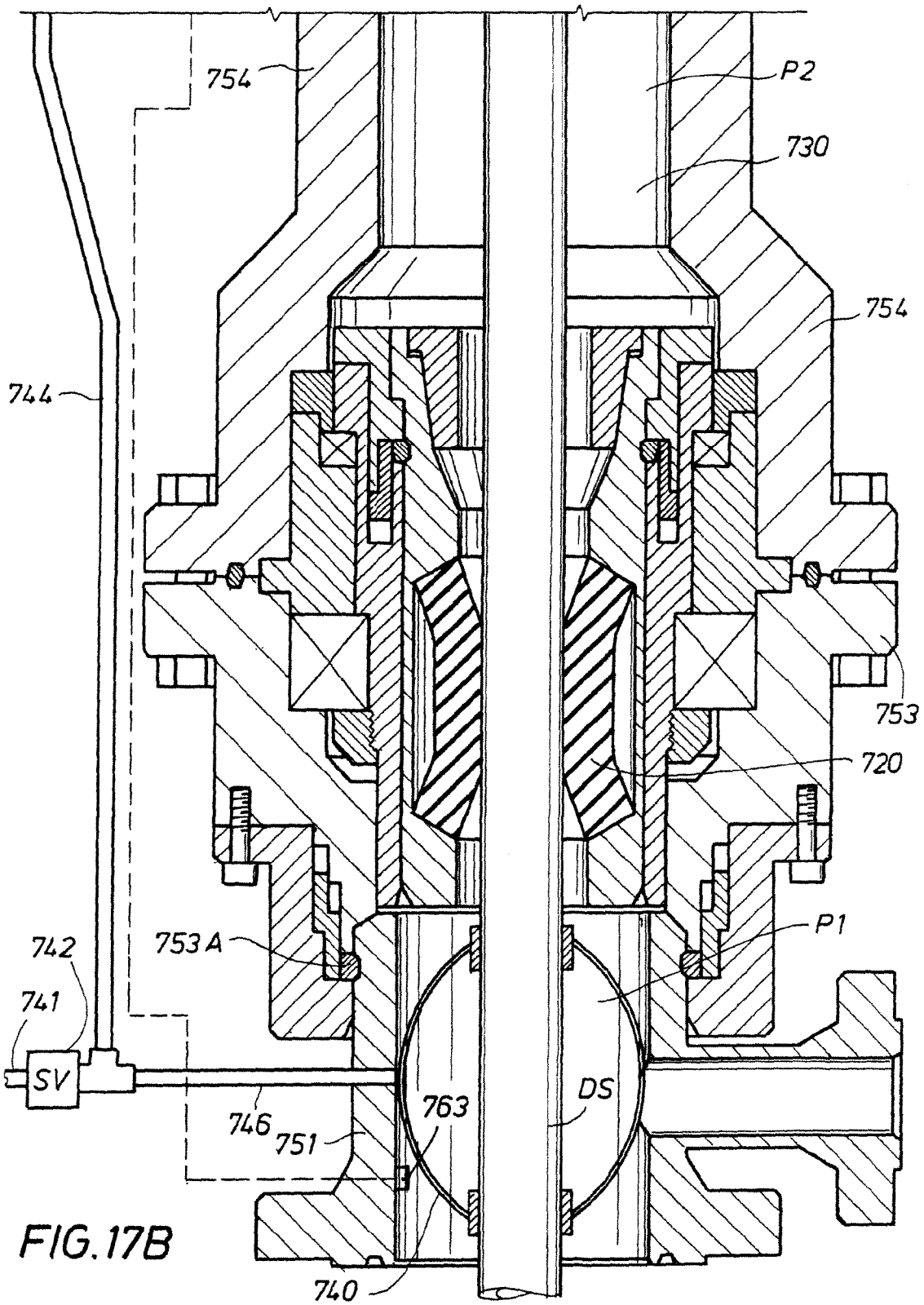

In FIGS. 17A and 17B, RCD, generally indicated as 726, is latched with fourth housing 757, over independent active sealing element 720, which is shown engaged on tubular or drill string DS. Fourth housing 757 is bolted with third housing 754, third housing 754 is bolted with second housing 753, and second housing 753 is latched using latch 753A with first or diverter housing 751. RCD 726 has an inner member 734 rotatable relative to an outer member 738 about bearings 736. A first sealing element 722 and second sealing element 724 are attached to and rotate with inner member 734. Sealing elements (722, 724) are passive stripper rubber sealing elements.

First cavity 730 is defined by third housing or member 754, tubular or drill string DS, independent active sealing element 720, and first sealing element 722. Within RCD 726, second cavity 732 is defined by inner member 734, tubular or drill string DS, first sealing element 722, and second sealing element 724. First pressure regulator or choke valve 748 and second pressure regulator or choke valve 756 are in fluid communication with each other and the wellbore pressure P1 in diverter housing 751 through first regulator line 744 (via influent lines 750A, 758A) and second regulator line 746. Pressure regulators (748, 756) are also in fluid communication with an accumulator 762. Pressure regulators (748, 756) are in electrical connection with PLC 768. A first sensor 763 is positioned in the diverter housing 751. A second sensor 764 is positioned in first cavity 730. First pressure regulator 748 is in fluid communication with first cavity 730 through first influent line 750B and first sized influent port 752 in third housing 754. A third sensor 766 is positioned in second cavity 732. Second pressure regulator 756 is in fluid communication with second cavity 732 through second influent line 758B and second sized influent port 760 in inner member 734.

Sensors (763, 764, 766) may at least measure temperature and/or pressure. Sensors (763, 764, 766) are in electrical connection with PLC 768. Based upon information received from sensors (763, 764, 766), PLC 768 may signal pressure regulators (748, 756) so as to provide desired pressures (P2, P3) in the first cavity 730 and second cavity 732, respectively, in relation to each other and the wellbore pressure P1. Accumulator 762 is in fluid communication with first regulator line 744 and therefore the wellbore pressure P1. Solenoid valve 742 is positioned between the juncture of first regulator line 744 and second regulator line 746 in valve line 741. Solenoid valve 742 is in electrical connection with PLC 768. Based upon information received from sensors (763, 764, 766), PLC 768 may signal solenoid valve 742 as discussed above. Pump (not shown) for active sealing element 720 is also in electrical connection with PLC 768. The active sealing element 720 may be activated, among other reasons, to compensate for rotational differences of the drill string DS with the passive sealing elements. Stabilizer 740 for drill string DS is positioned below independent active sealing element 720. Drill string stabilizer 740 may be used to retrieve active sealing element 720 after the RCD 726 is removed. It is contemplated that a stabilizer to remove sealing elements may be used with all embodiments of the invention.

Not only may the pressure between a pair of active/passive sealing elements be adjusted, but also for a configuration in which an RCD is used within a riser, the pressure above the uppermost sealing element may be controlled—for example, by selecting the density and/or the level of fluid within the riser above the RCD. Depending upon the location of the RCD within the riser (i.e., towards the top, in the middle, towards the bottom, etc.), the selection of fluid type, density and level within the riser above the RCD may have a significant effect upon the pressure differential experienced by the uppermost seal of the RCD. Hence, the annular space within the riser above an RCD presents an additional "cavity", the pressure within which may also be controlled to a certain extent.

A drilling operation utilizing an RCD may comprise several "phases", each phase presenting different demands upon the integrity and longevity of an RCD active or passive sealing element. Such phases may include running a drill string into the wellbore, drilling ahead while rotating the drill string, drilling ahead while not rotating the drill string (i.e., when a mud motor is used to rotate the drill bit), drilling ahead across a geological boundary into a zone exhibiting higher or lower pressure, reciprocation of the drill string, pulling a drill string out of the wellbore, etc. Each of these phases places a different demand upon the sealing elements of an RCD. For example, running a drill string into the wellbore may not be particularly detrimental to the downwardly and inwardly taper of passive stripper rubber sealing elements; however, such a configuration may be very detrimental when the drill string is pulled out of the wellbore and successive upset tool joints are forced upwards past each sealing element.

The pressures within each cavity may be controlled during any phase of the drilling operation, such that adjustment of pressures within one or more cavities may be tailored to each phase of the drilling operation. Furthermore, the pressures within each cavity may be changed occasionally or regularly while a single phase of the drilling operation is proceeding to spread or "even out" the demand placed upon one or more sealing elements.

For example, in operating a multi-seal RCD, the pressures within one or more cavities may be adjusted such that one particular sealing element experiences a relatively high differential pressure, and thereby is considered the "main" sealing element. This would be the case if one or more additional sealing elements within the RCD were to be employed as a "reserve" or protected sealing element, ready to be used as the new "main or sacrificial" sealing element should the original "main or sacrificial" sealing element fail. An operator may not wish to place such a demand on any one sealing element for a prolonged period, and therefore may periodically choose to adjust the pressures within the cavities of the RCD such that other sealing elements within the RCD are utilized as the "main or sacrificial" sealing element, even though the integrity of the original "main" sealing element may still be good.

In this way, a periodic assessment of the integrity of each sealing element may be performed while the RCD is in operation, and the risk of failure of any one sealing element may be reduced.

Additionally, adjustment of the pressures within the cavities may be made according to which of the above phases of the drilling operation are being conducted. For example, in a multi-seal RCD, one or more sealing elements may be primarily employed to contain the wellbore pressure during the drilling phase—i.e., while the bit is rotating at the bottom of the wellbore, and the open hole section is being extended. When it is desired to pull the drill string out of the wellbore, it may be preferred that one or more other sealing elements be selected for the duty of primary pressure containment. This is particularly relevant for those embodiments which include both active and passive sealing elements. It may be desired to use an active sealing element only while drilling is progressing, with little or no demand being placed upon the passive sealing elements. When pulling the drill string out of the wellbore, the active sealing element may be de-activated or deflated, and so the remaining passive sealing elements are selected to contain the wellbore pressure. Similarly, for those embodiments employing only multiple passive sealing elements, the pressures within each cavity may be adjusted such that selected sealing element(s) primarily withstand wellbore pressure during the drilling phase, whereas other sealing element(s) primarily withstand wellbore pressure while pulling the drill string out of the wellbore. In this scenario, the material and configuration of the material used in each sealing element may be selected such that those identified for primary use while pulling the drill string out of the wellbore may be constructed of a more abrasion-resistant material than those sealing elements selected for primary use while drilling.

In a further embodiment, the instantaneous differential pressure experienced by a sealing element may be controlled specifically to coincide with the passage of an article, for example, a tool joint of a drill string, through the sealing element. For example, while pulling a drill string out of a wellbore though multiple passive sealing elements, many tool joints are forced through the sealing elements, which is most detrimental to the integrity and life of the sealing elements if this occurs simultaneously while the sealing elements themselves are subject to withstanding the pressure within the wellbore. Therefore, an operator may choose to adjust the differential pressure experienced by a particular sealing element to coincide with the passage of a tool joint through that sealing element. The pressure within one or more cavities may be adjusted such that the pressure above a sealing element is slightly less than, equal to, or greater than the pressure below the sealing element when the tool joint is being raised through the sealing element. When the tool joint has passed through a sealing element and is about to be passed through a second sealing element, the pressures within each cavity may be adjusted again such that the conditions under which the tool joint passed though the first sealing element are replicated for the second sealing element. In this way, the pulling out of successive tool joints past each sealing element need not be as detrimental to the sealing elements as it would have been had this pressure control not been employed.

It should be noted that for all situations described above in which the pressures within the cavities are adjusted according to the phase of the drilling operation, or the timing of events, or according to operator selection, the monitoring and adjustment may be accomplished using manual control, using preprogrammed control via one or more PLCs, using programmed control to react to a sensor output (again via a PLC), or by using any combination of these.

The foregoing disclosure and description of the invention are illustrative and explanatory thereof, and various changes in the details of the illustrated apparatus and system, and the construction and method of operation may be made without departing from the spirit of the invention.

We claim:

1. Method for cooling a first sealing element of a rotating control device configured for use above a wellbore, wherein said rotating control device having an inner member, said first sealing element and a second sealing element rotatable relative to an outer member, the method comprising the steps of:

positioning a tubular with said rotating control device;

sealing said first sealing element and said second sealing element of said rotating control device with said tubular;

communicating a pressure to a first cavity defined by said rotating control device inner member, said rotating control device first sealing element, said rotating control device second sealing element and said tubular, said first sealing element having a first sealing element cavity side surface and a first sealing element wellbore side surface;

measuring a pressure on said first sealing element wellbore side surface; and supplying a cooling fluid in said first cavity during the step of sealing said first sealing element and said second sealing element with said tubular so that the pressure on said first sealing element cavity side surface is greater than said measured pressure on said first sealing element wellbore side surface.

2. The method of claim 1, further comprising the step of:

circulating the cooling fluid in said first cavity.

3. The method of claim 1, further comprising the step of:

allowing said first sealing element to pass the cooling fluid from said first cavity, wherein said passed fluid includes nitrogen from said first cavity.

4. The method of claim 1, wherein said first sealing element is an active seal, further comprising:

stripping said tubular through said first sealing element after the step of supplying said cooling fluid in said first cavity; and reducing a sealing pressure of said active seal during the step of stripping said tubular.

5. The method of claim 1, wherein said first cavity configured to receive a gas and the method further comprising the step of:

injecting said gas into said first cavity through a gas expansion nozzle.

6. The method of claim 1, further comprising the step of:

allowing the cooling fluid to pass between said first sealing element and said tubular, wherein the cooling fluid cools said first sealing element when passed therebetween.

7. The method of claim 1, further comprising the step of:

measuring said first sealing element cavity side surface pressure before and/or during the step of supplying the cooling fluid.

8. The method of claim 1, wherein said inner member having a first influent port configured for communicating said pressure and supplying said cooling fluid to said first cavity.

9. The method of claim 1, further comprising the step of:

flowing a second cooling fluid adjacent said first sealing element wellbore side surface during the step of supplying said cooling fluid in the first cavity.

10. The method of claim 1, further comprising:
calculating a pressure differential across the first sealing element; and
increasing the pressure differential to overcome a stretch tightness of the first sealing element;
wherein the calculated pressure differential is based on a measured first sealing element cavity side surface pressure and the measured first sealing element wellbore side surface pressure; and
wherein the calculating of the pressure differential is performed by a programmable logic controller.

11. The method of claim 1, further comprising:
a first sensor configured for measuring the pressure on said first sealing element wellbore side surface.

12. A rotating control apparatus configured to receive a tubular, comprising:
an outer member;
an inner member having a first sealing element and a second sealing element, said inner member, said first sealing element and said second sealing element rotatable relative to said outer member;
said inner member, the tubular, said first sealing element and said second sealing element defining a first cavity;
a first sensor configured for measuring a temperature in said first cavity; and
a fluid source configured to communicate with said first cavity to provide a first predetermined fluid temperature to said first cavity.

13. The apparatus of claim 12, further comprising:
said outer member having a first influent port configured to communicate said first predetermined fluid temperature to said first cavity; and
said outer member having a first effluent port configured to communicate with said first cavity.

14. The apparatus of claim 12, further comprising:
a third sealing element rotatable relative to said outer member;
the tubular, said inner member, said third sealing element and said second sealing element defining a second cavity; and
a second fluid source configured to communicate with said second cavity to provide a second predetermined fluid temperature to said second cavity;
wherein said outer member having a second influent port configured to communicate said second predetermined fluid temperature to said second cavity; and
wherein said outer member having a second effluent port configured to communicate with said second cavity.

15. The apparatus of claim 14, further comprising:
a second sensor configured for measuring a temperature in said second cavity.

16. A rotating control system configured to receive a tubular, comprising:
a first rotating control device comprising:
a first outer member;
a first inner member having a first sealing element and a second sealing element; and
said first inner member, said first sealing element, and said second sealing element rotatable relative to said first outer member, said first inner member, the tubular, said first sealing element, and said second sealing element defining a first rotating control device cavity;
a sensor configured for measuring a temperature in said first rotating control device cavity; and
a first fluid source configured to provide a first predetermined fluid temperature to said first rotating control device cavity.

17. The system of claim 16, further comprising:
means for accumulating fluid at the first predetermined temperature to communicate with said first rotating control device cavity.

18. The system of claim 16, further comprising:
a second rotating control device comprising:
a second outer member;
a second inner member having a third sealing element and a fourth sealing element; and
said second inner member, said third sealing element and said fourth sealing element rotatable relative to said second outer member, said second inner member, the tubular, said third sealing element and said fourth sealing element defining a second rotating control device cavity; and
a second fluid source configured to provide a second predetermined fluid temperature to said second rotating control device cavity.

19. The system of claim 18, further comprising:
a second sensor configured for measuring a temperature in said second rotating control device cavity.

20. The system of claim 16, further comprising:
a third sealing element rotatable relative to said outer member;
the tubular, said inner member, said third sealing element and said second sealing element defining a second cavity; and
a second fluid source configured to communicate with said second cavity to provide a second predetermined fluid temperature in said second cavity.

21. The system of claim 16, wherein a programmable logic controller is configured to calculate said first predetermined fluid temperature.

22. The system of claim 16, further comprising:
a pressure sensor configured for measuring a pressure in said first rotating control device cavity.

23. A method for cooling a rotating control device, said rotating control device comprising an inner member having a first sealing element and a second sealing element rotatable relative to an outer member, said first sealing element having a first sealing element cavity side surface and a first sealing element wellbore side surface, the method comprising the steps of:
measuring a temperature adjacent said first sealing element wellbore side surface;
positioning a tubular with said rotating control device to form a first cavity, the first cavity defined by said rotating control device inner member, said rotating control device first sealing element, said rotating control device second element, and the tubular;
sealing said first sealing element and said second sealing element of said rotating control device with the tubular;
calculating a first predetermined fluid cavity temperature using said measured temperature adjacent said first sealing element wellbore side surface, wherein the first predetermined fluid cavity temperature is lower than the measured temperature adjacent said first sealing element wellbore side surface; and
cooling the rotating control device by circulating a first fluid at the first predetermined fluid cavity temperature through said first cavity.

24. The method of claim 23, further comprising the steps of:
providing a third sealing element with said inner member; and
cooling a second cavity to a second predetermined fluid temperature, the second cavity defined by said rotating control device inner member, said rotating control device second sealing element and a rotating control device third sealing element when said second sealing element and said third sealing element are sealed on said tubular.

25. The method of claim 23, wherein said first predetermined fluid cavity temperature in said first cavity is lower than said measured temperature adjacent said first sealing element wellbore side surface.

26. The method of claim 23, further comprising the step of:

urging one of said sealing elements to pass the first fluid from said first fluid cavity, wherein said passed fluid includes nitrogen from said first fluid cavity.

27. The method of claim 23, wherein said first predetermined fluid cavity temperature in said first cavity is different than said measured temperature adjacent said first sealing element wellbore side surface.

28. The method of claim 23, wherein the step of calculating is enabled by a programmable logic controller.

* * * * *